US010134332B2

(12) United States Patent
Kimura et al.

(10) Patent No.: US 10,134,332 B2
(45) Date of Patent: Nov. 20, 2018

(54) DISPLAY DEVICE, ELECTRONIC DEVICE, AND DRIVING METHOD OF DISPLAY DEVICE

(71) Applicant: Semiconductor Energy Laboratory Co., Ltd., Atsugi-shi, Kanagawa-ken (JP)

(72) Inventors: Hajime Kimura, Atsugi (JP); Shunpei Yamazaki, Setagaya (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 11 days.

(21) Appl. No.: 15/062,261

(22) Filed: Mar. 7, 2016

(65) Prior Publication Data

US 2016/0275863 A1 Sep. 22, 2016

(30) Foreign Application Priority Data

Mar. 18, 2015 (JP) ..... 2015-055382

(51) Int. Cl.
*G09G 5/10* (2006.01)
*G09G 3/3233* (2016.01)

(52) U.S. Cl.
CPC ... *G09G 3/3233* (2013.01); *G09G 2300/0866* (2013.01); *G09G 2320/043* (2013.01)

(58) Field of Classification Search
CPC ..... G09G 2300/0866; G09G 2320/043; G09G 3/3233
See application file for complete search history.

(56) References Cited

U.S. PATENT DOCUMENTS 5,731,856 A 3/1998 Kim et al.
5,744,864 A 4/1998 Cillessen et al.
6,294,274 B1 9/2001 Kawazoe et al.
6,563,174 B2 5/2003 Kawasaki et al.
6,580,094 B1 6/2003 Yamazaki et al.
6,727,522 B1 4/2004 Kawasaki et al.
6,815,901 B2 11/2004 Koyama
(Continued)

FOREIGN PATENT DOCUMENTS

EP 1737044 A 12/2006
EP 2226847 A 9/2010
(Continued)

OTHER PUBLICATIONS

Fortunato.E et al., "Wide-Bandgap High-Mobility ZnO Thin-Film Transistors Produced at Room Temperature,", Appl. Phys. Lett. (Applied Physics Letters) , Sep. 27, 2004, vol. 85, No. 13, pp. 2541-2543.

(Continued)

*Primary Examiner* — Insa Sadio
(74) *Attorney, Agent, or Firm* — Robinson Intellectual Property Law Office; Eric J. Robinson

(57) ABSTRACT

Provided is a novel display device. In a 2T2C display device, a voltage of a current supply line in a data voltage writing period is lower than a voltage thereof in an emission period. For example, the voltage of the current supply line in the data voltage writing period is equal to a voltage on the cathode side of a light-emitting element. With such a structure, the potential rise on the anode side of the light-emitting element can be suppressed to avoid undesired emission in the data voltage writing period.

8 Claims, 61 Drawing Sheets

(56) References Cited

U.S. PATENT DOCUMENTS

| | | | |
|---|---|---|---|
| 7,049,190 | B2 | 5/2006 | Takeda et al. |
| 7,061,014 | B2 | 6/2006 | Hosono et al. |
| 7,064,346 | B2 | 6/2006 | Kawasaki et al. |
| 7,088,052 | B2 | 8/2006 | Kimura |
| 7,105,868 | B2 | 9/2006 | Nause et al. |
| 7,211,825 | B2 | 5/2007 | Shih et al. |
| 7,282,782 | B2 | 10/2007 | Hoffman et al. |
| 7,297,977 | B2 | 11/2007 | Hoffman et al. |
| 7,323,356 | B2 | 1/2008 | Hosono et al. |
| 7,332,742 | B2 | 2/2008 | Miyake et al. |
| 7,385,224 | B2 | 6/2008 | Ishii et al. |
| 7,402,506 | B2 | 7/2008 | Levy et al. |
| 7,411,209 | B2 | 8/2008 | Endo et al. |
| 7,453,065 | B2 | 11/2008 | Saito et al. |
| 7,453,087 | B2 | 11/2008 | Iwasaki |
| 7,462,862 | B2 | 12/2008 | Hoffman et al. |
| 7,468,304 | B2 | 12/2008 | Kaji et al. |
| 7,501,293 | B2 | 3/2009 | Ito et al. |
| 7,674,650 | B2 | 3/2010 | Akimoto et al. |
| 7,732,819 | B2 | 6/2010 | Akimoto et al. |
| 9,165,505 | B2 | 10/2015 | Miyazaki |
| 2001/0046027 | A1 | 11/2001 | Tai et al. |
| 2002/0056838 | A1 | 5/2002 | Ogawa |
| 2002/0132454 | A1 | 9/2002 | Ohtsu et al. |
| 2003/0189401 | A1 | 10/2003 | Kido et al. |
| 2003/0218222 | A1 | 11/2003 | Wager et al. |
| 2004/0038446 | A1 | 2/2004 | Takeda et al. |
| 2004/0127038 | A1 | 7/2004 | Carcia et al. |
| 2005/0017302 | A1 | 1/2005 | Hoffman |
| 2005/0199959 | A1 | 9/2005 | Chiang et al. |
| 2005/0205680 | A1 | 9/2005 | Anzai et al. |
| 2005/0205880 | A1 | 9/2005 | Yamazaki et al. |
| 2006/0035452 | A1 | 2/2006 | Carcia et al. |
| 2006/0043377 | A1 | 3/2006 | Hoffman et al. |
| 2006/0091793 | A1 | 5/2006 | Baude et al. |
| 2006/0108529 | A1 | 5/2006 | Saito et al. |
| 2006/0108636 | A1 | 5/2006 | Sano et al. |
| 2006/0110867 | A1 | 5/2006 | Yabuta et al. |
| 2006/0113536 | A1 | 6/2006 | Kumomi et al. |
| 2006/0113539 | A1 | 6/2006 | Sano et al. |
| 2006/0113549 | A1 | 6/2006 | Den et al. |
| 2006/0113565 | A1 | 6/2006 | Abe et al. |
| 2006/0169973 | A1 | 8/2006 | Isa et al. |
| 2006/0170111 | A1 | 8/2006 | Isa et al. |
| 2006/0197092 | A1 | 9/2006 | Hoffman et al. |
| 2006/0208977 | A1 | 9/2006 | Kimura |
| 2006/0228974 | A1 | 10/2006 | Thelss et al. |
| 2006/0231882 | A1 | 10/2006 | Kim et al. |
| 2006/0238135 | A1 | 10/2006 | Kimura |
| 2006/0244107 | A1 | 11/2006 | Sugihara et al. |
| 2006/0284171 | A1 | 12/2006 | Levy et al. |
| 2006/0284172 | A1 | 12/2006 | Ishii |
| 2006/0292777 | A1 | 12/2006 | Dunbar |
| 2007/0024187 | A1 | 2/2007 | Shin et al. |
| 2007/0046191 | A1 | 3/2007 | Saito |
| 2007/0052025 | A1 | 3/2007 | Yabuta |
| 2007/0054507 | A1 | 3/2007 | Kaji et al. |
| 2007/0090365 | A1 | 4/2007 | Hayashi et al. |
| 2007/0108446 | A1 | 5/2007 | Akimoto |
| 2007/0152217 | A1 | 7/2007 | Lai et al. |
| 2007/0172591 | A1 | 7/2007 | Seo et al. |
| 2007/0187678 | A1 | 8/2007 | Hirao et al. |
| 2007/0187760 | A1 | 8/2007 | Furuta et al. |
| 2007/0194379 | A1 | 8/2007 | Hosono et al. |
| 2007/0252928 | A1 | 11/2007 | Ito et al. |
| 2007/0268210 | A1* | 11/2007 | Uchino ..... G09G 3/3233 345/55 |
| 2007/0272922 | A1 | 11/2007 | Kim et al. |
| 2007/0287296 | A1 | 12/2007 | Chang |
| 2008/0006877 | A1 | 1/2008 | Mardilovich et al. |
| 2008/0030436 | A1 | 2/2008 | Iida et al. |
| 2008/0030437 | A1 | 2/2008 | Iida et al. |
| 2008/0038882 | A1 | 2/2008 | Takechi et al. |
| 2008/0038929 | A1 | 2/2008 | Chang |
| 2008/0050595 | A1 | 2/2008 | Nakagawara et al. |
| 2008/0073653 | A1 | 3/2008 | Iwasaki |
| 2008/0083950 | A1 | 4/2008 | Pan et al. |
| 2008/0106191 | A1 | 5/2008 | Kawase |
| 2008/0128689 | A1 | 6/2008 | Lee et al. |
| 2008/0129195 | A1 | 6/2008 | Ishizaki et al. |
| 2008/0166834 | A1 | 7/2008 | Kim et al. |
| 2008/0180584 | A1* | 7/2008 | Utsunomiya ..... G06F 3/044 349/12 |
| 2008/0182358 | A1 | 7/2008 | Cowdery-Corvan et al. |
| 2008/0224133 | A1 | 9/2008 | Park et al. |
| 2008/0246747 | A1 | 10/2008 | Taneda et al. |
| 2008/0254569 | A1 | 10/2008 | Hoffman et al. |
| 2008/0258139 | A1 | 10/2008 | Ito et al. |
| 2008/0258140 | A1 | 10/2008 | Lee et al. |
| 2008/0258141 | A1 | 10/2008 | Park et al. |
| 2008/0258143 | A1 | 10/2008 | Kim et al. |
| 2008/0296568 | A1 | 12/2008 | Ryu et al. |
| 2009/0066616 | A1 | 3/2009 | Uchino et al. |
| 2009/0068773 | A1 | 3/2009 | Lai et al. |
| 2009/0073325 | A1 | 3/2009 | Kuwabara et al. |
| 2009/0114910 | A1 | 5/2009 | Chang |
| 2009/0134399 | A1 | 5/2009 | Sakakura et al. |
| 2009/0152506 | A1 | 6/2009 | Umeda et al. |
| 2009/0152541 | A1 | 6/2009 | Maekawa et al. |
| 2009/0219234 | A1 | 9/2009 | Yamamoto et al. |
| 2009/0278122 | A1 | 11/2009 | Hosono et al. |
| 2009/0280600 | A1 | 11/2009 | Hosono et al. |
| 2010/0065844 | A1 | 3/2010 | Tokunaga |
| 2010/0092800 | A1 | 4/2010 | Itagaki et al. |
| 2010/0109002 | A1 | 5/2010 | Itagaki et al. |
| 2015/0364496 | A1 | 12/2015 | Kaneyasu |

FOREIGN PATENT DOCUMENTS

| | | | |
|---|---|---|---|
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-251705 | A | 9/1993 |
| JP | 08-264794 | A | 10/1996 |
| JP | 11-505377 | | 5/1999 |
| JP | 2000-044236 | A | 2/2000 |
| JP | 2000-150900 | A | 5/2000 |
| JP | 2002-076356 | A | 3/2002 |
| JP | 2002-289859 | A | 10/2002 |
| JP | 2003-086000 | A | 3/2003 |
| JP | 2003-086808 | A | 3/2003 |
| JP | 2004-103957 | A | 4/2004 |
| JP | 2004-273614 | A | 9/2004 |
| JP | 2004-273732 | A | 9/2004 |
| JP | 2013-068957 | | 4/2013 |
| JP | 2013-092791 | | 5/2013 |
| WO | WO-2004/114391 | | 12/2004 |

OTHER PUBLICATIONS

Dembo.H et al., "RFCPUS on Glass and Plastic Substrates Fabricated by TFT Transfer Technology,", IEDM 05: Technical Digest of International Electron Devices Meeting, Dec. 5, 2005, pp. 1067-1069.

Ikeda.T et al., "Full-Functional System Liquid Crystal Display Using CG-Silicon Technology,", SID Digest '04: SID International Symposium Digest of Technical Papers, 2004, vol. 35, pp. 860-863.

Nomura.K et al., "Room-Temperature Fabrication of Transparent Flexible Thin-Film Transistors Using Amorphous Oxide Semiconductors,", Nature, Nov. 25, 2004, vol. 432, pp. 488-492.

Park.J et al., "Improvements in the Device Characteristics of Amorphous Indium Gallium Zinc Oxide Thin-Film Transistors by Ar Plasma Treatment,", Appl. Phys. Lett. (Applied Physics Letters), Jun. 26, 2007, vol. 90, No. 26, pp. 262106-1-262106-3.

Takahashi.M et al., "Theoretical Analysis of IGZO Transparent Amorphous Oxide Semiconductor,", IDW '08: Proceedings of the 15th International Display Workshops, Dec. 3, 2008, pp. 1637-1640.

(56) References Cited

OTHER PUBLICATIONS

Hayashi.R et al., "42.1: Invited Paper: Improved Amorphous In—Ga—Zn—O TFTs,", SID Digest '08: SID International Symposium Digest of Technical Papers, May 20, 2008, vol. 39, pp. 621-624.
Prins.M et al., "A Ferroelectric Transparent Thin-Film Transistor,", Appl. Phys. Lett. (Applied Physics Letters), Jun. 17, 1996, vol. 68, No. 25, pp. 3650-3652.
Nakamura.M et al., "The phase relations in the In2O3—Ga2ZnO4—ZnO system at 1350° C.,", Journal of Solid State Chemistry, Aug. 1, 1991, vol. 93, No. 2, pp. 298-315.
Kimizuka.N et al., "Syntheses and Single-Crystal Data of Homologous Compounds, In2O3(ZnO)m (m=3, 4, and 5), InGaO3(ZnO)3, and Ga2O3(ZnO)m (m=7, 8, 9, and 16) in the In2O3—ZnGa2O4—ZnO System,", Journal of Solid State Chemistry, Apr. 1, 1995, vol. 116, No. 1, pp. 170-178.
Nomura.K et al., "Thin-Film Transistor Fabricated in Single-Crystalline Transparent Oxide Semiconductor,", Science, May 23, 2003, vol. 300, No. 5623, pp. 1269-1272.
Masuda.S et al., "Transparent thin film transistors using ZnO as an active channel layer and their electrical properties,", J. Appl. Phys. (Journal of Applied Physics) , Feb. 1, 2003, vol. 93, No. 3, pp. 1624-1630.
Asakuma.N et al., "Crystallization and Reduction of Sol-Gel-Derived Zinc Oxide Films by Irradiation With Ultraviolet Lamp,", Journal of Sol-Gel Science and Technology, 2003, vol. 26, pp. 181-184.
Osada.T et al., "15.2: Development of Driver-Integrated Panel using Amorphous In—Ga—Zn-Oxide TFT,", SID Digest '09 : SID International Symposium Digest of Technical Papers, May 31, 2009, pp. 184-187.
Nomura.K et al., "Carrier transport in transparent oxide semiconductor with intrinsic structural randomness probed using single-crystalline InGaO3(ZnO)5 films,", Appl. Phys. Lett. (Applied Physics Letters) , Sep. 13, 2004, vol. 85, No. 11, pp. 1993-1995.
Li.C et al., "Modulated Structures of Homologous Compounds InMO3(ZnO)m (M=In,Ga; m=Integer) Described by Four-Dimensional Superspace Group,", Journal of Solid State Chemistry, 1998, vol. 139, pp. 347-355.
Son.K et al., "42.4L: Late-News Paper: 4 Inch QVGA AMOLED Driven by the Threshold Voltage Controlled Amorphous GIZO (Ga2O3—In2O3—ZnO) TFT,", SID Digest '08 : SID International Symposium Digest of Technical Papers, May 20, 2008, vol. 39, pp. 633-636.
Lee.J et al., "World's Largest (15-Inch) XGA AMLCD Panel Using IGZO Oxide TFT,", SID Digest '08 : SID International Symposium Digest of Technical Papers, May 20, 2008, vol. 39, pp. 625-628.
Nowatari.H et al., "60.2: Intermediate Connector With Suppressed Voltage Loss for White Tandem OLEDs,", SID Digest '09 : SID International Symposium Digest of Technical Papers, May 31, 2009, vol. 40, pp. 899-902.
Kanno.H et al., "White Stacked Electrophosphorecent Organic Light-Emitting Devices Employing MOO3 as a Charge-Generation Layer,", Adv. Mater. (Advanced Matrerials), 2006, vol. 18, No. 3, pp. 339-342.
Tsuda.K et al., "Ultra Low Power Consumption Technologies for Mobile TFT-LCDs ,", IDW '02 : Proceedings of the 9th International Display Workshops, Dec. 4, 2002, pp. 295-298.
Van de Walle.C, "Hydrogen as a Cause of Doping in Zinc Oxide,", Phys. Rev. Lett. (Physical Review Letters), Jul. 31, 2000, vol. 85, No. 5, pp. 1012-1015.
Fung.T et al., "2-D Numerical Simulation of High Performance Amorphous In—Ga—Zn–O TFTs for Flat Panel Displays,", AM-FPD '08 Digest of Technical Papers, Jul. 2, 2008, pp. 251-252, The Japan Society of Applied Physics.
Jeong.J et al., "3.1: Distinguished Paper: 12.1-Inch WXGA AMOLED Display Driven by Indium-Gallium-Zinc Oxide TFTs Array,", SID Digest '08 : SID International Symposium Digest of Technical Papers, May 20, 2008, vol. 39, No. 1, pp. 1-4.
Park.J et al., "High performance amorphous oxide thin film transistors with self-aligned top-gate structure,", IEDM 09: Technical Digest of International Electron Devices Meeting, Dec. 7, 2009, pp. 191-194.
Kurokawa.Y et al., "UHF RFCPUs on Flexible and Glass Substrates for Secure RFID Systems,", Journal of Solid-State Circuits , 2008, vol. 43, No. 1, pp. 292-299.
Ohara.H et al., "Amorphous In—Ga—Zn-Oxide TFTs with Suppressed Variation for 4.0 inch QVGA AMOLED Display,", AM-FPD '09 Digest of Technical Papers, Jul. 1, 2009, pp. 227-230, The Japan Society of Applied Physics.
Coates.D et al., "Optical Studies of the Amorphous Liquid-Cholesteric Liquid Crystal Transistion:The "Blue Phase",", Physics Letters, Sep. 10, 1973, vol. 45A, No. 2, pp. 115-116.
Cho.D et al., "21.2:Al and Sn-Doped Zinc Indium Oxide Thin Film Transistors for AMOLED Back-Plane,", SID Digest '09 : SID International Symposium Digest of Technical Papers, May 31, 2009, pp. 280-283.
Lee.M et al., "15.4:Excellent Performance of Indium-Oxide-Based Thin-Film Transistors by DC Sputtering,", SID Digest '09 : SID International Symposium Digest of Technical Papers, May 31, 2009, pp. 191-193.
Jin.D et al., "65.2:Distinguished Paper:World-Largest (6.5") Flexible Full Color Top Emission AMOLED Display on Plastic Film and Its Bending Properties,", SID Digest '09 : SID International Symposium Digest of Technical Papers, May 31, 2009, pp. 983-985.
Sakata.J et al., "Development of 4.0-In. AMOLED Display With Driver Circuit Using Amorphous In—Ga—Zn-Oxide TFTs,", IDW '09 : Proceedings of the 16th International Display Workshops, 2009, pp. 689-692.
Park.J et al., "Amorphous Indium-Gallium-Zinc Oxide TFTs and Their Application for Large Size AMOLED,", AM-FPD '08 Digest of Technical Papers, Jul. 2, 2008, pp. 275-278.
Park.S et al., "Challenge to Future Displays: Transparent AM-OLED Driven by PEALD Grown ZnO TFT,", IMID '07 Digest, 2007, pp. 1249-1252.
Godo.H et al., "Temperature Dependence of Characteristics and Electronic Structure for Amorphous In—Ga—Zn-Oxide TFT,", AM-FPD '09 Digest of Technical Papers, Jul. 1, 2009, pp. 41-44.
Osada.T et al., "Development of Driver-Integrated Panel Using Amorphous In—Ga—Zn-Oxide TFT,", AM-FPD '09 Digest of Technical Papers, Jul. 1, 2009, pp. 33-36.
Hirao.T et al., "Novel Top-Gate Zinc Oxide Thin-Film Transistors (ZnO TFTs) for AMLCDs,", Journal of the SID, 2007, vol. 15, No. 1, pp. 17-22.
Hosono.H, "68.3:Invited Paper:Transparent Amorphous Oxide Semiconductors for High Performance TFT,", SID Digest '07 : SID International Symposium Digest of Technical Papers, 2007, vol. 38, pp. 1830-1833.
Godo.H et al., "P-9:Numerical Analysis on Temperature Dependence of Characteristics of Amorphous In—Ga—Zn-Oxide TFT,", SID Digest '09 : SID International Symposium Digest of Technical Papers, May 31, 2009, pp. 1110-1112.
Ohara.H et al., "21.3:4.0 In. QVGA AMOLED Display Using In—Ga—Zn-Oxide TFTs With a Novel Passivation Layer,", SID Digest '09 : SID International Symposium Digest of Technical Papers, May 31, 2009, pp. 284-287.
Miyasaka.M, "SUFTLA Flexible Microelectronics on Their Way to Business,", SID Digest '07 : SID International Symposium Digest of Technical Papers, 2007, vol. 38, pp. 1673-1676.
Chern.H et al., "An Analytical Model for the Above-Threshold Characteristics of Polysilicon Thin-Film Transistors,", IEEE Transactions on Electron Devices, Jul. 1, 1995, vol. 42, No. 7, pp. 1240-1246.
Kikuchi.H et al., "39.1:Invited Paper:Optically Isotropic Nano-Structured Liquid Crystal Composites for Display Applications,", SID Digest '09 : SID International Symposium Digest of Technical Papers, May 31, 2009, pp. 578-581.
Asaoka.Y et al., "29.1:Polarizer-Free Reflective LCD Combined With Ultra Low-Power Driving Technology,", SID Digest '09 : SID International Symposium Digest of Technical Papers, May 31, 2009, pp. 395-398.

(56) References Cited

OTHER PUBLICATIONS

Lee.H et al., "Current Status of, Challenges to, and Perspective View of AM-OLED,", IDW'06 : Proceedings of the 13th International Display Workshops, Dec. 7, 2006, pp. 663-666.
Kikuchi.H et al., "62.2:Invited Paper:Fast Electro-Optical Switching in Polymer-Stabilized Liquid Crystalline Blue Phases for Display Application,", SID Digest '07 : SID International Symposium Digest of Technical Papers, 2007, vol. 38, pp. 1737-1740.
Nakamura.M, "Synthesis of Homologous Compound with New Long-Period Structure,", NIRIM Newsletter, Mar. 1, 1995, vol. 150, pp. 1-4.
Kikuchi.H et al., "Polymer-Stabilized Liquid Crystal Blue Phases,", Nature Materials, Sep. 2, 2002, vol. 1, pp. 64-68.
Kimizuka.N et al., "Spinel,YbFe2O4, and Yb2Fe3O7 Types of Structures for Compounds in the In2O3 and Sc2O3—A2O3—BO Systems [A; Fe, Ga, or Al; B: Mg, Mn, Fe, Ni, Cu,or Zn] at Temperatures Over 1000° C.,", Journal of Solid State Chemistry, 1985, vol. 60, pp. 382-384.
Kitzerow.H et al., "Observation of Blue Phases in Chiral Networks,", Liquid Crystals, 1993, vol. 14, No. 3, pp. 911-916.
Costello.M et al., "Electron Microscopy of a Cholesteric Liquid Crystal and Its Blue Phase,", Phys. Rev. A (Physical Review. A), May 1, 1984, vol. 29, No. 5, pp. 2957-2959.
Meiboom.S et al., "Theory of the Blue Phase of Cholesteric Liquid Crystals,", Phys. Rev. Lett. (Physical Review Letters), May 4, 1981, vol. 46, No. 18, pp. 1216-1219.
Park.Sang-Hee et al., "42.3: Transparent ZnO Thin Film Transistor for the Application of High Aperture Ratio Bottom Emission AM-OLED Display,", SID Digest '08 : SID International Symposium Digest of Technical Papers, May 20, 2008, vol. 39, pp. 629-632.
Orita.M et al., "Mechanism of Electrical Conductivity of Transparent InGaZnO4,", Phys. Rev. B (Physical Review. B), Jan. 15, 2000, vol. 61, No. 3, pp. 1811-1816.
Nomura.K et al., "Amorphous Oxide Semiconductors for High-Performance Flexible Thin-Film Transistors,", Jpn. J. Appl. Phys. (Japanese Journal of Applied Physics) , 2006, vol. 45, No. 5B, pp. 4303-4308.
Janotti.A et al., "Native Point Defects in ZnO,", Phys. Rev. B (Physical Review. B), Oct. 4, 2007, vol. 76, No. 16, pp. 165202-1-165202-22.
Park.J et al., "Electronic Transport Properties of Amorphous Indium-Gallium-Zinc Oxide Semiconductor Upon Exposure to Water,", Appl. Phys. Lett. (Applied Physics Letters) , 2008, vol. 92, pp. 072104-1-072104-3.
Hsieh.H et al., "P-29:Modeling of Amorphous Oxide Semiconductor Thin Film Transistors and Subgap Density of States,", SID Digest '08 : SID International Symposium Digest of Technical Papers, 2008, vol. 39, pp. 1277-1280.
Janotti.A et al., "Oxygen Vacancies in ZnO,", Appl. Phys. Lett. (Applied Physics Letters) , 2005, vol. 87, pp. 122102-1-122102-3.
Oba.F et al., "Defect energetics in ZnO: A hybrid Hartree-Fock density functional study,", Phys. Rev. B (Physical Review. B), 2008, vol. 77, pp. 245202-1-245202-6.
Orita.M et al., "Amorphous transparent conductive oxide InGaO3(ZnO)m (m<4):a Zn4s conductor,", Philosophical Magazine, 2001, vol. 81, No. 5, pp. 501-515.
Hosono.H et al., "Working hypothesis to explore novel wide band gap electrically conducting amorphous oxides and examples,", J. Non-Cryst. Solids (Journal of Non-Crystalline Solids), 1996, vol. 198-200, pp. 165-169.
Mo.Y et al., "Amorphous Oxide TFT Backplanes for Large Size AMOLED Displays,", IDW'08 : Proceedings of the 6th International Display Workshops, Dec. 3, 2008, pp. 581-584.
Kim.S et al., "High-Performance oxide thin film transistors passivated by various gas plasmas,", 214th ECS Meeting, 2008, No. 2317, ECS.
Clark.S et al., "First Principles Methods Using CASTEP,", Zeitschrift fur Kristallographie, 2005, vol. 220, pp. 567-570.
Lany.S et al., "Dopability, Intrinsic Conductivity, and Nonstoichiometry of Transparent Conducting Oxides,", Phys. Rev. Lett. (Physical Review Letters), Jan. 26, 2007, vol. 98, pp. 045501-1-045501-4.
Park.J et al., "Dry etching of ZnO films and plasma-induced damage to optical properties,", J. Vac. Sci. Technol. B (Journal of Vacuum Science & Technology B), Mar. 1, 2003, vol. 21, No. 2, pp. 800-803.
Oh.M et al., "Improving the Gate Stability of ZnO Thin-Film Transistors With Aluminum Oxide Dielecrtric Layers,", J. Electrochem. Soc. (Journal of the Electrochemical Society), 2008, vol. 155, No. 12, pp. H1009-H1014.
Ueno.K et al., "Field-Effect Transistor on SrTiO3 With Sputtered Al2O3 Gate Insulator,", Appl. Phys. Lett. (Applied Physics Letters), Sep. 1, 2003, vol. 83, No. 9, pp. 1755-1757.

* cited by examiner

P14

P15

P16

P11

$$V_{CP}=V_{TH}+\Delta V$$

$$\Delta V=(V_{DATA}-V_{G\text{-}INI})\times(C_{EL}/C_{103}+C_{EL})$$

P24

P25

P26

P21

DISPLAY DEVICE, ELECTRONIC DEVICE, AND DRIVING METHOD OF DISPLAY DEVICE

BACKGROUND OF THE INVENTION

1. Field of the Invention

One embodiment of the present invention relates to a display device and an electronic device.

Note that one embodiment of the present invention is not limited to the technical field. The technical field of the invention disclosed in this specification and the like relates to an object, a method, or a manufacturing method. In addition, one embodiment of the present invention relates to a process, a machine, manufacture, or a composition of matter. Specifically, examples of the technical field of one embodiment of the present invention disclosed in this specification include a semiconductor device, a display device, a light-emitting device, a power storage device, an imaging device, a memory device, a method for driving any of them, and a method for manufacturing any of them.

2. Description of the Related Art

Display devices including a light-emitting element, such as an electroluminescence element (hereinafter referred to as an EL element) have been actively developed.

For example, Patent Documents 1 to 3 disclose a 2T2C circuit configuration including two transistors and two capacitors in each pixel.

REFERENCE

Patent Document

[Patent Document 1] United States Patent Application Publication No. 2007/0268210

[Patent Document 2] United States Patent Application Publication No. 2009/0219234

[Patent Document 3] United States Patent Application Publication No. 2008/0030436

SUMMARY OF THE INVENTION

As described above, there is a variety of structures used for a circuit in a display device. Each structure has advantages and disadvantages, and a structure appropriate for circumstances is selected. Proposals of novel structures for a display device and the like can increase choices and our freedom of choice.

It is an object of one embodiment of the present invention to provide a novel display device, a driving method of such a novel display device, or the like. Another object of one embodiment of the present invention is to provide a display device or the like with fewer connection terminals. Another object of one embodiment of the present invention is to provide a display device or the like with high yield. Another object of one embodiment of the present invention is to provide a display device or the like with a small layout area of a driver circuit. Another object of one embodiment of the present invention is to provide a display device and the like with a narrow bezel.

In a 2T2C pixel disclosed in Patent Documents 1 to 3, the threshold voltage and the mobility of a transistor are compensated by switching the potential of a wiring. However, time enough to compensate the threshold voltage and the mobility in one gate selection period cannot be secured in some cases. If enough time for such compensation cannot be secured, compensation is not successively carried out, so that images cannot be displayed uniformly.

In addition, in the 2T2C pixels disclosed in Patent Documents 1 to 3, the mobility is compensated by supplying current into the transistors to adjust the voltage that has been held between a gate and a source. The supply of current into the transistors is made by increasing the potential of a wiring used for supplying current to a light-emitting element (such a wiring is also referred to as a current supply line). However, undesired light emission from a light-emitting element might be caused by increasing the potential of the current supply line in the compensation period.

In view of the above, an object of one embodiment of the present invention is to provide a display device or the like having a novel structure. Another object of one embodiment of the present invention is to provide a display device or the like for uniformly displaying images. Another object of one embodiment of the present invention is to provide a semiconductor device or the like having such a novel structure to suppress undesired emission from a light-emitting element in a compensation period.

Note that the objects of the present invention are not limited to the above objects. The objects described above do not disturb the existence of other objects. The other objects are the ones that are not described above and will be described below. The other objects will be apparent from and can be derived from the description of the specification, the drawings, and the like by those skilled in the art. One embodiment of the present invention is to solve at least one of the aforementioned objects and the other objects.

One embodiment of the present invention is a display device including a switch, a transistor, a capacitor, and a light-emitting element. A first electrode of the capacitor is electrically connected to a gate of the transistor. A second electrode of the capacitor is electrically connected to one of a source and a drain of the transistor and a first electrode of the light-emitting element. The switch is turned on to apply a data voltage to the gate of the transistor. A potential smaller than a potential for driving the light-emitting element is applied to the other of the source and the drain of the transistor in a period for applying the data voltage to the gate of the transistor.

In one embodiment of the present invention, the potential of the other of the source and the drain of the transistor in the period for applying the data voltage to the gate of the transistor is preferably equal to a potential applied to a second electrode of the light-emitting element.

In the display device of one embodiment of the present invention, the transistor preferably includes an oxide semiconductor in a channel formation region thereof.

Another embodiment of the present invention is a method for driving a display device including a switch, a transistor, a capacitor, and a light-emitting element. The method includes a first period, a second period, and a third period. The first period is a period for holding the threshold voltage of the transistor in the capacitor which is provided between the gate and one of the source and the drain of the transistor. The second period is a period for holding the threshold voltage added with a voltage corresponding to the data voltage in the capacitor. The third period is a period for driving the light-emitting element. A potential applied to the other of the source and the drain of the transistor in the second period is smaller than a potential applied thereto in the third period.

Another embodiment of the present invention is a method for driving a display device including a switch, a transistor, a capacitor, and a light-emitting element. The method includes a first period, a second period, and a third period. The first period is a period for holding the threshold voltage of the transistor in the capacitor which is provided between the gate and one of the source and the drain of the transistor. The second period is a period for holding the threshold voltage added with a voltage corresponding to the data voltage in the capacitor. The third period is a period for driving the light-emitting element. In the first period, a potential smaller than the potential applied to the second electrode of the light-emitting element is applied to the other of the source and the drain of the transistor. A potential applied to the other of the source and the drain of the transistor in the second period is smaller than a potential applied thereto in the third period.

According to one embodiment of the present invention, the display device preferably includes a plurality of pixels each including a switch, a transistor, a capacitor, and a light-emitting element. An operation in the first period is preferably performed by switching the switches at the same time. An operation in the second period is preferably performed by switching the switches row by row.

According to one embodiment of the present invention, the potential applied to the other of the source and the drain of the transistor in the second period is preferably equal to the potential applied to the second electrode of the light-emitting element.

Note that other embodiments of the present invention will be shown in the following embodiments and the drawings.

One embodiment of the present invention can provide a novel display device or the like.

Alternatively, one embodiment of the present invention provides a novel display device or the like in which a compensation period is kept long. Alternatively, one embodiment of the present invention provides a novel display device or the like which performs display with uniformity. Alternatively, one embodiment of the present invention provides a novel display device or the like in which undesired emission from a light-emitting element in a compensation period is suppressed. Alternatively, one embodiment of the present invention provides a novel display device or the like with less connection terminals. Alternatively, one embodiment of the present invention provides a novel display device or the like which has high manufacturing yield. Alternatively, one embodiment of the present invention provides a novel display device or the like with a small layout area of a driver circuit. Alternatively, one embodiment of the present invention provides a novel display device or the like with a small bezel.

Note that the effects of the present invention are not limited to the above effects. The effects described above do not disturb the existence of other effects. The other effects are the ones that are not described above and will be described below. The other effects will be apparent from and can be derived as appropriate from the description of the specification, the drawings, and the like by those skilled in the art. One embodiment of the present invention has at least one of the above effects and the other effects. Accordingly, one embodiment of the present invention does not have the aforementioned effects in some cases.

DETAILED DESCRIPTION OF THE INVENTION

Figure 1A:
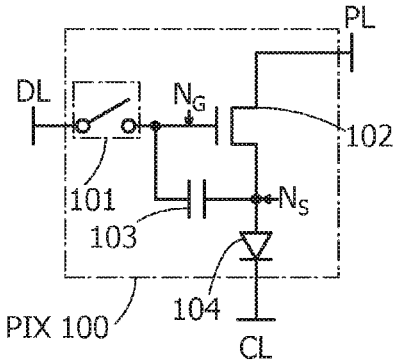
FIGS. 1A and 1B are a circuit diagram and a timing chart illustrating one embodiment of the present invention.

Hereinafter, embodiments will be described with reference to drawings. Note that embodiments can be carried out in many different modes, and it is easily understood by those skilled in the art that modes and details of the present invention can be modified in various ways without departing from the spirit and the scope of the present invention. Thus, the present invention should not be interpreted as being limited to the following description of the embodiments.

In this specification and the like, ordinal numbers such as first, second, and third are used in order to avoid confusion among components. Thus, the terms do not limit the number or order of components. Thus, the terms do not limit the number or order of components. In the present specification and the like, a "first" component in one embodiment can be referred to as a "second" component in other embodiments or claims. Furthermore, in the present specification and the like, a "first" component in one embodiment can be referred to without the ordinal number in other embodiments or claims.

The same elements or elements having similar functions, elements formed using the same material, elements formed at the same time, or the like in the drawings are denoted by the same reference numerals, and the description thereof is not repeated in some cases.

Embodiment 1

Structure examples of a display device of one embodiment of the present invention will be described with reference to FIGS. 1A and 1B, FIG. 2, FIGS. 3A and 3B, FIGS. 4A and 4B, FIGS. 5A and 5B, FIG. 6, FIG. 7, FIGS. 8A and 8B, FIGS. 9A and 9B, FIGS. 10A to 10C, FIG. 11, FIGS. 12A and 12B, FIGS. 13A and 13B, FIGS. 14A to 14C, FIGS. 15A and 15B, FIGS. 16A to 16E, FIGS. 17A to 17C, FIGS. 18A and 18B, FIGS. 19A to 19C, FIG. 20, FIGS. 21A and 21B, FIGS. 22A to 22C, FIGS. 23A and 23B, FIGS. 24A and 24B, FIGS. 25A and 25B, FIGS. 26A and 26B, and FIG. 27.

<Pixel>

First, a pixel included in the display device is described.

For example, the pixel described in this embodiment compensates variations in threshold voltages of transistors that adversely affect images displayed thereby.

An example of a mechanism for compensating variations in threshold voltages is briefly shown below. First, a data voltage that has been written in the previous period is initialized, that is, is set so that a transistor is turned on. Then, a capacitor holds the threshold voltage or a voltage corresponding to the threshold voltage. Then, a data voltage corresponding to the shades of gray is added to the threshold voltage that has been held in the capacitor. Finally, current is supplied into a light-emitting element in accordance with the threshold voltage to which the voltage corresponding to the data voltage is added. Such a mechanism reduces the influence of the threshold voltage of a transistor on current supplied into a light-emitting element.

The sequential operation can be divided into the following periods: an initialization period, a threshold voltage acquiring period, a data voltage writing period, and an emission period. In each period, pixels need to be selected and each voltage of a gate line, a data line, and a current supply line needs to be switched to apply a predetermined voltage to the pixels.

In the initialization period and the threshold voltage acquiring period in one embodiment of the present invention, which is one example, voltage switching of a current supply line connected to each pixel is performed in all the pixels at the same time. In contrast, in the data voltage writing period, pixels into which a data voltage is written are selected row by row. In the emission period, voltage switching of the current supply line connected to each pixel is performed in all the pixels at the same time, and accordingly light is emitted in all the pixels at the same time. With such a structure, the current supply line connected to each pixel can be driven at the same time; thus, such a complicated operation that the current supply line is sequentially selected row by row is eliminated. Owing to this, there is no need to provide a switch or the like in each row, for example. If a switch is suggested to be provided in each row, the layout area of the driver circuit can be increased because the area occupied by the switches is increased. In another case, a switch needs to be formed over a substrate (e.g., a semiconductor substrate) different from a substrate including a pixel, in which case the substrate including the switch needs to be connected to the substrate including the pixel through a connection terminal. The connection terminal needs to be provided in each row, resulting in a large number of connection terminals. Accordingly, a contact failure at the connection terminal occurs at a high possibility, leading to a reduction in yield. However, where the current supply line is driven in all the pixels at the same time, the number of connection terminals is small and the yield can be improved. In addition, there is no need to provide a switch in each row, the layout area of the driver circuit, that is, the bezel of the display device can be small.

In addition, once the operation for acquiring the threshold voltage is completed, the data voltage writing period and the emission period are unnecessary thereafter. In other words, the operation for acquiring the threshold voltage is not necessarily performed in one gate selection period. Therefore, the operation for acquiring the threshold voltage can spend a longer period of time than one gate selection period, and one gate selection period can be used only for the data voltage writing period. Thus, time enough for compensation in the initialization period and the threshold voltage acquiring period can be secured, so that acquiring the threshold voltage is secured, which results in displaying images uniformly. In addition, since the operation for acquiring the threshold voltage can be performed in all pixels at the same time, the total length of time taken for acquiring the threshold voltage from all the pixels can be shorter than that when the operation for acquiring the threshold voltage is performed row by row. Thus, a period for writing a data voltage can be secured long enough to accurately input the data voltage to a pixel, so that images can be displayed accurately.

In one embodiment of the present invention, the voltage of a current supply line is lowered to prevent emission from a light-emitting element in the data voltage writing period. In other words, the voltage of the current supply line is smaller in the data voltage writing period than in the emission period. Since the data voltage is applied under such a condition, an increase in the potential of an anode of the light-emitting element is suppressed, leading to suppressing undesired light emission from the light-emitting element.

Next, an example of a circuit configuration of the pixel will be described.

FIG. 1A illustrates a pixel 100 of a display device which is one embodiment of the present invention. The pixel 100 (a pixel is denoted by PIX in drawings) includes a switch 101, a transistor 102, a capacitor 103, and a light-emitting element 104.

A node $N_G$ represents a gate of the transistor 102 in the pixel 100 in FIG. 1A. A node $N_S$ represents a node between the transistor 102 and the light-emitting element 104 in the pixel 100 in FIG. 1A.

One terminal of the switch 101 is connected to a data line DL. The other terminal of the switch 101 is connected to the node $N_G$.

Examples of the function of the data line DL include but not limited to applying (or transmitting) an initialization voltage in the initialization period and the threshold voltage acquiring period, applying (or transmitting) a data voltage (also referred to as an image signal voltage, a video signal, or the like) to the pixel 100 in the data voltage writing period, and supplying (or transmitting) a precharge voltage in the data voltage writing period. The data line DL having such functions can be referred to simply as a wiring, a first wiring, or the like.

The data voltage applied to the data line DL is a voltage for driving the light-emitting element 104 at desired shades of gray. The data voltage can be denoted by $V_{DATA}$.

The initialization voltage applied to the data line DL is a voltage for initializing voltages of each terminal of the capacitor 103 or for turning on the transistor 102. The initialization voltage can be denoted by $V_{G\text{-}INI}$.

The gate of the transistor 102 is connected to the node $N_G$. One of a source and a drain of the transistor 102 is connected to the node $N_S$. Note that the source and the drain of the transistor are replaced with each other depending on their potentials. For example, the potential of a current supply line PL is higher than that of a cathode line CL in the emission period, where the source of the transistor 102 is connected to the node $N_S$. The other of the source and the drain of the transistor 102 is connected to the current supply line PL. Note that the transistor 102 is assumed to be an n-channel transistor in the following description. The threshold voltage of the transistor 102 is denoted by $V_{TH}$ in the description.

Examples of the function of the current supply line PL include but not limited to applying (or transmitting) an initialization voltage for initializing the voltage of each terminal of the capacitor 103 in the initialization period, applying (or transmitting) a voltage for supplying current in accordance with the voltage between the gate and the source (also referred to as $V_{GS}$) of the transistor 102 in the threshold voltage acquiring period, applying a low voltage in the data voltage writing period, applying a voltage which is not enough to drive the light-emitting element 104 if current is supplied to the transistor 102, and applying a voltage for supplying current to the light-emitting element 104 in accordance with $V_{GS}$ of the transistor 102. The current supply line PL having such functions can be referred to simply as a wiring, a first wiring, or the like.

The initialization voltage applied to the current supply line PL is a voltage for initializing the voltage of each terminal of the capacitor 103 or for turning on the transistor 102. The initialization voltage can be denoted by $V_{P\text{-}INI}$. Note that $V_{P\text{-}INI}$ is different from $V_{G\text{-}INI}$ but can be the same depending on circumstances.

The voltage for supplying current in accordance with $V_{GS}$ of the transistor 102, which is applied to the current supply line PL, sets the voltage held at each terminal of the capacitor 103 at the threshold voltage of the transistor 102 so that the light-emitting element 104 is driven. The voltage for supplying current in accordance with $V_{GS}$ of the transistor 102 can be denoted by $V_{P\text{-}EMI}$.

Note that the voltage of the current supply line PL for driving the light-emitting element 104 may be different in level from that for acquiring the threshold voltage of the transistor 102. It is desirable, however, that they have the same level because the configuration of a voltage supplying circuit can be simplified.

The voltage which is not enough to drive the light-emitting element 104 if current is supplied to the transistor 102, which is applied to the current supply line PL, is equal to or lower than the voltage applied to the cathode line CL, for example.

The voltage applied to the cathode line CL can be denoted by $V_{CS}$. The function of the cathode line CL is not limited to the above, and the cathode line CL can be simply referred to as a wiring, a first wiring, or the like.

One electrode of the capacitor 103 is connected to the node $N_G$. The other electrode of the capacitor 103 is connected to the node $N_S$.

One electrode of the light-emitting element 104 is connected to the node $N_S$. The other electrode of the capacitor 103 is connected to the cathode line CL to which $V_{CS}$ is applied. Note that the gate capacitance (parasitic capacitance) of the transistor 102 is utilized instead, in which case the capacitor 103 can be omitted as shown in a pixel 100I in FIG. 2.

<Operation of Pixel>

Next, an example of the operation of the pixel 100 in FIG. 1A is described.

Figure 1B:
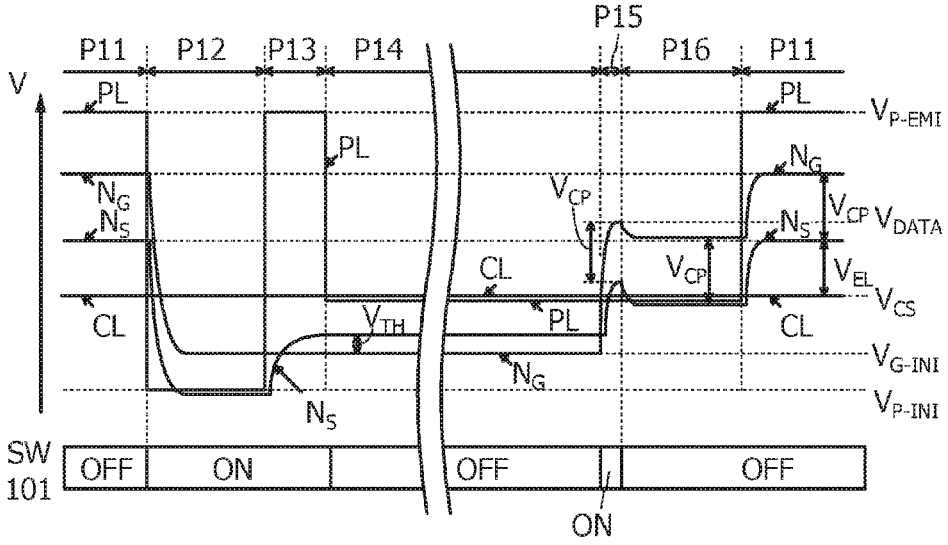
Figure 2:
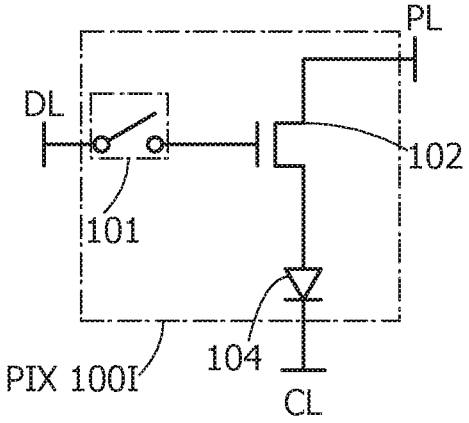
FIG. 2 is a circuit diagram illustrating one embodiment of the present invention.

FIG. 1B is a timing chart for the operation of the pixel 100. FIGS. 3A and 3B to FIGS. 5A and 5B are circuit diagrams showing the voltage of each line, the operation of the switch, and the voltage of each node in each period in FIG. 1B.

The timing chart of FIG. 1B is separated into an emission period P11, an initialization period P12, a threshold voltage compensation period P13, a threshold voltage compensation termination period P14, a data voltage input period P15, and a data voltage input termination period P16. Note that the threshold voltage compensation period P13 and the threshold voltage compensation termination period P14 correspond to the threshold voltage compensation period described above, for example. In addition, the data voltage input period P15 and the data voltage input termination period P16 correspond to the data voltage writing period described above, for example.

Note that one embodiment of the present invention is not limited to the example including the emission period P11, the initialization period P12, the threshold voltage compensation period P13, the threshold voltage compensation termination period P14, the data voltage input period P15, and the data voltage input termination period P16. For example, one embodiment of the present invention includes a period other than these periods or does not include any one of these periods. For example, the initialization period P12 is not necessarily provided when the transistor 102 is ON. The data voltage input period P15 can immediately follow the threshold voltage compensation period P13, in which case the threshold voltage compensation termination period P14 is not necessarily provided. For example, the emission period P11 can immediately follow the data voltage input period P15, in which case the data voltage input termination period P16 is not necessarily provided.

The timing chart of FIG. 1B shows an example of variation in each voltage of the current supply line PL, the cathode line CL, the node $N_G$, and the node $N_S$ in the above-described periods. In FIG. 1B, the voltage-level relationship between $V_{P\text{-}EMI}$, $V_{DATA}$, $V_{CS}$, $V_{G\text{-}INI}$, and $V_{P\text{-}INI}$ for the wirings and nodes is shown, where a vertical axis indicates voltage. FIG. 1B also shows $V_{TH}$ denoting the threshold voltage of the transistor 102, a voltage $V_{CP}$ held by each electrode of the capacitor 103, and a voltage $V_{EL}$ applied to each electrode of the light-emitting element 104. In addition, the ON/OFF state of the switch 101 is also shown in FIG. 1B. Note that the transistor 102 is assumed to be normally on, that is, the threshold voltage $V_{TH}$ is assumed to be negative in FIG. 1B, and the pixel is operated with no problems when the transistor 102 is either normally on or normally off.

Note that even if voltages change at the same time or if the levels of potentials are the same, the voltages do not overlap with each other in FIG. 1B for easy understanding of the change in the voltages of the wirings and nodes. Therefore, the actual voltage-level relationship and the actual timing of a change in voltage may be different from those shown in FIG. 1B.

Figure 3A:
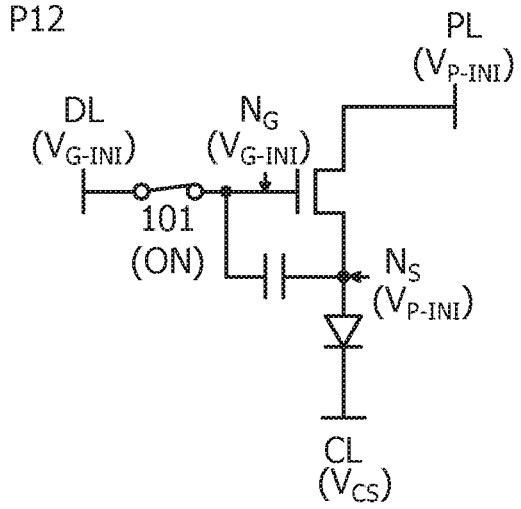
FIGS. 3A and 3B are circuit diagrams illustrating one embodiment of the present invention.

First, in the initialization period P12, the voltage of each wiring and node that has been held in the emission period P11 before the initialization period P12 is initialized or the transistor 102 is turned on. If the transistor 102 has already been turned on, the initialization period P12 can be omitted. The voltage of the current supply line PL is $V_{P\text{-}INI}$, the switch 101 is ON, the voltage of the node $N_G$ is $V_{G\text{-}INI}$, and the transistor 102 is ON. Accordingly, current flows in the transistor 102 with the lowering voltage of the current supply line PL to lower the voltage of the node $N_S$. Though the voltage of the cathode line CL is kept at $V_{CS}$ after the initialization period P12, it may be changed depending on circumstances. After the initialization period P12, the voltage of the node $N_S$ becomes $V_{P\text{-}INI}$, so that a voltage ($V_{G\text{-}INT}$−$V_{P\text{-}INI}$) is held in the capacitor 103. FIG. 3A shows each voltage of the wirings and nodes in the initialization period P12. Note that the voltage of the node $N_S$ can be higher than that of the node $N_G$ depending on the level of the threshold voltage of the transistor 102.

The voltage $V_{P\text{-}INI}$ is smaller than $V_{CS}$ so that current does not pass through the light-emitting element 104. The voltage $V_{G\text{-}INI}$ is larger than $V_{P\text{-}INI}$ so that current does not pass through the transistor 102 to be initialized. However, depending on the level of the threshold voltage of the transistor 102, current can pass through the transistor 102 regardless of the voltage of the node $N_S$ higher than that of the node $N_G$. In such a case, the voltage of the node $N_S$ can be higher than that of the node $N_G$.

Note that the operation in the initialization period P12 is not limited to the above-described operation, and other various operations can be performed in the initialization period P12 in one embodiment of the present invention. Accordingly, the initialization period P12 can be simply referred to as a period, a first period, or the like.

Figure 3B:
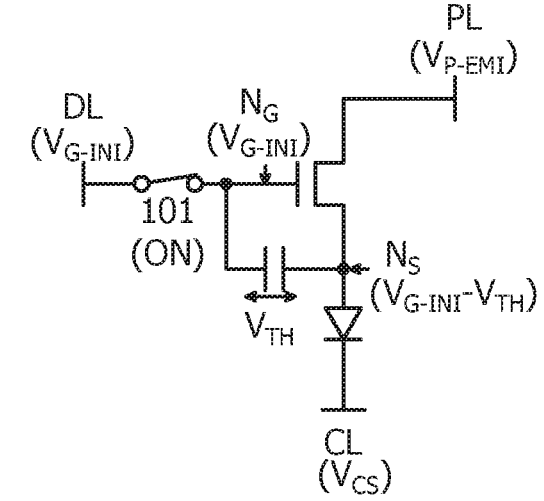

In the threshold voltage compensation period P13 that follows thereafter, current is supplied into the transistor 102 to increase the voltage of the node $N_S$, thereby holding $V_{TH}$ at each electrode of the capacitor 103. Note that there is no need to obtain the threshold voltage of the transistor 102 if variations in characteristics of the transistor 102 are small or less influence, such as when moving images are displayed. Thus, the threshold voltage compensation period P13 does not need to be provided depending on circumstances. The voltage of the current supply line PL is $V_{P\text{-}EMI}$ and the switch 101 is ON. The voltage of the current supply line PL is increased, thereby supplying current to the transistor 102, and accordingly the voltage of the node $N_S$ is increased, so that electric charge accumulated in the capacitor 103 is released. Since the switch 101 remains ON, the voltage of the node $N_G$ is not changed. The voltage of the node $N_S$ keeps increasing until $V_{GS}$ of the transistor 102 becomes $V_{TH}$ and accordingly the current flowing through the transistor 102 is gradually decreased and finally stopped. In other words, the voltage of the node $N_S$ becomes the voltage ($V_{G\text{-}INI}$−$V_{TH}$). Then, the voltage ($V_{TH}$) is held in the capacitor 103. That is, $V_{TH}$ of the transistor 102 is obtained. At this time, the voltage of the node $N_S$ can be higher than the voltage of the node $N_G$ when the transistor 102 is normally on. Although the voltage of the node $N_S$ is the voltage ($V_{G\text{-}INI}$−$V_{TH}$), the actual voltage of the node $N_S$ is higher than that of the node $N_G$ because $V_{TH}$ is a negative value. In other words, such an operation ensures acquiring the threshold voltage if the transistor 102 is normally on. Each potential of the wirings and nodes in the threshold voltage compensation period P13 is shown in FIG. 3B. Note that the voltage of the current supply line PL is not limited to $V_{P\text{-}EMI}$ and may be other voltages higher than the voltage of the node $N_S$ that has been increased already.

Although $V_{GS}$ of the transistor 102 becomes $V_{TH}$ in the above description, electric charge accumulated in the capacitor 103 is not necessarily released until $V_{GS}$ becomes $V_{TH}$. For example, $V_{GS}$ of the transistor 102 may be close to $V_{TH}$ to terminate the threshold voltage acquiring operation, in which case the level of the acquired voltage corresponds to $V_{TH}$ of the transistor 102.

Note that the operation in threshold voltage compensation period P13 is not limited to the above-described operation, and other various operations can be performed in the threshold voltage compensation period P13 in one embodiment of the present invention. Accordingly, the threshold voltage compensation period P13 can be simply referred to as a period, a first period, or the like.

Figure 4A:
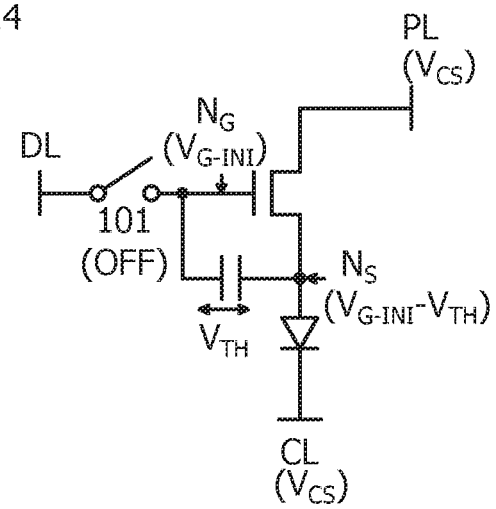
FIGS. 4A and 4B are circuit diagrams illustrating one embodiment of the present invention.

In the threshold voltage compensation termination period P14 that follows thereafter, the voltage of the current supply line PL is $V_{CS}$ and the switch 101 is turned off. Since the switch 101 is OFF and $V_{CS}$ is higher than the voltage of the node $N_S$, the voltages of the nodes $N_S$ and $N_G$ are not changed and thus current does not flow through the transistor 102. Each voltage of the wirings and nodes in the threshold voltage compensation termination period P14 is shown in FIG. 4A.

In the threshold voltage compensation termination period P14, the voltage of the current supply line PL is $V_{CS}$ and the switch 101 is OFF, thereby maintaining the state. In addition, $V_{CS}$ which is the voltage of the current supply line PL is almost equal to or is lower than the voltage $V_{CS}$ of the cathode line CL; thus, there is no risk of leakage current into the light-emitting element 104. As described above, the structure which is one embodiment of the present invention allows the capacitor 103 to keep $V_{TH}$; thus, once the threshold voltage is acquired, the data voltage writing period and the emission period are not needed thereafter, and only the data voltage writing period is provided per gate selection period. This can provide a sufficient compensation time in each of the initialization period, the threshold voltage acquiring period, and the data voltage writing period, and a sufficiently long data voltage writing period.

Note that the input of a data voltage may be performed in a different pixel in the threshold voltage compensation termination period P14. In other words, the threshold voltage compensation termination period P14 may overlap with the data voltage input period P15 in the different pixel.

Note that the operation in the threshold voltage compensation termination period P14 is not limited to the above-described operation, and other various operations can be performed in the threshold voltage compensation termination period P14 in one embodiment of the present invention. Accordingly, the threshold voltage compensation termination period P14 can be simply referred to as a period, a first period, or the like.

In the next period, the data voltage input period P15, $V_{DATA}$ is applied to the data line DL, and the switch 101 is turned on. The voltage of the node $N_G$ is changed from $V_{G\text{-}INI}$ to $V_{DATA}$. Thus, the voltage of the node $N_S$ changes depending on the capacitive coupling in the capacitor 103 in accordance with the voltage change of the node $N_G$.

Figure 6:
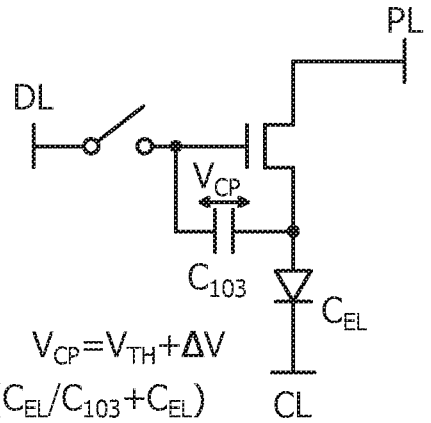
FIG. 6 is a circuit diagram illustrating one embodiment of the present invention.

Here, the voltage of the capacitor 103 is denoted by $V_{CP}$. The capacitance of the capacitor 103 is denoted by $C_{103}$. The capacitance of the light-emitting element 104 is denoted by $C_{EL}$. FIG. 6 shows the relationship of voltages and capacitances of these elements. The voltage $V_{CP}$ held in each electrode of the capacitor becomes ($V_{TH}+\Delta V$) depending on the capacitive coupling. The value of $\Delta V$ is the product of the amount of change in voltage of the node $N_G$ ($V_{DATA}-V_{G\text{-}INI}$) and the capacitance ratio of the capacitor 103 and the light-emitting element 104 ($C_{EL}/(C_{103}+C_{EL})$).

Figure 4B:
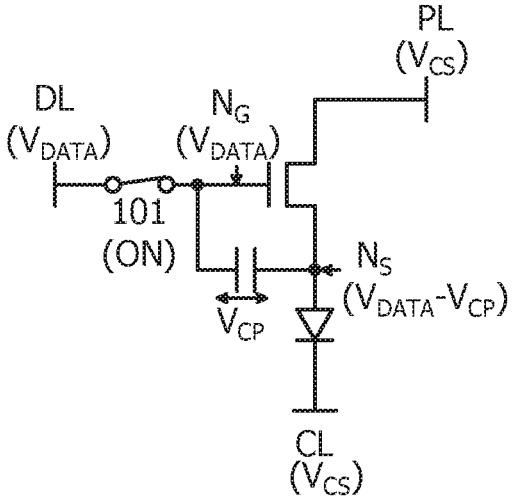

In other words, the voltage of the node $N_S$ is increased to ($V_{DATA}-V_{CP}$) in the data voltage input period P15; however, this increase can be suppressed by increasing $C_{EL}$. In addition, although the voltage of the node $N_S$ is increased, the voltage of the current supply line PL is equal to or lower than $V_{CS}$ in the data voltage input period P15. Thus, if the level of $V_{DATA}$ is large, current is supplied from the node $N_S$ to the current supply line PL through the transistor 102; therefore, undesired emission from the light-emitting element 104 is suppressed, though the voltage of the node $N_S$ is increased. In addition, the increase in the voltage of the node $N_S$ is limited. That is, if the voltage of the node $N_S$ is changed too much because of leakage current through the transistor 102, the voltage of the node $N_S$ only becomes equal to the voltage of the current supply line PL. Thus, even if the voltage of the node $N_S$ is changed too much, the voltage of the capacitor 103 finally corresponds to $V_{DATA}$. Such a structure prevents that the voltage of the node $N_S$ is changed too much, so that a voltage not related to $V_{DATA}$, such as the threshold voltage of the transistor 102, is held in the capacitor 103. There is thus no need of control performed so that the data voltage input period P15 becomes shorter. Note that in the case of shortening the data voltage input period P15, the amount of change in the voltage of the node $N_S$, which can be larger because of leakage current through the transistor 102, can be reduced. Each voltage of the wirings and nodes in the data voltage input period P15 is shown in FIG. 4B.

Note that the operation in data voltage input period P15 is not limited to the above-described operation, and other various operations can be performed in the data voltage input period P15 in one embodiment of the present invention. Accordingly, the data voltage input period P15 can be simply referred to as a period, a first period, or the like.

Figure 5A:
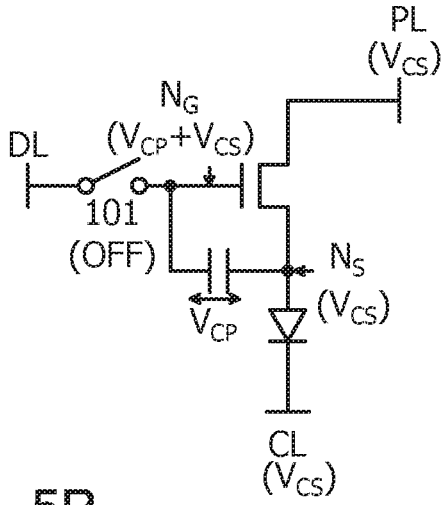
FIGS. 5A and 5B are circuit diagrams illustrating one embodiment of the present invention.

In the next period, the data voltage input termination period P16, the switch 101 is turned off. Since the switch 101 is turned off, the node $N_G$ is brought into a floating state. Accordingly, the voltage $V_{CP}$ of the capacitor 103 in this period is maintained. When current is supplied into the transistor 102 because of increased voltage of the node $N_S$ in the data voltage input period P15, the voltage of the node $N_S$ is lowered. With the lowering of the node $N_S$, the voltage of the node $N_G$ is lowered as well. The voltage of the node $N_S$ becomes $V_{CS}$ similarly to the voltage of the current supply line PL. Since the capacitor 103 holds $V_{CP}$, the voltage of the node $N_G$ becomes ($V_{CP}+V_{CS}$). Each voltage of the wirings and nodes in the threshold voltage input termination period P16 is shown in FIG. 5A.

Note that the voltage of the current supply line PL in this period is set lower than the voltage $V_{P\text{-}EMI}$ in the emission period P11. Specifically, for example, the voltage of the current supply line PL is set at $V_{CS}$ similarly to the cathode line CL. Thus, variations in the voltage of the node $N_S$ are reduced after time passed in the data voltage input termination period P16, leading to suppressing emission from the light-emitting element 104.

Note that the input of a data voltage may be performed in a different pixel in the data voltage input termination period P16. In other words, the data voltage input termination period P16 may overlap with the data voltage input period P15 in the different pixel.

Note that the operation in data voltage input termination period P16 is not limited to the above-described operation, and other various operations can be performed in the data voltage input termination period P16 in one embodiment of the present invention. Accordingly, the data voltage input termination period P16 can be simply referred to as a period, a first period, or the like.

Figure 5B:
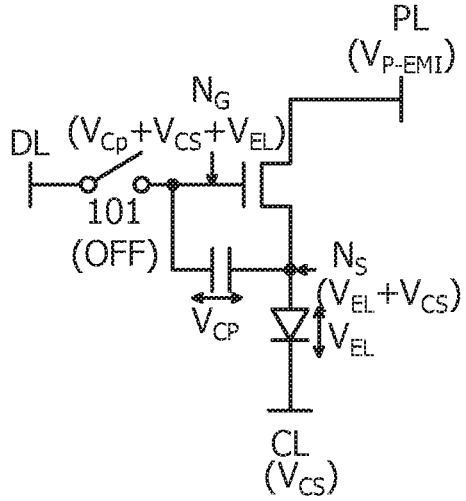

In the next period, the emission period P11, the voltage of the current supply line PL is switched into $V_{P\text{-}EMI}$. The voltage of the current supply line PL is increased, whereby current is supplied into the transistor 102 and the voltage of the node $N_S$ is increased. Since the switch 101 remains off, the voltage of the node $N_G$ is increased with the increased voltage of the node $N_S$. $V_{GS}$ of the transistor holds $V_{CP}$ that has been determined in the data voltage writing period. Since $V_{CP}$ is a voltage in which a term including $V_{DATA}$ is added to $V_{TH}$, current depending on $V_{DATA}$ can be supplied into the light-emitting element 104 regardless the level of $V_{TH}$. In other words, the influence of variations in $V_{TH}$ can be reduced. Note that the node $N_S$ has a voltage ($V_{EL}$+$V_{CS}$) that is higher than $V_{CS}$ by $V_{EL}$. The node $N_G$ has a voltage ($V_{CP}$+$V_{CS}$+$V_{EL}$) that is higher than ($V_{CS}$+$V_{EL}$) by $V_{CP}$. Each voltage of the wirings and nodes in the emission period P11 is shown in FIG. 5B.

Note that the operation in the emission period P11 is not limited to the above-described operation, and other various operations can be performed in the emission period P11 in one embodiment of the present invention. Accordingly, the emission period P11 can be simply referred to as a period, a first period, or the like.

In the above-described structure of one embodiment of the present invention, for example, the potential of the current supply line is equal to the potential of the cathode line in the data voltage writing period, so that time for acquiring threshold voltage can be longer. Note that an embodiment of the present invention is not limited thereto. In addition, an increase in the voltage of the node $N_S$, which is provided on the anode side of the light-emitting element, is suppressed to prevent undesired emission in the data voltage writing period.

Modification Example of Pixel

Next, a modification example of the circuit configuration of a pixel shown in FIG. 1A is described.

Figure 7:
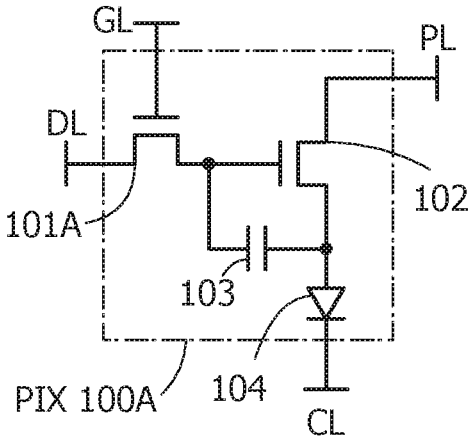
FIG. 7 is a circuit diagram illustrating one embodiment of the present invention.

The switch 101 included in the pixel 100 shown in FIG. 1A can be replaced with a transistor as shown in FIG. 7, a circuit diagram. A pixel 100A shown in FIG. 7 includes a transistor 101A instead of the switch 101 in FIG. 1A. Note that ON/OFF of the transistor 101A is controlled by potentials applied to the gate line GL.

The transistor 101A is preferably a transistor containing an oxide semiconductor in its channel formation region (OS transistor), for example. The off-state current of an OS transistor can be small. Thus, the transistor 101A functioning as a switch is turned off to suppress variations in the potential of the node $N_G$. Note that one embodiment of the present invention is not limited thereto. For example, the transistor 101A may be a transistor containing silicon in its channel formation region (Si transistor). Similarly, a transistor containing an oxide semiconductor in its channel formation region (OS transistor) is preferably used as the transistor 102 as well. Note that one embodiment of the present invention is not limited thereto. For example, the transistor 102 can be a transistor containing silicon in its channel formation region (Si transistor).

Figure 8A:
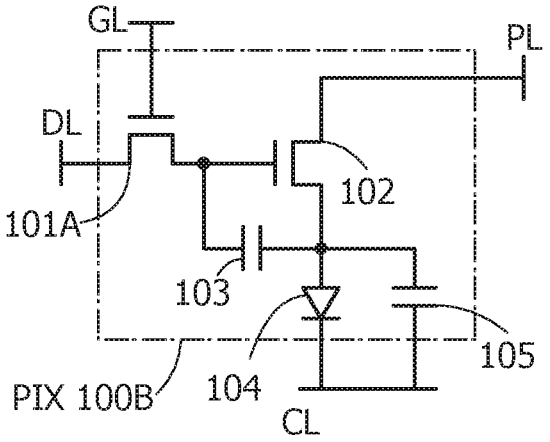
FIGS. 8A and 8B are circuit diagrams illustrating one embodiment of the present invention.

The pixel 100 in FIG. 1A preferably includes a capacitor parallel to the light-emitting element 104 as in FIG. 8A showing a circuit diagram. A pixel 100B shown in FIG. 8A includes a capacitor 105 in addition to the components in FIG. 1A.

The above-described embodiments of the present invention utilize the capacitance ratio of the capacitor 103 to the light-emitting element 104. If the capacitance of the capacitor 103 is larger than that of the light-emitting element 104, the potential of the node $N_S$ might be increased too much in the data voltage input period P15, resulting in undesired emission from the light-emitting element. To prevent this, the capacitor 105 is preferably provided. Note that the circuit configuration shown in FIG. 8A is preferable for providing the capacitor without increasing the number of wirings.

Figure 8B:
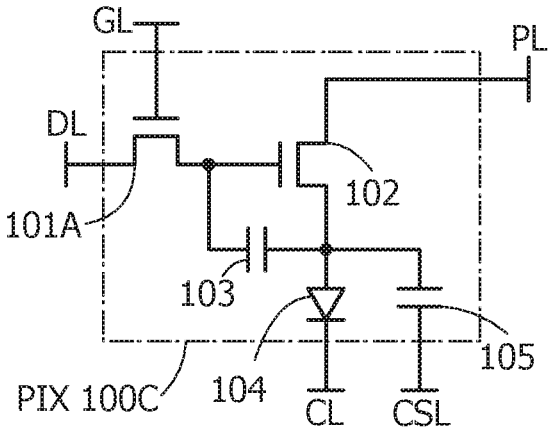

Alternatively, a capacitor line may be provided for the capacitor 105 as in FIG. 8B, a circuit diagram. A pixel 100C shown in FIG. 8B includes the capacitor 105 one electrode of which is connected to a capacitor line CSL in addition to the components shown in FIG. 8A.

Although the circuit shown in FIG. 8B needs an additional wiring, it can be easily fabricated without a complicated process, such as a process step of connecting a cathode of the light-emitting element 104 to an electrode layer of the transistor 102.

Figure 9A:
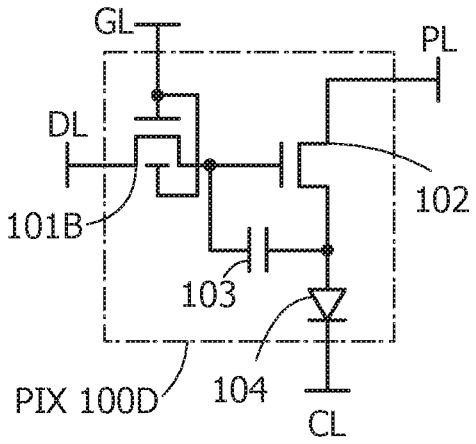
FIGS. 9A and 9B are circuit diagrams illustrating one embodiment of the present invention.

A pixel 100D shown in FIG. 9A is a modification example of the pixel 100A in FIG. 7. A transistor functioning as a switch in the pixel 100D is a transistor 101B having a backgate.

Figure 9B:
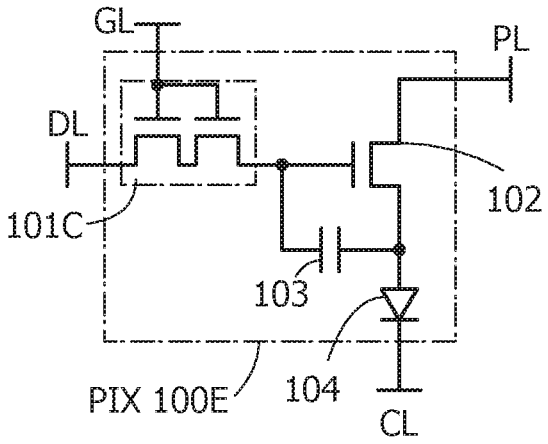

A pixel 100E shown in FIG. 9B is a modification example of the pixel 100A in FIG. 7. A transistor functioning as a switch in the pixel 100E is a series-connected transistor 101C.

Figure 10A:
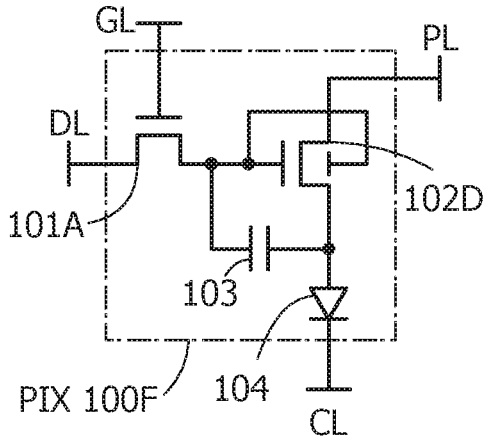
FIGS. 10A to 10C are circuit diagrams illustrating one embodiment of the present invention.

A pixel 100F shown in FIG. 10A is a modification example of the pixel 100A in FIG. 7. The transistor 102 in the pixel 100F is a transistor 102D having a backgate. The same potential is applied to each gate of the transistor 102D.

Figure 10B:
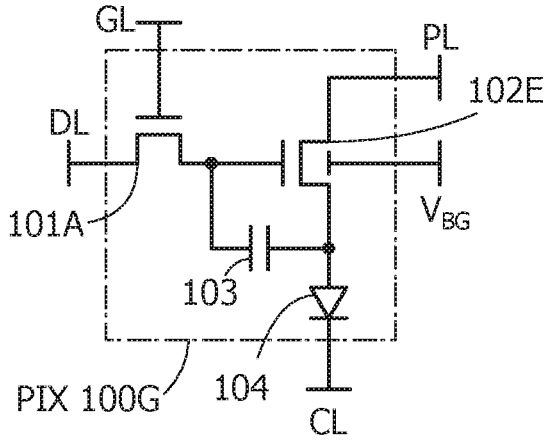

A pixel 100G shown in FIG. 10B is a modification example of the pixel 100A in FIG. 7. The transistor 102 in the pixel 100G is a transistor 102E having a backgate. Potentials applied to the gates of the transistor 102E are different from each other. The voltage $V_{BG}$ is applied to the backgate to control the threshold voltage of the transistor 102E.

Figure 10C:
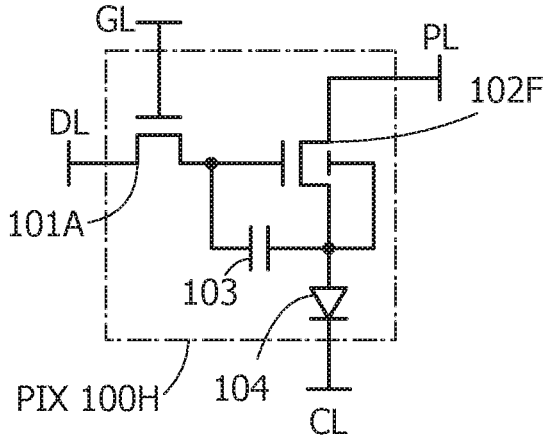
Figure 11:
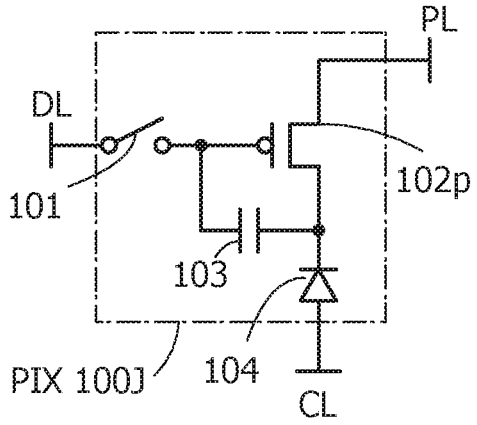
FIG. 11 is a circuit diagram illustrating one embodiment of the present invention.

A pixel 100H shown in FIG. 10C is a modification example of the pixel 100A in FIG. 7. The transistor 102 in the pixel 100H is a transistor 102F having a backgate. Potentials applied to the gates of the transistor 102F are different from each other. The voltage of the node $N_S$ is applied to the backgate.

Although the transistor 102 in the pixel 100 shown in FIG. 1A is an n-channel transistor, one embodiment of the present invention is not limited thereto. A pixel 100J shown in FIG. 11, which is different from the pixel in FIG. 1A, includes a p-channel transistor 102 instead of the transistor 102.

Figure 12A:
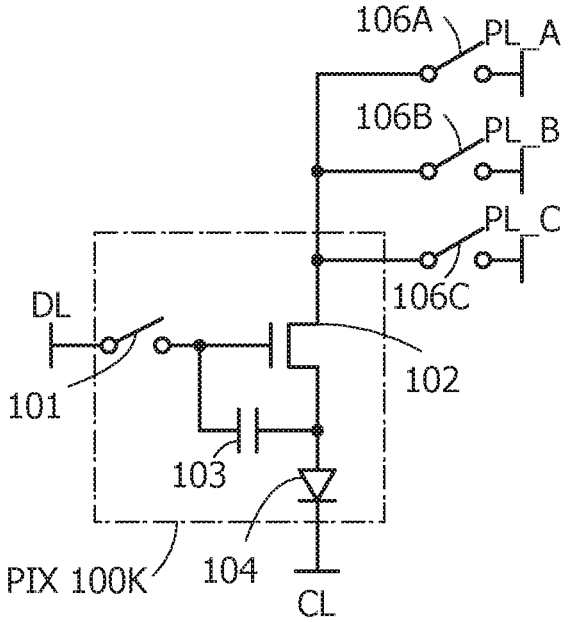
FIGS. 12A and 12B are circuit diagrams illustrating one embodiment of the present invention.

In addition, although the transistor 102 is connected to the current supply line PL, one embodiment of the present invention is not limited thereto. For example, a pixel 100K shown in FIG. 12A is different from the pixel in FIG. 1A. The transistor 102 in FIG. 12A is connected to different wirings, that is, to a current supply line PL_A via a switch 106A, to a current supply line PL_B via a switch 106B, and to a current supply line PL_C via a switch 106C. Different voltages $V_{P\text{-}EMI}$, $V_{CS}$, and $V_{P\text{-}INI}$ are applied to the current supply lines PL_A, PL_B, and PL_C, respectively, and the level of a voltage applied to the transistor 102 is controlled using the switches 106A, 106B, and 106C. Since the switches are provided like this, the above-described operation can be performed without changing the potentials of the current supply lines PL_A, PL_B, and PL_C.

Figure 12B:
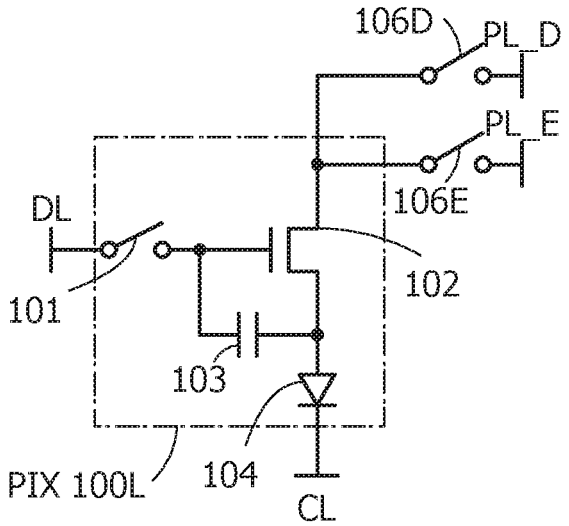

Although the pixel 100K shown in FIG. 12A is configured to apply different voltages to the current supply lines PL_A, PL_B, and PL_C, a wiring to which a constant voltage is applied and a wiring to which different voltages are applied may be provided as in FIG. 12B showing a circuit diagram. The transistor 102 in a pixel 100L shown in FIG. 12B is connected to different wirings, that is, to a current supply line PL_D via a switch 106D and to a current supply line PL_E via a switch 106E. $V_{P\text{-}EMI}$ is applied to the current supply line PL_D, whereas different voltages $V_{CS}$ and $V_{P\text{-}INI}$ are applied to the current supply line PL_E, and the level of a voltage applied to the transistor 102 can be controlled using the switches 106D and 106E.

Figure 13A:
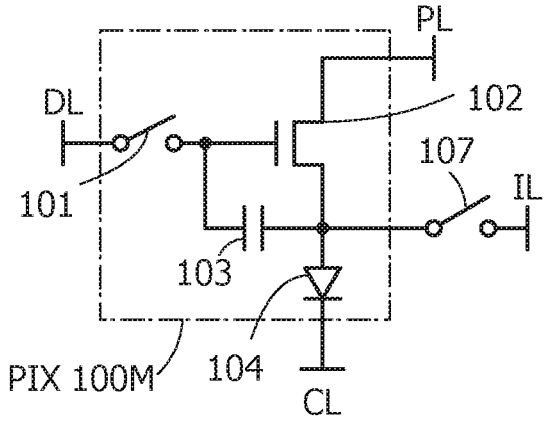
FIGS. 13A and 13B are circuit diagrams illustrating one embodiment of the present invention.

A pixel 100M shown in FIG. 13A has a different configuration from the pixel in FIG. 1. The node $N_S$ in FIG. 13A is connected to a wiring IL supplying the initialization voltage $V_{P\text{-}INI}$ via a switch 107. The switch 107 is turned on at least in the initialization period P12, so that the voltage of the node $N_S$ is kept low without lowering the voltage of the current supply line PL. The switch 107 is preferably OFF in periods other than the initialization period P12. Note that one embodiment of the present invention is not limited thereto.

Figure 13B:
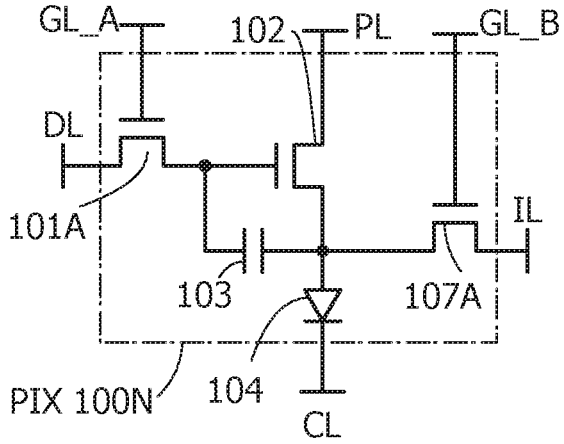

Note that the switches 101 and 107 in the pixel 100M shown in FIG. 13A can be replaced with transistors as shown in FIG. 13B, a circuit diagram of a pixel. A pixel 100N in FIG. 13B includes a transistor 101A and a transistor 107A. The transistor 101A and the transistor 107A are controlled using a gate line GL_A and a gate line GL_B, respectively.

Figure 14A:
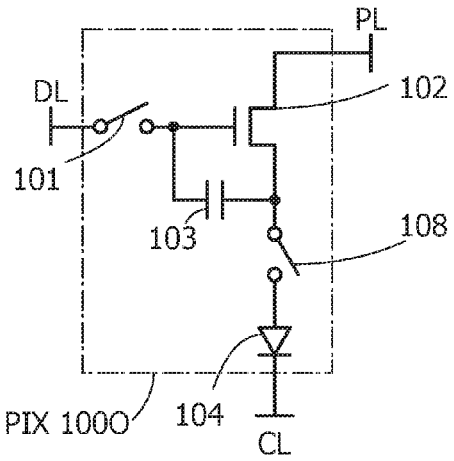
FIGS. 14A to 14C are circuit diagrams illustrating one embodiment of the present invention.

A pixel 100O shown in FIG. 14A has a different configuration from FIG. 1A. In FIG. 14A, a switch 108 is provided between the node $N_S$ and the light-emitting element 104. For example, the switch 108 is OFF at least in one period except the emission period P11 and is ON at least in the emission period P11, so that undesired emission from the light-emitting element 104 can be suppressed. Note that the switch may be turned on in the data voltage input period P15 as well.

Figure 14B:
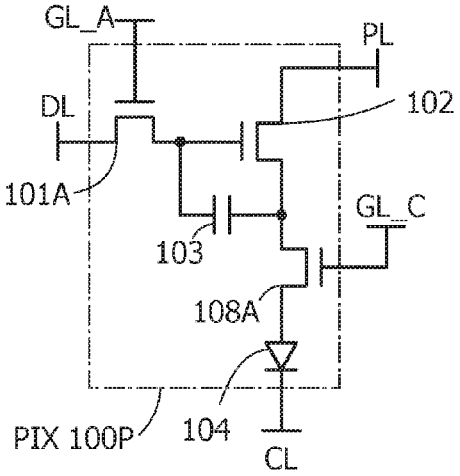

Note that the switches 101 and 108 in the pixel 100O shown in FIG. 14A can be replaced with transistors as shown in FIG. 14B, a circuit diagram of a pixel. A pixel 100P in FIG. 14B includes the transistor 101A and a transistor 108A. The transistor 101A and the transistor 108A are controlled using the gate line GL_A and a gate line GL_C, respectively.

Figure 14C:
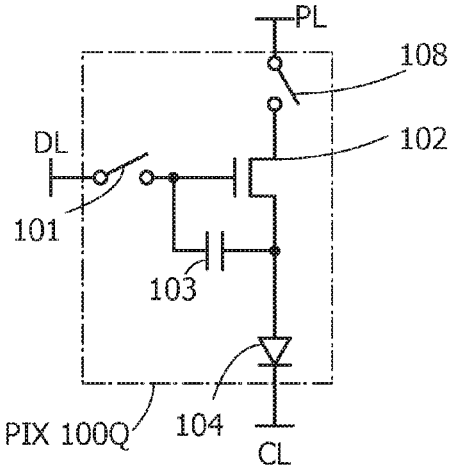

A pixel 100Q shown in FIG. 14C has a different configuration from FIG. 14A. In FIG. 14C, the switch 108 is provided not between the node $N_S$ and the light-emitting element 104 but between the transistor 102 and the current supply line PL.

Figure 15A:
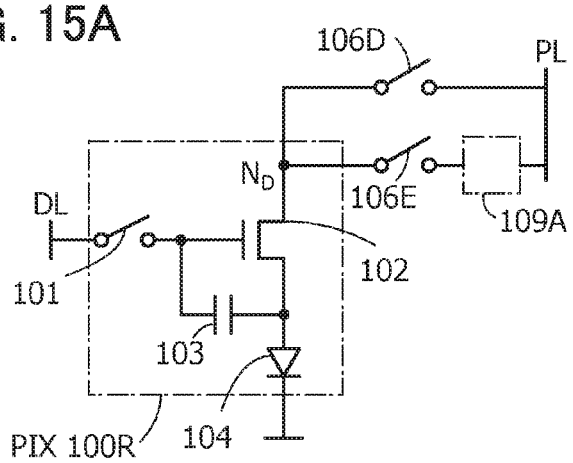
FIGS. 15A and 15B are a circuit diagram and a timing chart illustrating one embodiment of the present invention.

A pixel 100R shown in FIG. 15A has a different configuration from FIG. 1A. In FIG. 15A, a switch 106D, a circuit 109A, and a switch 106E are provided between the transistor 102 and the current supply line PL. The circuit 109A is configured to distort waveforms when the voltage of the current supply line PL is applied to one of the source and the drain of the transistor 102 (the node ND in drawings). Note that the circuit 109A may be provided either inside or outside the pixel 100R.

Figure 15B:
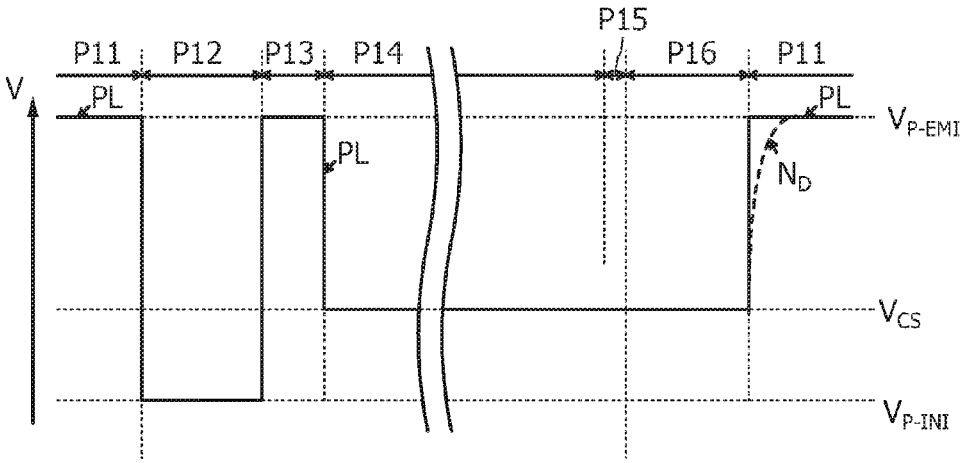

The operation of the circuit 109A is preferably switched using the switches 106D and 106E. For example, the circuit 109A needs to be active when waveforms in the node $N_S$ should be blunted, such as in the emission period P11. In the transition to the emission period P11, waveforms of the voltage of the current supply line PL is blunted in the node $N_S$ as shown in FIG. 15B, leading to a smooth transition in luminance. Thus, a reduction in glare and flicker is expected to provide an eye-friendly and strain-free display device.

Figure 16A:
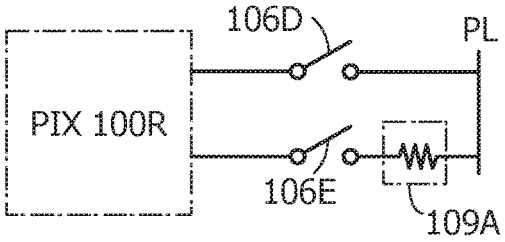
FIGS. 16A to 16E are circuit diagrams illustrating one embodiment of the present invention.
Figure 16B:
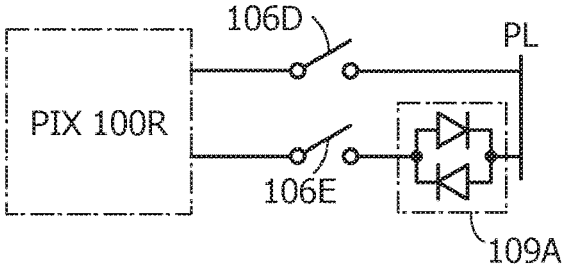
Figure 16C:
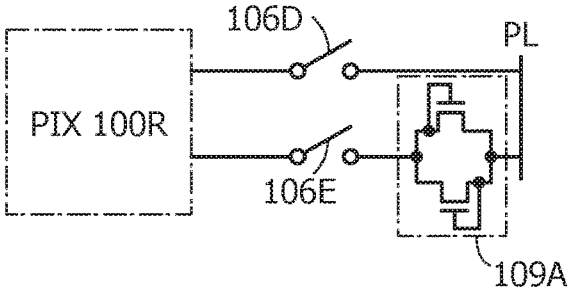

For example, the circuit 109A may be composed of a resistor, a diode, or diode-connected transistors as shown in FIG. 16A, 16B, or 16C, respectively.

Figure 16D:
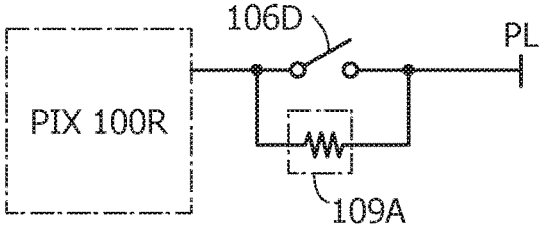
Figure 16E:
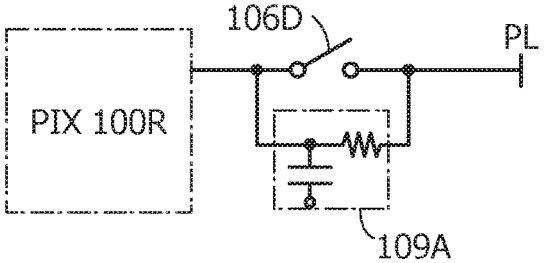

Note that the circuit 109A may be configured to be active by turning the switch 106D off and be inactive by turning the switch 106D off as shown in FIG. 16D. Alternatively, the circuit 109A may be composed of a combination of a resistor and a capacitor as shown in FIG. 16E.

Figure 17A:
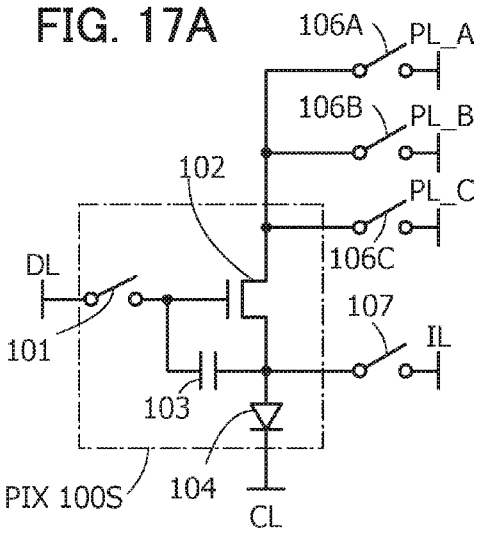
FIGS. 17A to 17C are circuit diagrams illustrating one embodiment of the present invention.
Figure 17B:
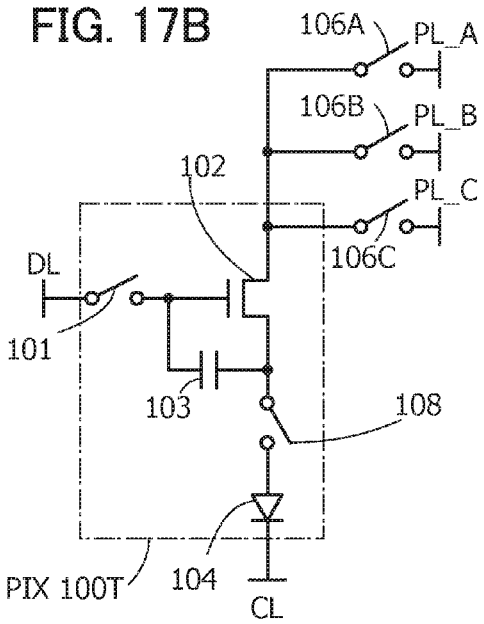
Figure 17C:
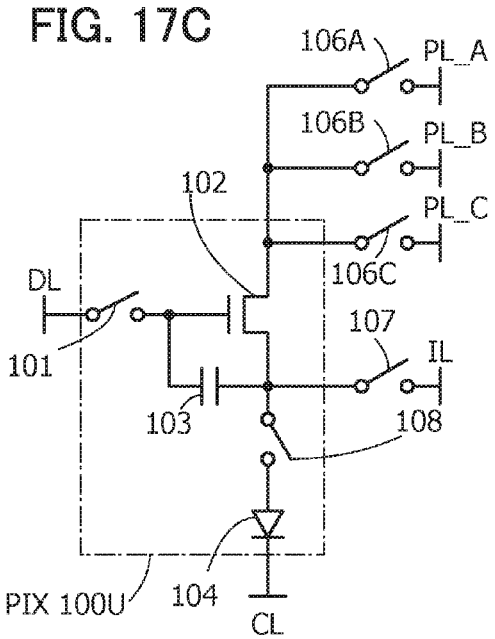

Note that the circuits in FIGS. 12A to 15A can be combined. For example, a pixel 100S shown in FIG. 17A is a combination of FIG. 12A and FIG. 13A. Similarly, a pixel 100T shown in FIG. 17B is a combination of FIG. 12A and FIG. 14A. A pixel 100U shown in FIG. 17C is a combination of FIG. 12A, FIG. 13A, and FIG. 14A. Such a circuit appropriately combining different circuits can be used.

As has been described, one embodiment of the present invention can operate using any of a variety of variation examples.

<Block Diagram of Display Device>

Next Described is an example of a block diagram of a display device that can include the pixels illustrated in FIG. 1A and the like.

Figure 18A:
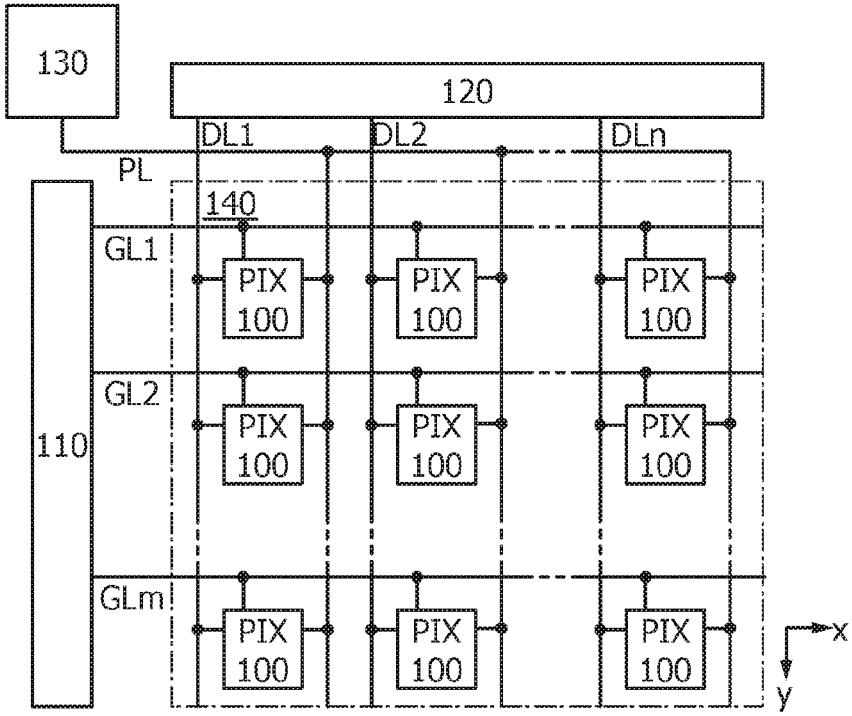
FIGS. 18A and 18B are block diagrams illustrating one embodiment of the present invention.

FIG. 18A is an example of a block diagram of such a display device and illustrates a gate line driver circuit 110, a data line driver circuit 120, a current supply line control circuit 130, and a pixel portion 140 including a pixel 100.

A plurality of pixels 100 in the pixel portion 140 is arranged in x and y directions in a matrix. In the pixel portion 140, gate lines GL1 to GLm (m is a natural number) connected to the gate line driver circuit 110 are arranged in the x direction. The gate lines GL1 to GLm are connected to respective pixels 100. In the pixel portion 140, data lines DL1 to DLn (n is a natural number) connected to the data line driver circuit 120 are arranged in the y direction. The data lines DL1 to DLn are connected to respective pixels 100.

The current supply line PL is connected to the current supply line control circuit 130 and is provided in the y direction as shown in FIG. 18A. Although the current supply line PL is common in all the pixels and is connected to one current supply line control circuit 130, one embodiment of the present invention is not limited thereto. For example, the current supply line PL may be connected to different current supply line control circuits for a pixel for each color.

Figure 18B:
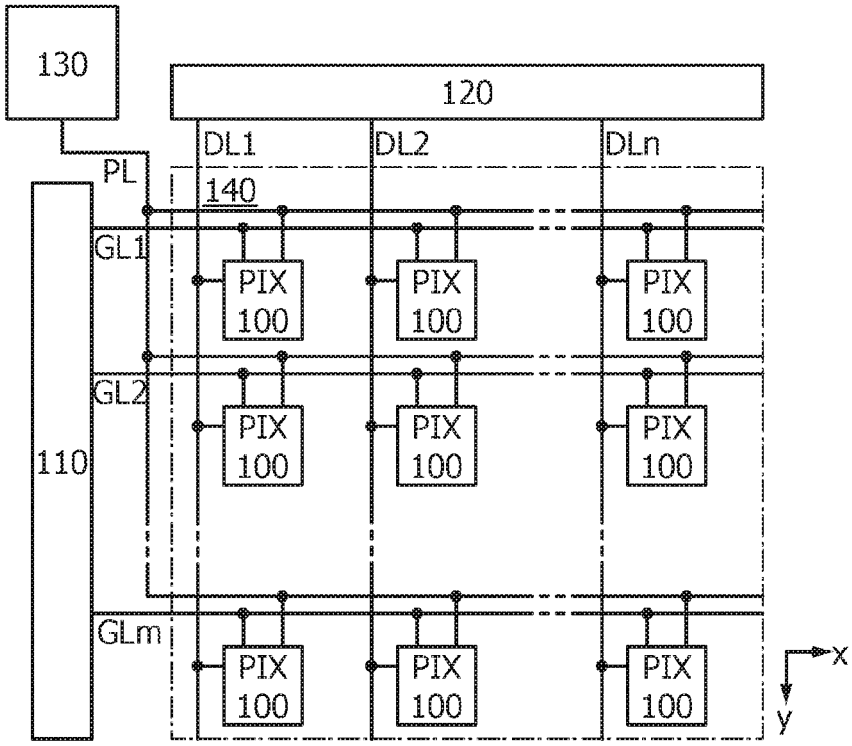

Note that the current supply line PL may be provided in the x direction as shown in FIG. 18B.

In the case where the pixel portion 140 and the current supply line control circuit 130 are formed over different substrates, for example, in the case where the pixel portion 140 and the current supply line control circuit 130 are formed over an insulating substrate and a semiconductor substrate, respectively, the pixel portion 140 and the current supply line control circuit 130 need to be connected via a connection terminal. However, the display device needs less connection terminals because the number of wirings is small. A reduction in the number of connection terminals leads to an increase in yield.

In addition, there is no need to provide the current supply line control circuit 130 in each row, and the layout area of the driver circuit, that is, the bezel of the display device can be small.

Figure 19A:
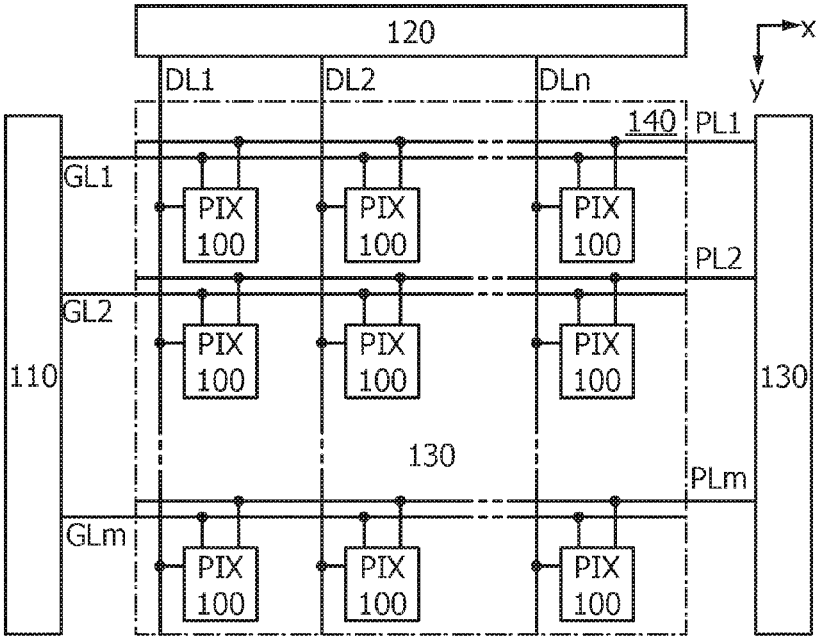
FIGS. 19A and 19B are block diagrams illustrating one embodiment of the present invention.

Note that the current supply line PL may be provided as shown in FIG. 19A so that the current supply line control circuit 130 can separately scan current supply lines PL1 to PLm.

In such a case of scanning row by row, there is no need to provide the initialization period P12 and the threshold voltage compensation period P13 at the same timing in all the pixels. Thus, the initialization period P12 and the threshold voltage compensation period P13 may be provided row by row, in which case the threshold voltage compensation termination period P14 and the data voltage input termination period P16 can be omitted as shown in a timing chart of FIG. 20.

Figure 19B:
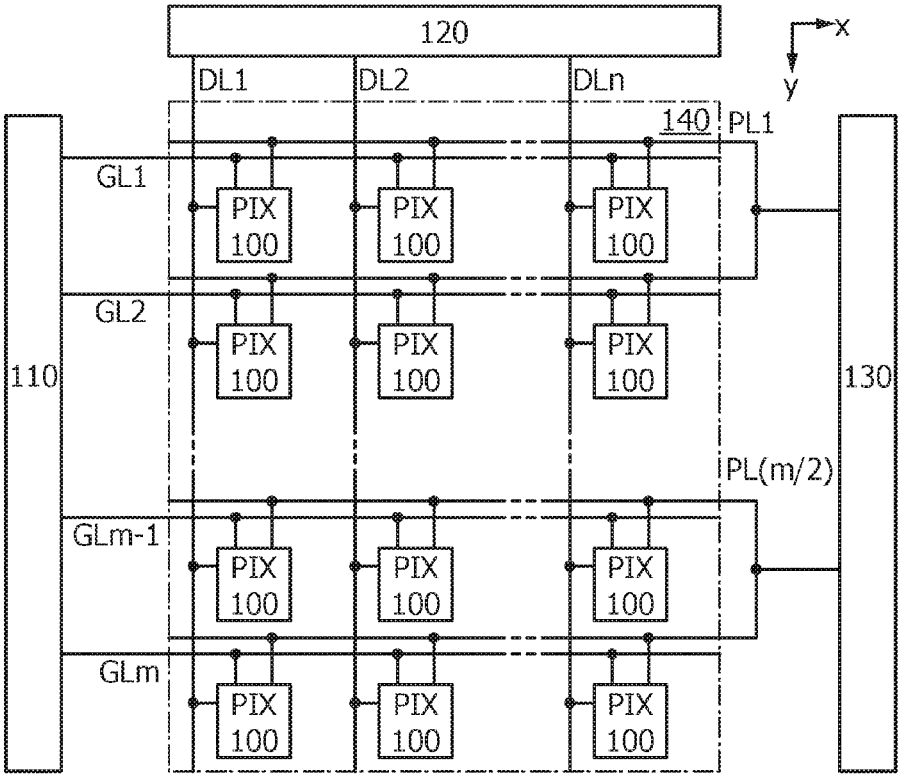
Figure 20:
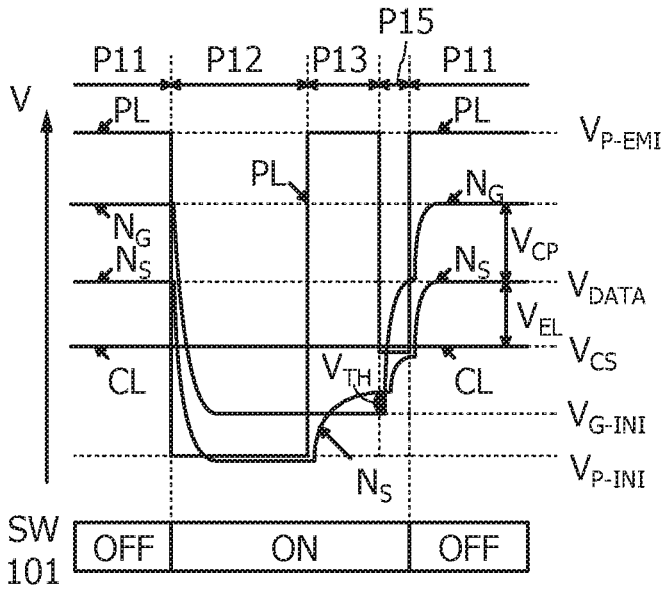
FIG. 20 is a timing chart illustrating one embodiment of the present invention.

Note that the current supply line PL may be provided as shown in FIG. 19B, where the current supply line control circuit 130 scans the current supply lines PL by a plurality of rows so that the current supply lines PL1 to PL(m/2) are scanned sequentially.

Figure 21A:
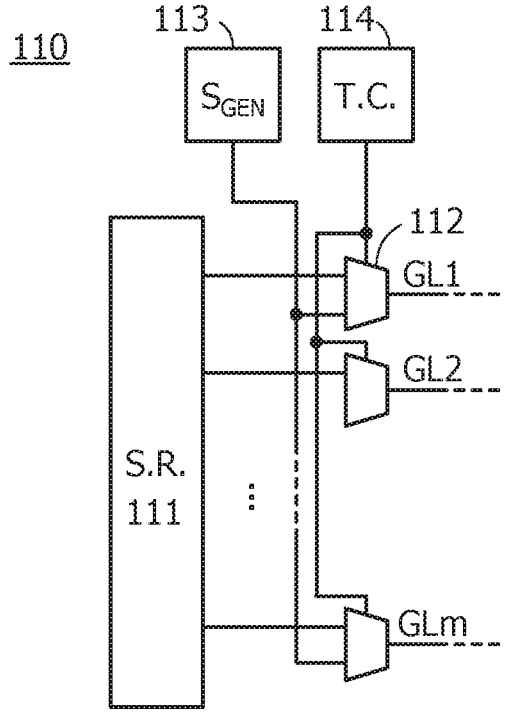
FIGS. 21A and 21B are circuit diagrams illustrating one embodiment of the present invention.
Figure 21B:
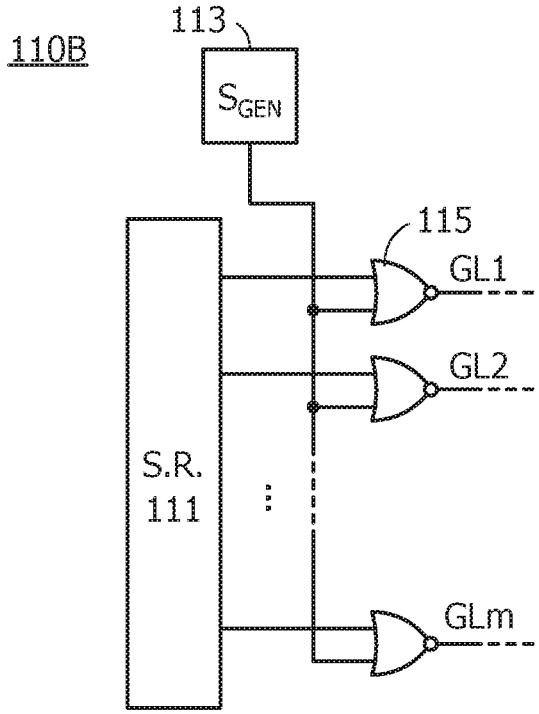

FIGS. 21A and 21B show structure examples of the gate line driver circuit 110. In the pixel operation according to one embodiment of the present invention, a period for changing voltages at the same time and a period for scanning the gate lines GL1 to GLm are switched between the period for initialization and threshold compensation and the period for writing data voltage into each pixel.

For example, in the gate line driver circuit 110 in FIG. 21A includes a shift register 111 (denoted by S.R. in drawings) that generates a scan signal, a signal generation circuit 113 (denoted by $S_{GEN}$ in drawings) that generates an initialization voltage, a selector 112 that switches a signal generated by the shift register 111 and a signal generated by the signal generation circuit 113, and a timing controller 114 (denoted by T.C. in drawings) that generates a signal for switching the output of the selector 112. In accordance with the timing controller 114, a signal generated by the shift register 111 and a signal generated by the signal generation circuit 113 are switched by the selector 112 and a selected one is output.

A gate line driver circuit 110B in FIG. 21B, which shows another structure, includes the shift register 111 (denoted by S.R. in drawings) that generates a scan signal, the signal generation circuit 113 (denoted by $S_{GEN}$ in drawings) that generates an initialization voltage, and an OR circuit 115 as a combination circuit. In accordance with the OR circuit 115, a signal generated by the shift register 111 and a signal generated by the signal generation circuit 113 are switched and a selected one is output.

Figure 22A:
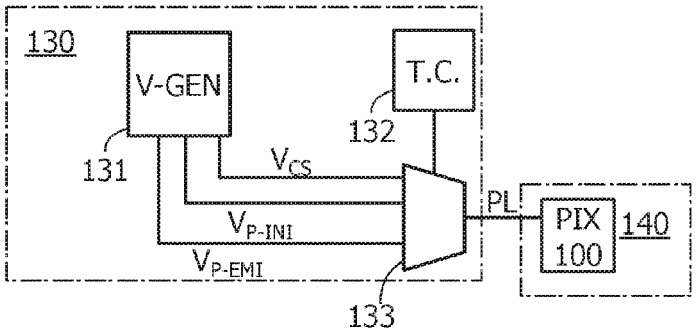
FIGS. 22A to 22C are circuit diagrams illustrating one embodiment of the present invention.
Figure 22B:
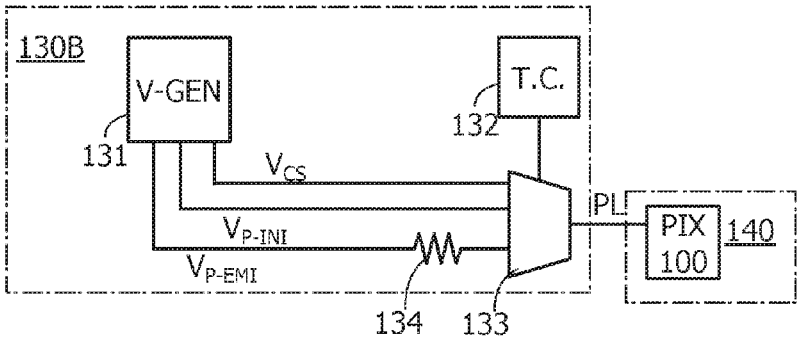
Figure 22C:
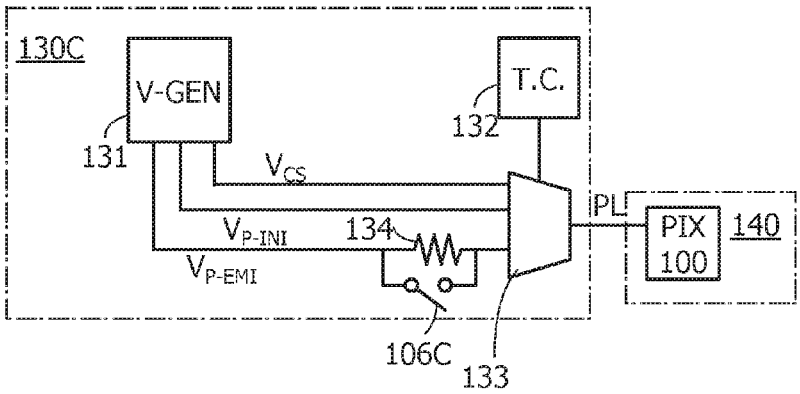

FIGS. 22A to 22C show structure examples of the current supply control circuit 130. In the pixel operation according to one embodiment of the present invention, voltages are changed in the initialization period, the threshold compensation period, the period for writing data voltage into each pixel, and the emission period.

The current supply line control circuit 130 in FIG. 22A includes a voltage generation circuit 131 (denoted by V-GEN in drawings) that generates a voltage, a selector 133 that switches a plurality of voltages, and a timing controller 132 (denoted by T.C. in drawings) that generates a signal for switching the output of the selector 133. In accordance with the timing controller 132, a plurality of voltages $V_{P\text{-}EMI}$, $V_{P\text{-}INI}$, and $V_{CS}$ are switched and a selected one is output.

A current supply line control circuit 130B in FIG. 22B includes the voltage generation circuit 131 (denoted by V-GEN in drawings) that generates a voltage, a selector 133 that switches a plurality of voltages, and a timing controller 132 (denoted by T.C. in drawings) that generates a signal for switching the output of the selector 133. In accordance with the timing controller 132, a plurality of voltages $V_{P\text{-}EMI}$, $V_{P\text{-}INI}$, and $V_{CS}$ are switched and a selected one is output.

The current supply line control circuit 130B in FIG. 22B includes the resistor 134 in a path for the voltage $V_{P\text{-}EMI}$ that is applied to the current supply line PL in the emission period P11. If the voltage of the current supply line PL changes abruptly in the emission period P11, the luminance also changes abruptly, so that flicker might be recognized. However, the current supply line control circuit 130 can make a voltage change slight using the resistor 134 to suppress such an abrupt change in luminance and accordingly blinking can be reduced. A switch 106C that switches the operation of the resistor 134 may be provided as shown in FIG. 22C, which is an effective structure. Note that as in FIGS. 16A to 16E, the circuit composed of the resistor 134 can be replaced or a capacitor can be added thereto.

Modification Example of Pixel Operation

Next, a modification example of the operation of the pixel 100 in FIG. 1A is described.

Figure 23A:
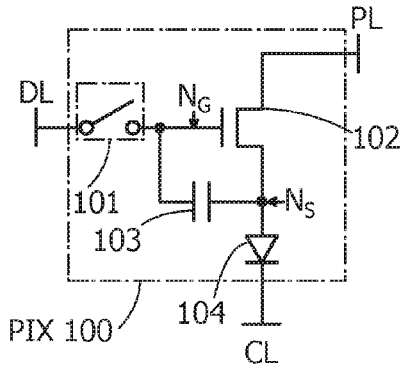
FIGS. 23A and 23B are a circuit diagram and a timing chart illustrating one embodiment of the present invention.
Figure 23B:
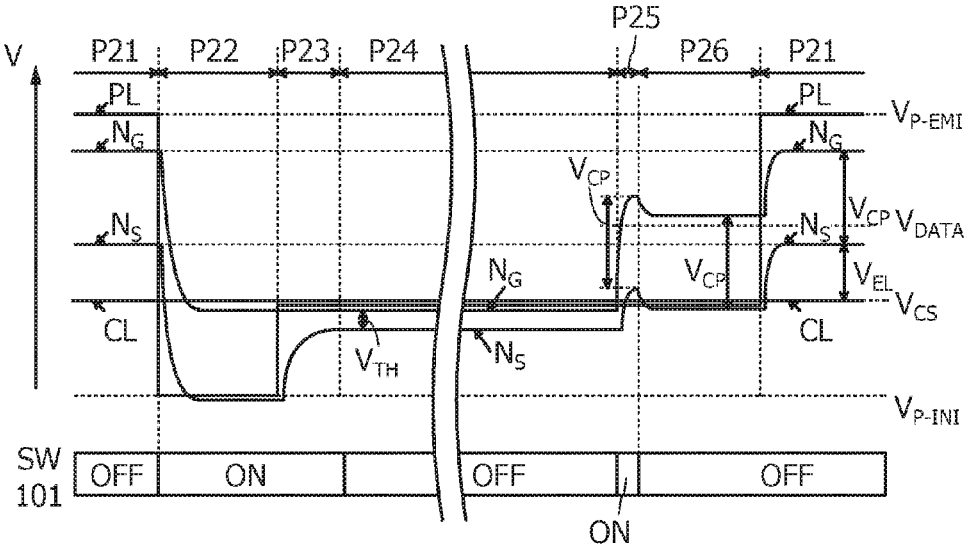

FIG. 23A is a circuit diagram of the pixel 100 which is the same as that in FIG. 1A. FIG. 23B is a timing chart for the operation of the pixel 100, which is a modification example of FIG. 1B. FIGS. 24A and 24B to FIGS. 26A and 26B are circuit diagrams showing the voltage of each line, the operation of the switch, and the voltage of each node in each period in FIG. 23B.

Note that the transistor 102 is assumed to be normally on, that is, the threshold voltage $V_{TH}$ is assumed to be negative in FIG. 14B, unlike in FIG. 1B. In the following description of FIG. 14B, points of difference from FIG. 1B are described in detail, whereas the above description may be referred to for points of similarity, which may be briefly described.

The timing chart of FIG. 23B is separated into an emission period P21, an initialization period P22, a threshold voltage compensation period P23, a threshold voltage compensation termination period P24, a data voltage input period P25, and a data voltage input termination period P26. Note that the threshold voltage compensation period P23 and the threshold voltage compensation termination period P24 correspond to the threshold voltage compensation period described above, for example. In addition, the threshold voltage compensation termination period P24, the data voltage input period P25, and the data voltage input termination period P26 correspond to the data voltage writing period described above, for example.

The timing chart of FIG. 23B is an example of variation in each voltage of the current supply line PL, the cathode line CL, the node $N_G$, and the node $N_S$ in the above-described periods. In FIG. 23B, the voltage-level relationship between $V_{P\text{-}EMI}$, $V_{DATA}$, $V_{CS}$, $V_{G\text{-}INI}$, and $V_{P\text{-}INI}$ for the wirings and nodes is shown, where a vertical axis indicates voltage. FIG. 23B also shows $V_{TH}$ denoting the threshold voltage of the transistor 102, a voltage $V_{CP}$ held by each electrode of the capacitor 103, and a voltage $V_{EL}$ applied to each electrode of the light-emitting element 104. In addition, the ON/OFF state of the switch 101 is also shown in FIG. 23B. Note that the transistor 102 is assumed to be normally on, that is, the threshold voltage $V_{TH}$ is assumed to be negative in FIG. 23B, and the pixel is operated with no problems when the transistor 102 is either normally on or normally off.

Figure 24A:
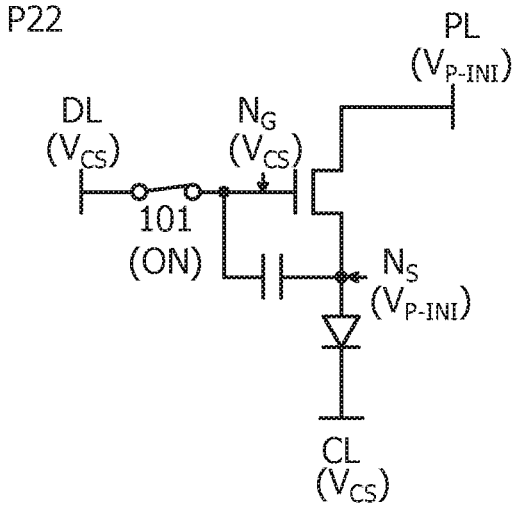
FIGS. 24A and 24B are circuit diagrams illustrating one embodiment of the present invention.

First, in the initialization period P22, the voltage of each wiring and node that has been held in the emission period P21 before the initialization period P22 is initialized. The voltage of the data line DL is $V_{CS}$, which is a different point of the initialization period P12 from the initialization period P22. The node $N_G$ is $V_{CS}$. The voltage of the current supply line PL is $V_{P\text{-}INI}$. $V_{CS}$ is larger than $V_{P\text{-}INI}$. As a result, the transistor 102 is turned on, and the voltage of the node $N_S$ is lowered to have $V_{P\text{-}INI}$. FIG. 24A shows each voltage of the wirings and nodes in the initialization period P22.

Figure 24B:
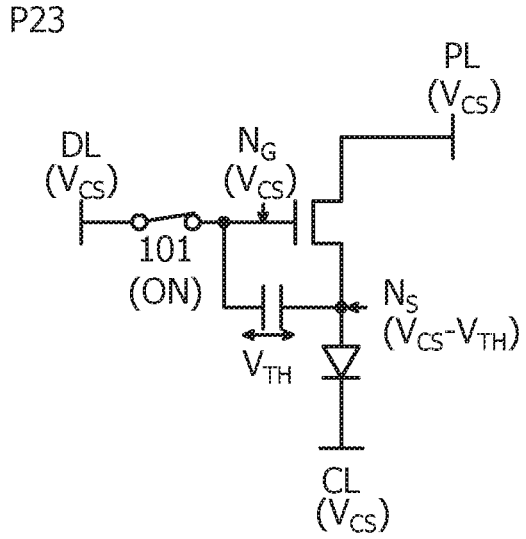

In the threshold voltage compensation period P23 that follows thereafter, current is supplied into the transistor 102 to increase the voltage of the node $N_S$, thereby holding $V_{TH}$ at each electrode of the capacitor 103. The voltage of the data line DL is $V_{CS}$, which is a different point of the threshold voltage compensation period P23 from the threshold voltage compensation period P13. The node $N_G$ is $V_{CS}$. The voltage of the current supply line PL is $V_{CS}$, thereby increasing the voltage of the node $N_S$. The voltage of the node $N_S$ keeps increasing until $V_{GS}$ of the transistor 102 becomes $V_{TH}$ and accordingly the current flowing through the transistor 102 is gradually decreased and finally stopped. In other words, the voltage of the node $N_S$ becomes the voltage ($V_{CS}$–$V_{TH}$). Note that in FIG. 23B, the increase in the voltage of the node $N_S$ is stopped when the voltage of the node $N_S$ reaches a voltage lower than the voltage of the node $N_G$ by $V_{TH}$. This is because the transistor 102 is normally off. Each voltage of the wirings and nodes in the threshold voltage compensation period P23 is shown in FIG. 24B.

Figure 25A:
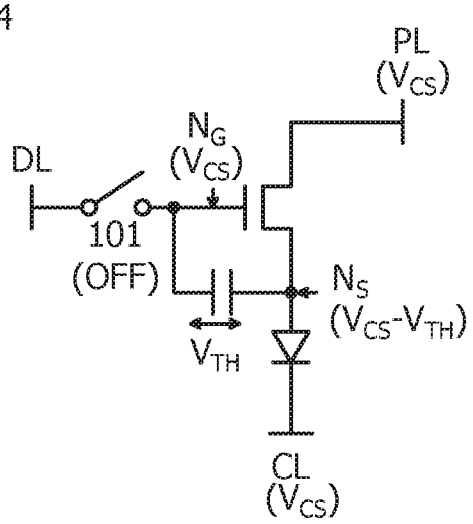
FIGS. 25A and 25B are circuit diagrams illustrating one embodiment of the present invention.

In the threshold voltage compensation termination period P24 that follows thereafter, the voltage of the current supply line PL is $V_{CS}$ and the switch 101 is turned off. The operation in the threshold voltage compensation termination period P24 is the same as that in the threshold voltage compensation termination period P14. Each voltage of the wirings and nodes in the threshold voltage compensation termination period P24 is shown in FIG. 25A.

Figure 25B:
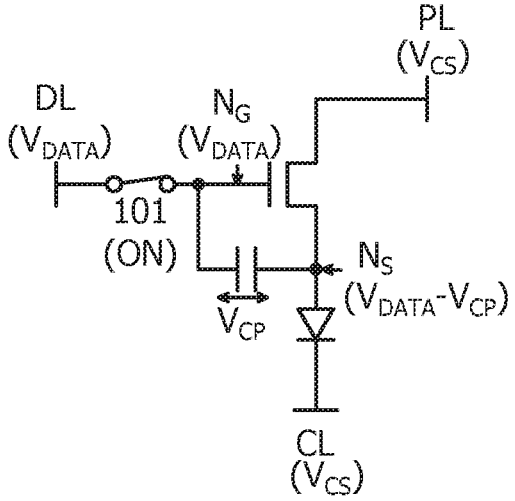

In the next period, the data voltage input period P25, the voltage of the data line DL is $V_{DATA}$ and the switch 101 is turned on. The voltage of the node $N_G$ is thus changed from $V_{CS}$ to $V_{DATA}$. The operation in the data voltage input period P25 is the same as that in the data voltage input period P15. Note that the increase in the voltage of the node $N_S$ in FIG. 23B is smaller than that in FIG. 1B, and the voltage of the node $N_S$ does not exceed $V_{CP}$. This is because the transistor 102 is normally off. In such a case that the voltage of the node $N_S$ is increased, there is no emission from the light-emitting element 104. Each voltage of the wirings and nodes in the data voltage input period P25 is shown in FIG. 25B.

Figure 26A:
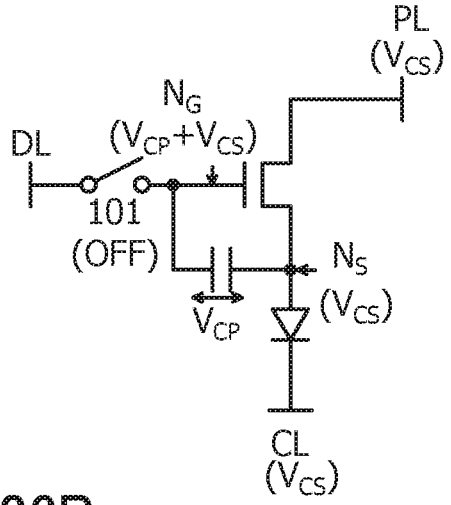
FIGS. 26A and 26B are circuit diagrams illustrating one embodiment of the present invention.

In the next period, the data voltage input termination period P26, the switch 101 is turned off. The operation in the data voltage input termination period P26 is the same as that in the data voltage input termination period P16. Each potential of the wirings and nodes in the data voltage input termination period P26 is shown in FIG. 26A.

Figure 26B:
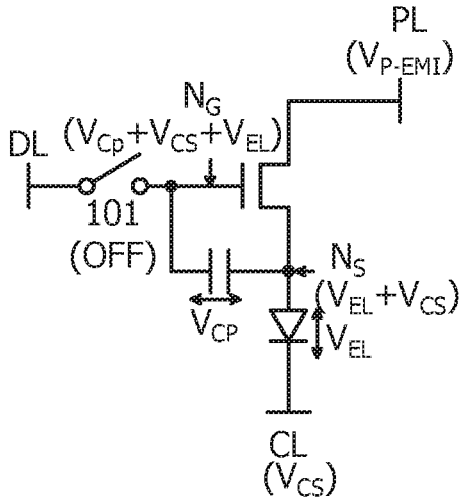

In the next period, the emission period P21, the voltage of the current supply line PL is $V_{P\text{-}EMI}$. The operation in the emission period P21 is the same as that in the emission period P11. Each potential of the wirings and nodes in the emission period P21 is shown in FIG. 26B.

In the above-described structure of one embodiment of the present invention, time for acquiring threshold voltage can be longer regardless of positive and negative of the threshold voltage of the transistor 102. In addition, an increase in the voltage of the node $N_S$, which is provided on the anode side of the light-emitting element, is suppressed to prevent undesired emission in the data voltage writing period.

Note that the pixel operation described above is shown in FIG. 27 where the initialization period and the threshold voltage acquiring period are denoted by a period $P_{VTH}$, the data voltage writing period is denoted by a period $P_{DATA}$, and the emission period is denoted by a period $P_{EL}$.

Figure 27:
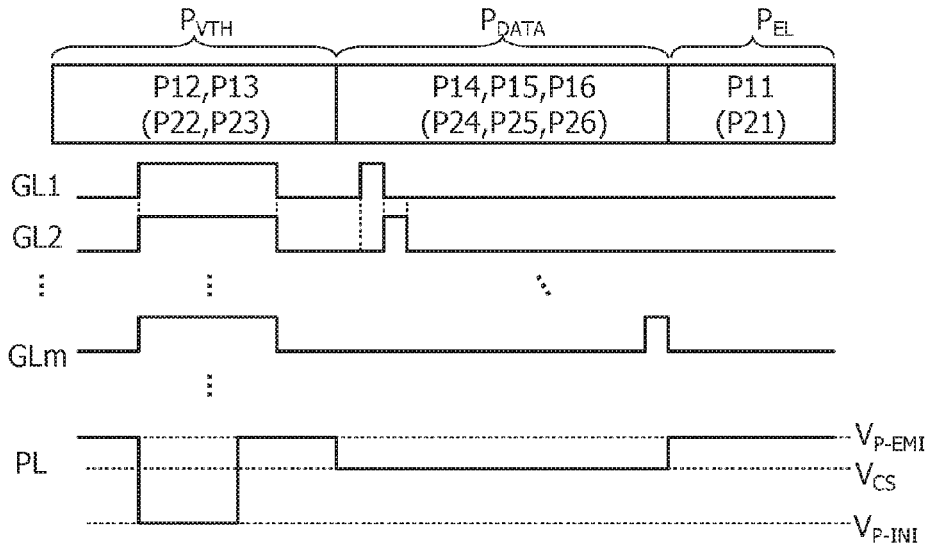
FIG. 27 is a timing chart illustrating one embodiment of the present invention.

The period $P_{VTH}$ in FIG. 27 corresponds to P12 and P13 in FIG. 1B (P22 and P23 in FIG. 23B), the period $P_{DATA}$ in FIG. 27 corresponds to P14, P15, and P16 in FIG. 1B (P24, P25, and P26 in FIG. 23B), and the period $P_{EL}$ in FIG. 27 corresponds to P11 in FIG. 1B (P21 in FIG. 23B).

FIG. 27 shows waveforms of the gate lines GL1 to GLm to which a signal for controlling the switch 100 is applied and a change in the voltage of the current supply line PL. As shown in FIG. 27, the gate lines GL1 to GLm are selected at the same time in the period $P_{DATA}$. After a certain period of time, the gate lines GL1 to GLm are selected row by row. In other words, the threshold voltage compensation termination period P14 and the data voltage input termination period P16 are provided before and after the data voltage input period P15 in each row. Therefore, the length of the threshold voltage compensation termination period P14 and that of the data voltage input termination period P16 differ depending on the rows. In the period $P_{EL}$, emission from the light-emitting element is obtained.

Figure 28:
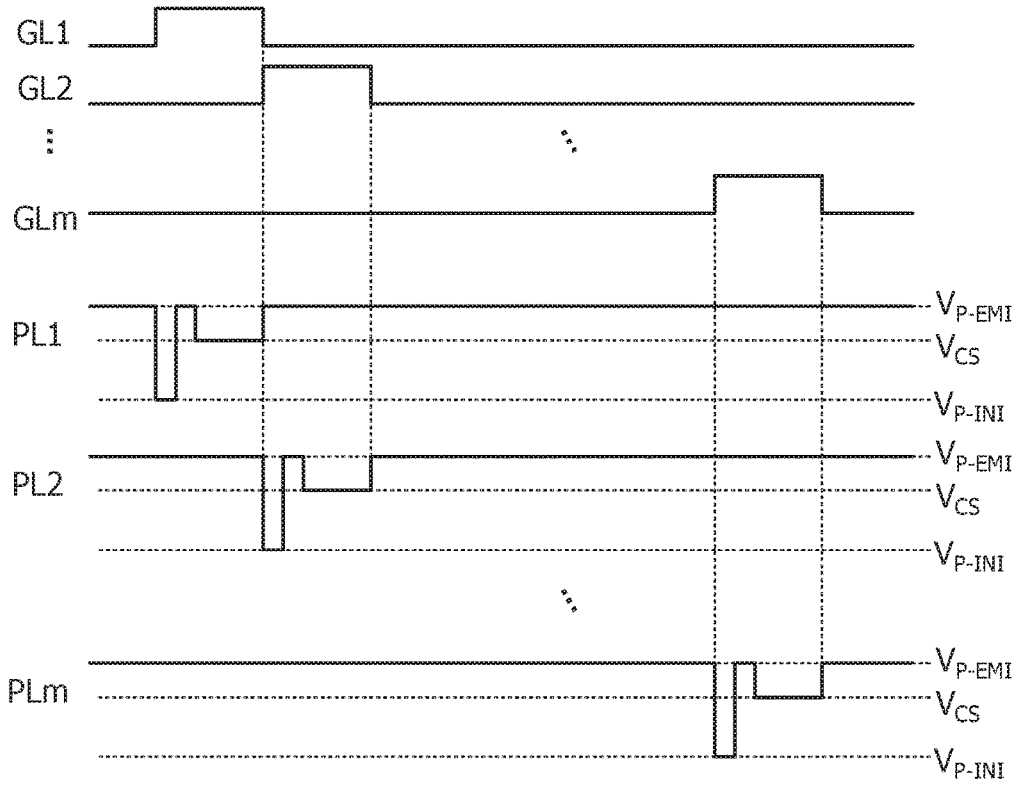
FIG. 28 is a timing chart illustrating one embodiment of the present invention.

Note that the initialization period P12 and the threshold voltage compensation period P13 may be provided in each row as shown in FIG. 28. The operation in that case corresponds to FIGS. 19A and 19B and FIG. 20.

One embodiment of the present invention has been described in this embodiment. Other modes of the present invention will be described in embodiments below. Note that one embodiment of the present invention is not limited to them. That is, since various embodiments of the present invention are disclosed in this embodiment and other embodiments, one embodiment of the present invention is not limited to a specific embodiment. For example, the case where the influence of the variation in threshold voltage of a transistor is reduced has been described in this embodiment, one embodiment of the present invention is not limited thereto. Depending on circumstances or conditions, one embodiment of the present invention may compensate variation in other characteristics. Depending on circumstances or conditions, one embodiment of the present invention does not necessarily compensate variation in threshold voltage of a transistor.

Embodiment 2

In this embodiment, a transistor in which an oxide semiconductor film is used for a channel formation region (OS transistor) and a transistor whose channel formation region is composed of silicon (Si transistor) are described as examples of the transistor in the pixel described in the above embodiment.

Structure Example 1 of Transistor

Next, a transistor in which an oxide semiconductor film is used for a channel formation region, i.e., OS transistor is described.

Figure 29A:
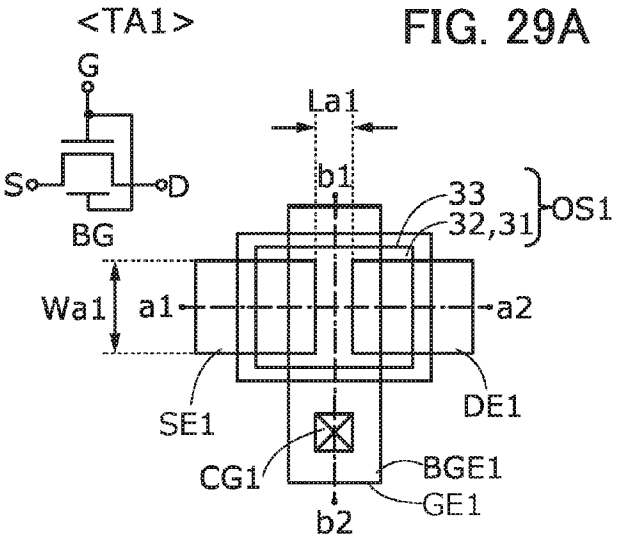
FIGS. 29A to 29C are top views illustrating one embodiment of the present invention.
Figure 29B:
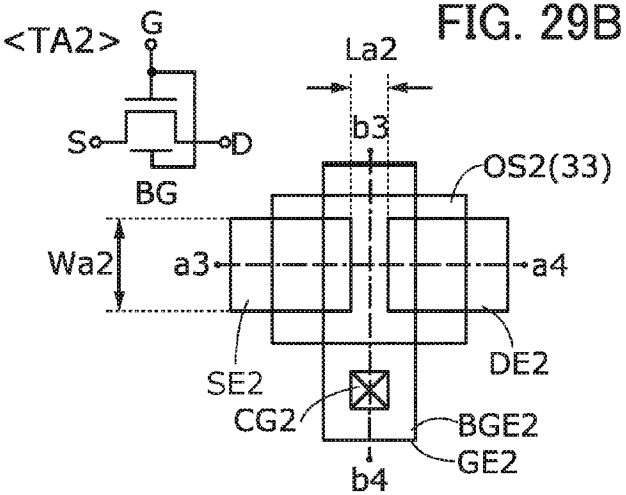
Figure 29C:
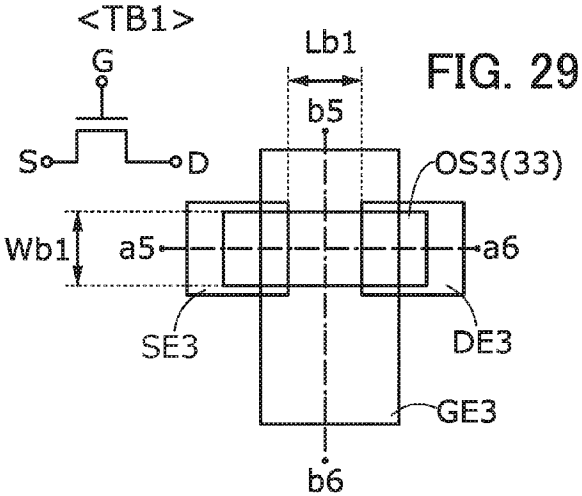
Figure 30A:
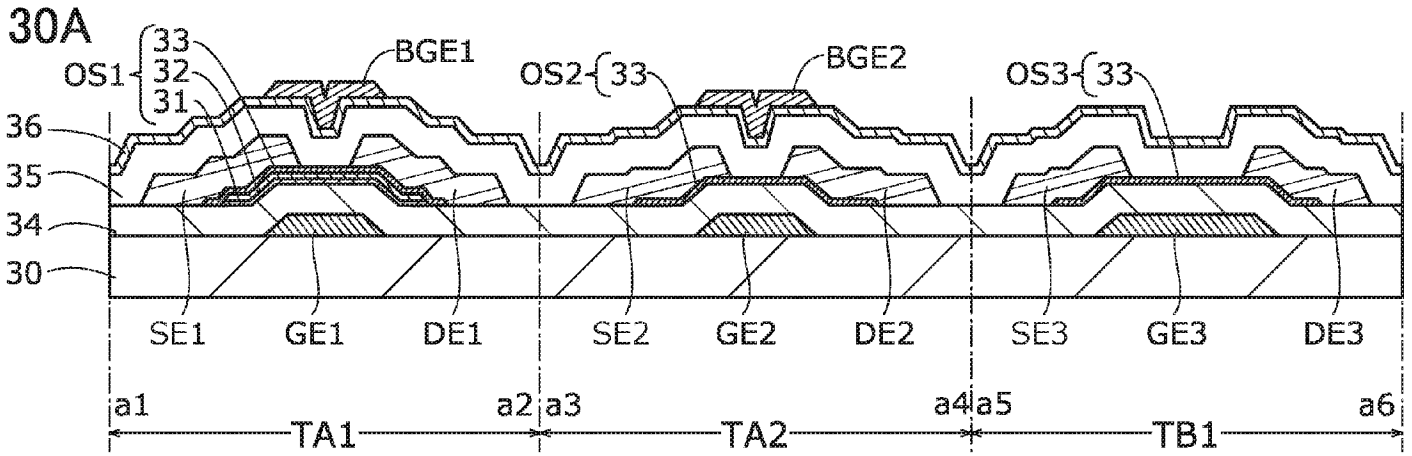
FIGS. 30A and 30B are cross-sectional views illustrating one embodiment of the present invention.
Figure 30B:
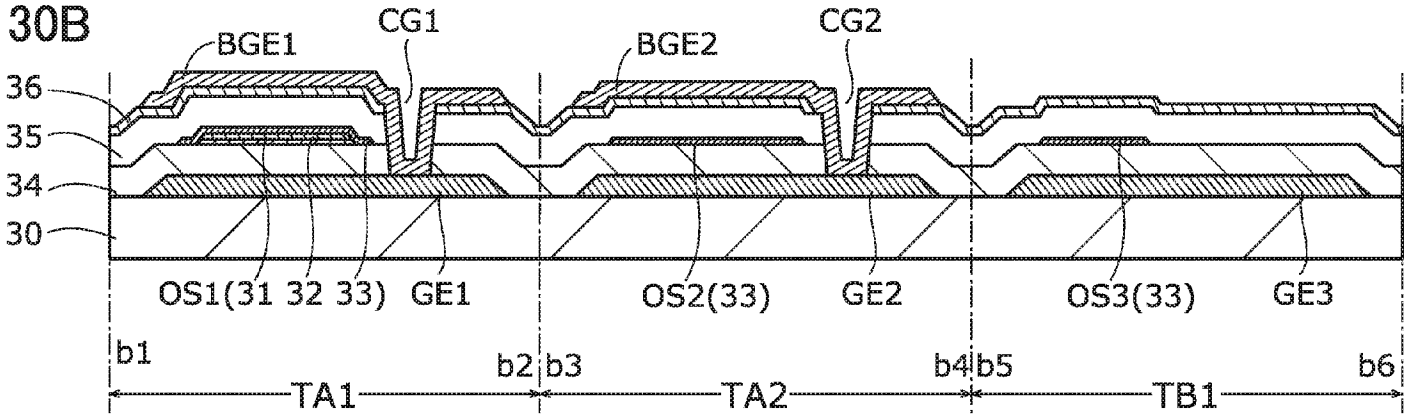

FIGS. 29A, 29B, and 29C respectively show top views (layouts) and circuit symbols of transistors TA1, TA2, and TB1 with different device structures. FIGS. 30A and 30B are cross-sectional views of the transistors TA1 along line a1-a2 and b1-b2, TA2 along line a3-a4 and b3-b4, and TB1 along line a5-a6 and b5-b6. FIGS. 30A and 30B show cross-sectional structures of the transistors in the channel length direction and the channel width direction, respectively.

As shown in FIGS. 30A and 30B, the transistors TA1, TA2, and TB1 are formed over the same insulating surface and can be formed in the same process. Note that for clarity of the device structures, a wiring for supplying a potential or power to a gate (G), a source (S), and a drain (D) of each transistor is not shown.

The transistor TA in FIG. 29A and the transistor TA2 in FIG. 29B each include a gate (G) and a backgate (BG). One of the gate and the backgate corresponds to a first gate and the other corresponds to a second gate. The backgate of each of the transistors TA1 and TA2 is connected to the gate. In contrast, the transistor TB1 in FIG. 29C does not include a backgate. As shown in FIGS. 30A and 30B, these transistors TA1, TA2, and TB1 are formed over a substrate 30. The structures of the transistors will be described with reference to FIGS. 29A to 29C and FIGS. 30A and 30B.

(Transistor TA1)

The transistor TA1 includes a gate electrode GE1, a source electrode SE1, a drain electrode DE1, a backgate electrode BGE1, and an oxide semiconductor film OS1.

In the description below, elements and components of the elements may be abbreviated; for example, the transistor TA1 is referred to as TA1, the backgate is BG, the oxide semiconductor film OS1 is OS1 or a film OS1. Potentials, signals, circuits, and the like may also be similarly abbreviated.

The channel length of an OS transistor corresponds to the distance between a source electrode and a drain electrode in this embodiment. The channel width of the OS transistor corresponds to the length of the source electrode or the drain electrode in a region where an oxide semiconductor film and a gate electrode overlap with each other. The channel length and the channel width of the transistor TA1 are represented by La1 and Wa1, respectively.

A film OS1 overlaps an electrode GE1 with an insulating film 34 provided therebetween. A pair of electrodes (SE1 and DE1) is formed in contact with the upper surface and the side surfaces of the film OS1. As shown in FIG. 29A, the film OS1 includes a region overlapping with neither the electrode GE1 nor the pair of electrodes (SE1 and DE1). The length in the channel length direction of the film OS1 is longer than the channel length La1 and the length in the channel width direction is longer than the channel width Wa1.

An insulating film 35 is formed to cover the film OS1, the electrodes GE1, SE1, and DE1. The electrode BGE1 is formed over the insulating film 35. The electrode BGE1 overlaps the film OS1 and the electrode GE1. Here, the electrode BGE1 has the same shape as the electrode GE1 and is located in the same position as the electrode GE1. The electrode BGE1 is in contact with the electrode GE1 through an opening CG1 in the insulating films 34, 35 and 36. With this structure, the gate is electrically connected to the backgate of the transistor TA1.

The backgate electrode BGE1 is connected to the gate electrode GE1, so that the on-state current of the transistor TA1 can be increased. The strength of the transistor TA1 can be increased with the backgate BGE1. When the substrate 30 is deformed like bending, the electrode BGE1 serves as a reinforcement member to prevent the transistor TA1 from being broken.

The film OS1 including a channel formation region has a multilayer structure; here, three oxide semiconductor films 31, 32, and 33 are stacked as an example. The oxide semiconductor films forming the film OS1 are preferably metal oxide films containing at least one metal element that is the same, more preferably containing In. As metal oxide containing In which can be used as the semiconductor film of the transistor, an In—Ga oxide film and an In-M-Zn oxide film (M is Al, Ga, Y, Zr, La, Ce, or Nd) are typical examples. Another element or material may be added to these metal oxide films.

The film "32" includes a channel formation region of the transistor TA1. The film "33" also includes a channel formation region of the transistor TA2 and TB1, which are described later. An oxide semiconductor film with an appropriate composition may be used depending on electrical characteristics (e.g., field-effect mobility and threshold voltage) required of the transistors TA2 and TB1. For example, the composition of metal elements contained as main components in the oxide semiconductor films 31 and 32 is preferably adjusted so that a channel is formed in "33".

Since a channel is formed in "32" of the transistor TA1, the channel formation region is not in contact with the insulating films 34 and 35. When the oxide semiconductor films 31 and 32 are metal oxide films containing at least one common metal element, interface scattering is unlikely to occur at the interface between "32" and "31" and the interface between "32" and "33". The field-effect mobility of the transistor TA1 can be thus higher than those of the transistor TA2 and TB1, and in addition, the drain current in an on-state (on-state current) can be increased.

[Transistor TA2]

The transistor TA2 includes a gate electrode GE2, a source electrode SE2, a drain electrode DE2, a backgate electrode BGE2, and an oxide semiconductor film OS2. The electrode BGE2 is in contact with the electrode GE2 through an opening CG2 formed in the insulating films 34 to 36. The transistor TA2 is a modification example of the transistor TA1; unlike in the transistor TA1, the film OS2 of the transistor TA2 is a single layer of the oxide semiconductor film 33, and other points are the same. A channel length La2 and a channel width Wa2 of the transistor TA2 are equal to the channel length La1 and the channel width Wa1 of the transistor TA1, respectively.

[Transistor TB1]

The transistor TB1 includes a gate electrode GE3, a source electrode SE3, a drain electrode DE3, and an oxide semiconductor film OS3. The transistor TB1 is a modification example of the transistor TA2. Like in the transistor TA2, a film OS3 of the transistor TB1 is formed with a single-layer structure of the oxide semiconductor film 33. Unlike the transistor TA2, the transistor TB1 does not include a backgate electrode. In addition, the layout of the film OS3 and the electrodes GE3, SE3, and DE3 is different. As shown in FIG. 29C, regions of the film OS3 not overlapping with the electrode GE3 overlap with the electrode SE3 or DE3. A channel width Wb1 of the transistor TB1 is thus determined by the width of the film OS3. A channel length Lb1 is determined by the distance between the electrodes SE3 and DE3 like in the transistor TA2, and is longer than the channel length La2 of the transistor TA2.

[Insulating Film]

The insulating films 34, 35, and 36 are formed over the entire regions over the substrate 30 where the transistors TA1, TA2, and TB1 are formed. Each of the insulating films 34, 35, and 36 is a single film or multilayer film. The insulating film 34 serves as a gate insulating film of the transistors TA1, TA2, and TB1. The insulating films 35 and 36 each serve as a gate insulating film on the backchannel side of the transistors TA1, TA2, and TB1. The insulating film 36, which is the uppermost film, is preferably formed using a material that allows it to serve as a protective film of a transistor over the substrate 30. The insulating film 36 is provided if necessary. In order to insulate the electrode BGE1 in the third layer from the electrodes SE1 and DE1 in the second layer, at least one insulating film is formed therebetween.

The insulating films 34 to 36 can be formed with a single layer of insulating film or a multilayer of two or more insulating films. Examples of the insulating film used for the insulating films 34 to 36 include an aluminum oxide film, a magnesium oxide film, a silicon oxide film, a silicon oxynitride film, a silicon nitride oxide film, a silicon nitride film, a gallium oxide film, a germanium oxide film, a yttrium oxide film, a zirconium oxide film, a lanthanum oxide film, a neodymium oxide film, a hafnium oxide film, and a tantalum oxide film. These insulating films can be formed by a sputtering method, a CVD method, an MBE method, an ALD method, or a PLD method.

[Oxide Semiconductor Film]

In this embodiment, an oxide semiconductor film used for a semiconductor film of an OS transistor is described. In the case where the semiconductor film is multilayer like the film OS1, the oxide semiconductor films forming the multilayer semiconductor film are preferably metal oxide films containing at least one metal element that is the same, more preferably containing In.

When "31" is an In—Ga oxide film, for example, the atomic proportion of In is set smaller than that of Ga. When "31" is an In-M-Zn oxide film (M is Al, Ga, Y, Zr, La, Ce, or Nd), the atomic proportion of In is set smaller than the atomic proportion of M, and the atomic proportion of Zn can be the largest among the three.

When "32" is an In—Ga oxide film, for example, the atomic proportion of In is set larger than the atomic proportion of Ga. When "32" is an In-M-Zn oxide film, the atomic proportion of In is set larger than the atomic proportion of M. In the case of an In-M-Zn oxide film, the atomic proportion of In is preferably larger than the atomic proportions of M and Zn.

When "33" is an In—Ga oxide film, for example, the atomic proportion of In is set equal to or smaller than the atomic proportion of Ga. When "33" is an In-M-Zn oxide film, the atomic proportion of In is set equal to the atomic proportion of M, and the atomic proportion of Zn can be larger than those of In and M Here, "33" is also a film including channel formation regions of the transistors TA2 and TB1 described later.

When the oxide semiconductor films 31 to 33 are formed by sputtering, the atomic proportions of the films can be adjusted by adjusting the atomic proportions or the like of the target compositions. When the oxide semiconductor films 31 to 33 are formed by CVD, the atomic proportions of the films can be adjusted by adjusting the flow rates of source gases or the like. A deposition target for forming In-M-Zn oxide films by sputtering as the oxide semiconductor films 31 to 33 will be described below as an example. In order to form these films, an In-M-Zn oxide target is used.

When the atomic proportion of metal elements of a target for "31" is In:M:Zn=$x_1$:$y_1$:$z_1$, $x_1/y_1$ is preferably greater than or equal to ⅙ and less than 1; $z_1/y_1$ is greater than or equal to ⅓ and less than or equal to 6, preferably greater than or equal to 1 and less than or equal to 6.

Typical examples of the atomic ratio of the metal elements of the target are In:M:Zn=1:3:2, In:M:Zn=1:3:4, In:M:Zn=1:3:6, In:M:Zn=1:3:8, In:M:Zn=1:4:4, In:M:Zn=1:4:5, In:M:Zn=1:4:6, In:M:Zn=1:4:7, In:M:Zn=1:4:8, In:M:Zn=1:5:5, In:M:Zn=1:5:6, In:M:Zn=1:5:7, In:M:Zn=1:5:8, In:M:Zn=1:6:8, and the like.

When the atomic proportion of metal elements of a target for "32" is In:M:Zn=$x_2$:$y_2$:$z_2$, $x_2/y_2$ is preferably greater than 1 and less than or equal to 6; $z_2/y_2$ is greater than 1 and less than or equal to 6. Typical examples of the atomic ratio of the metal elements of the target are In:M:Zn=2:1:1.5, 2:1:2.3, 2:1:3, 3:1:2, 3:1:3, 3:1:4, or the like.

When the atomic proportion of metal elements of a target for "33" is In:M:Zn=$x_3$:$y_3$:$z_3$, $x_3/y_3$ is preferably greater than or equal to ⅙ and less than or equal to 1; $z_3/y_3$ is greater than or equal to ⅓ and less than or equal to 6, more preferably greater than or equal to 1 and less than or equal to 6. Typical examples of the atomic ratio of the metal elements of the target are In:M:Zn=1:1:1, 1:1:1.2, 1:3:2, 1:3:4, 1:3:6, 1:3:8, 1:4:4, 1:4:5, 1:4:6, 1:4:7, 1:4:8, 1:5:5, 1:5:6, 1:5:7, 1:5:8, 1:6:8, or the like.

When the atomic ratio of metal elements of an In-M-Zn oxide deposition target is In:M:Zn=x:y:z, $1 \leq z/y \leq 6$ is preferably satisfied because a CAAC-OS film is easily formed as an In-M-Zn oxide film. Note that the CAAC-OS film is described later.

Oxide semiconductor films with low carrier density are used as the oxide semiconductor films 31 to 33. For example, an oxide semiconductor film whose carrier density is $1\times10^{17}/cm^3$ or lower, preferably $1\times10^{15}/cm^3$ or lower, more preferably $1\times10^{13}/cm^3$ or lower, particularly preferably lower than $8\times10^{11}/cm^3$, still further preferably lower than $1\times10^{11}/cm^3$, yet further preferably lower than $1\times10^{10}/cm^3$, and is $1\times10^{-9}/cm^3$ or higher is used as the oxide semiconductor films 31 to 33.

Note that it is preferable to use, as the oxide semiconductor films 31 to 33, an oxide semiconductor film in which the impurity concentration is low and density of defect states is low, in which case the transistor can have more excellent electrical characteristics. Here, the state in which impurity concentration is low and density of defect states is low (the number of oxygen vacancies is small) is referred to as "highly purified intrinsic" or "substantially highly purified intrinsic". A highly purified intrinsic or substantially highly purified intrinsic oxide semiconductor has few carrier generation sources, and thus has a low carrier density in some cases. Thus, in some cases, a transistor including the oxide semiconductor film in which a channel region is formed rarely has a negative threshold voltage (is rarely normally-on). A highly purified intrinsic or substantially highly purified intrinsic oxide semiconductor film has a low density of defect states and accordingly has a low density of trap states in some cases. Further, the highly purified intrinsic or substantially highly purified intrinsic oxide semiconductor film has an extremely low off-state current; even when an element has a channel width of $1\times10^6$ μm and a channel length (L) of 10 μm, the off-state current can be less than or equal to the measurement limit of a semiconductor parameter analyzer, i.e., less than or equal to $1\times10^{-13}$ A, at a voltage (drain voltage) between a source electrode and a drain electrode of from 1 V to 10 V. Thus, the transistor whose channel region is formed in the oxide semiconductor film has a small variation in electrical characteristics and high reliability in some cases. As examples of the impurities, hydrogen, nitrogen, alkali metal, alkaline earth metal, and the like are given.

Hydrogen contained in the oxide semiconductor film reacts with oxygen bonded to a metal atom to be water, and in addition, an oxygen vacancy is formed in a lattice from which oxygen is released (or a portion from which oxygen is released). Due to entry of hydrogen into the oxygen vacancy, an electron serving as a carrier is generated. In some cases, bonding of part of hydrogen to oxygen bonded to a metal atom causes generation of an electron serving as a carrier. Thus, a transistor including a hydrogen-containing oxide semiconductor is likely to be normally on.

It is thus preferable that hydrogen be reduced as much as possible as well as the oxygen vacancies in the oxide semiconductor films 31 to 33. Specifically, in the oxide semiconductor films 31 to 33, the concentration of hydrogen which is measured by secondary ion mass spectrometry (SIMS) is set to lower than or equal to $5\times10^{19}$ atoms/cm$^3$, preferably lower than or equal to $1\times10^{19}$ atoms/cm$^3$, preferably lower than $5\times10^{18}$ atoms/cm$^3$, preferably $1\times10^{18}$ atoms/cm$^3$ or lower, more preferably $5\times10^{17}$ atoms/cm$^3$ or lower, still more preferably $1\times10^{16}$ atoms/cm$^3$ or lower.

When the oxide semiconductor films 31 to 33 contain silicon or carbon, which is an element belonging to Group 14, oxygen vacancies in the films are increased, so that the films have n-type conductivity. For this reason, the concentration of silicon or carbon (the concentration is measured by SIMS) of each of the oxide semiconductor films 31 to 33 is set lower than or equal to $2\times10^{18}$ atoms/cm$^3$, preferably lower than or equal to $2\times10^{17}$ atoms/cm$^3$.

The concentration of alkali metal or alkaline earth metal in the oxide semiconductor films 31 to 33, which is measured by SIMS, is set to be lower than or equal to $1\times10^{18}$ atoms/cm$^3$, preferably lower than or equal to $2\times10^{16}$ atoms/cm$^3$. Alkali metal and alkaline earth metal might generate carriers when bonded to an oxide semiconductor, in which case the off-state current of the transistor might be increased. Therefore, it is preferable to reduce the concentration of alkali metal or alkaline earth metal of each of the oxide semiconductor films 31 to 33.

When containing nitrogen, the oxide semiconductor films 31 to 33 easily have an n-type region by generation of electrons serving as carriers and an increase of carrier density. Thus, a transistor including an oxide semiconductor which contains nitrogen is likely to be normally on, and the content of nitrogen in the oxide semiconductor films 31 to 33 is preferably reduced as much as possible. For example, the nitrogen concentration which is measured by SIMS is preferably set, for example, lower than or equal to $5\times10^{18}$ atoms/cm$^3$.

Without limitation to the oxide semiconductor films 31 to 33 described above, other oxide semiconductor films with appropriate compositions can be used depending on required semiconductor characteristics and electrical characteristics (e.g., field-effect mobility and threshold voltage) of transistors. To obtain the required semiconductor characteristics and electrical characteristics of the transistor, it is preferable that the carrier density, the impurity concentration, the defect density, the atomic ratio of metal elements and oxygen, the interatomic distance, the density, and the like of the oxide semiconductor films 31 to 33 be set to appropriate values.

The field-effect mobility of the transistor TA1 can be increased because a channel is formed in the oxide semiconductor film 32 in which the atomic proportion of In is larger than the atomic proportion of Ga or M (M is Al, Ga, Y, Zr, La, Ce, or Nd). For example, the field-effect mobility is higher than 10 cm$^2$/Vs and lower than 60 cm$^2$/Vs, preferably 15 cm$^2$/Vs or higher and lower than 50 cm$^2$/Vs. The transistor TA1 is thus preferably used in a driver circuit which needs to operate at high speed in an active matrix display device.

The transistor TA1 is preferably provided in a shielded region. Furthermore, the driving frequency of a driver circuit including the transistor TA1 with high field-effect mobility can be increased, so that a display device with higher definition is achieved.

The field-effect mobility of the transistors TA2 and TB1 in which a channel formation region is formed in the oxide semiconductor film 33 is approximately 3 cm$^2$/Vs or higher and 10 cm$^2$/Vs or lower, which is lower than that of the transistor TA1. Because the transistors TA2 and TB1 do not include the oxide semiconductor film 32, they are less degraded by light than the transistor TA1 and thus the amount of off-state current increased by light irradiation is small. For this reason, the transistors TA2 and TB1 in which a channel formation region is formed in the oxide semiconductor film 33 are preferably used for a pixel portion, which is irradiated with light.

The amount of off-state current increased by light irradiation is likely to be large in the transistor TA1 as compared to the transistor TA2 not including the oxide semiconductor film 32. This is a reason why the transistor TA1 is suitable for a peripheral driver circuit, which is less influenced by light than a pixel portion, which cannot be sufficiently shielded from light. Needless to say, a transistor like the transistors TA2 and TB1 can be provided in a driver circuit.

The structures of transistors and oxide semiconductor films are not limited to those of the transistors TA1, TA2, and TB1 and the oxide semiconductor films 31 to 33 described above, and the structure of the transistor can be changed depending on the required semiconductor characteristics and electrical characteristics of the transistor. For example, the presence or absence of a backgate electrode, a stacked-layer structure of an oxide semiconductor film, the shapes and positions of an oxide semiconductor film, a gate electrode, and source and drain electrodes, and the like can be appropriately changed.

[Structure of Oxide Semiconductor]

A structure of an oxide semiconductor is described below.

In this specification, the term "parallel" indicates that the angle formed between two straight lines is greater than or equal to −10° and less than or equal to 10°, and thus also includes the case where the angle is greater than or equal to −5° and less than or equal to 5°. The term "substantially parallel" indicates that the angle formed between two straight lines is greater than or equal to −30° and less than or equal to 30°. The term "perpendicular" indicates that the angle formed between two straight lines is greater than or equal to 80° and less than or equal to 100°, and accordingly includes the case where the angle is greater than or equal to 85° and less than or equal to 95°. A term "substantially perpendicular" indicates that the angle formed between two straight lines is greater than or equal to 60° and less than or equal to 120°.

In this specification, trigonal and rhombohedral crystal systems are included in a hexagonal crystal system.

An oxide semiconductor film is classified into, for example, a non-single-crystal oxide semiconductor film and a single crystal oxide semiconductor film or into a crystalline oxide semiconductor and an amorphous oxide semiconductor.

Examples of a non-single-crystal oxide semiconductor include a c-axis aligned crystalline oxide semiconductor (CAAC-OS), a polycrystalline oxide semiconductor, a microcrystalline oxide semiconductor, and an amorphous oxide semiconductor. Examples of a crystalline oxide semiconductor include a single crystal oxide semiconductor, a CAAC-OS, a polycrystalline oxide semiconductor, and a microcrystalline oxide semiconductor.

First, a CAAC-OS film is described.

The CAAC-OS film is one of oxide semiconductor films having a plurality of c-axis aligned crystal parts.

With a transmission electron microscope (TEM), a combined analysis image (also referred to as a high-resolution TEM image) of a bright-field image and a diffraction pattern of the CAAC-OS film is observed. Consequently, a plurality of crystal parts are observed clearly. However, in the high-resolution TEM image, a boundary between crystal parts, that is, a grain boundary is not clearly observed. Thus, in the CAAC-OS film, a reduction in electron mobility due to the grain boundary is less likely to occur.

From the high-resolution cross-sectional TEM image of the CAAC-OS film observed in a direction substantially parallel to a sample surface, metal atoms are arranged in a layered manner in the crystal parts. Each metal atom layer has a morphology reflecting a surface over which the CAAC-OS film is formed (hereinafter, a surface over which the CAAC-OS film is formed is referred to as a formation surface) or a top surface of the CAAC-OS film, and is arranged to be parallel to the formation surface or the top surface of the CAAC-OS film.

On the other hand, from the high-resolution planar TEM image of the CAAC-OS film observed in a direction substantially perpendicular to the sample surface, metal atoms are arranged in a triangular or hexagonal configuration in the crystal parts. However, there is no regularity of arrangement of metal atoms between different crystal parts.

A CAAC-OS film is subjected to structural analysis with an X-ray diffraction (XRD) apparatus. When the CAAC-OS film including an $InGaZnO_4$ crystal is analyzed by an out-of-plane method, for example, a peak appears frequently when the diffraction angle (2θ) is around 31°. This peak is derived from the (009) plane of the $InGaZnO_4$ crystal, which indicates that crystals in the CAAC-OS film have c-axis alignment, and that the c-axes are aligned in a direction substantially perpendicular to the formation surface or the top surface of the CAAC-OS film.

Note that when the CAAC-OS film with an $InGaZnO_4$ crystal is analyzed by an out-of-plane method, a peak of 2θ may also be observed at around 36°, in addition to the peak of 2θ at around 31°. The peak of 2θ at around 36° indicates that a crystal having no c-axis alignment is included in part of the CAAC-OS film. It is preferable that in the CAAC-OS film, a peak of 2θ appear at around 31° and a peak of 2θ not appear at around 36°.

The CAAC-OS film is an oxide semiconductor film having low impurity concentration. The impurity is an element other than the main components of the oxide semiconductor film, such as hydrogen, carbon, silicon, or a transition metal element. In particular, an element that has higher bonding strength to oxygen than a metal element included in the oxide semiconductor film, such as silicon, disturbs the atomic arrangement of the oxide semiconductor film by depriving the oxide semiconductor film of oxygen and causes a decrease in crystallinity. Further, a heavy metal such as iron or nickel, argon, carbon dioxide, or the like has a large atomic radius (molecular radius), and thus disturbs the atomic arrangement of the oxide semiconductor film and causes a decrease in crystallinity when it is contained in the oxide semiconductor film. Note that the impurity contained in the oxide semiconductor film might serve as a carrier trap or a carrier generation source.

The CAAC-OS film is an oxide semiconductor film having a low density of defect states. In some cases, oxygen vacancies in the oxide semiconductor film serve as carrier traps or serve as carrier generation sources when hydrogen is captured therein.

The state in which impurity concentration is low and density of defect states is low (the number of oxygen vacancies is small) is referred to as a "highly purified intrinsic" or "substantially highly purified intrinsic" state. A highly purified intrinsic or substantially highly purified intrinsic oxide semiconductor film has few carrier generation sources, and thus can have a low carrier density. Thus, a transistor including the oxide semiconductor film rarely has negative threshold voltage (is rarely normally on). The highly purified intrinsic or substantially highly purified intrinsic oxide semiconductor film has a low density of defect states, and thus has few carrier traps. Accordingly, the transistor including the oxide semiconductor film has little variation in electrical characteristics and high reliability. Electric charge trapped by the carrier traps in the oxide semiconductor film takes a long time to be released, and might behave like fixed electric charge. Thus, the transistor which includes the oxide semiconductor film having high impurity concentration and a high density of defect states has unstable electrical characteristics in some cases.

With the use of the CAAC-OS film in a transistor, variation in the electrical characteristics of the transistor due to irradiation with visible light or ultraviolet light is small.

Next, a microcrystalline oxide semiconductor film is described.

A microcrystalline oxide semiconductor film has a region where a crystal part is observed in a high resolution TEM image and a region where a crystal part is not clearly observed in a high resolution TEM image. In most cases, a crystal part in the microcrystalline oxide semiconductor is greater than or equal to 1 nm and less than or equal to 100 nm, or greater than or equal to 1 nm and less than or equal to 10 nm. A microcrystal with a size greater than or equal to 1 nm and less than or equal to 10 nm, or a size greater than or equal to 1 nm and less than or equal to 3 nm is specifically referred to as nanocrystal (nc). An oxide semiconductor film including nanocrystal is referred to as an nc-OS (nanocrystalline oxide semiconductor) film. In a high resolution TEM image of the nc-OS film, a grain boundary cannot be found clearly in the nc-OS film sometimes for example.

In the nc-OS film, a microscopic region (for example, a region with a size greater than or equal to 1 nm and less than or equal to 10 nm, in particular, a region with a size greater than or equal to 1 nm and less than or equal to 3 nm) has a periodic atomic order. Note that there is no regularity of crystal orientation between different crystal parts in the nc-OS film. Thus, the orientation of the whole film is not observed. Accordingly, in some cases, the nc-OS film cannot be distinguished from an amorphous oxide semiconductor film depending on an analysis method. For example, when the nc-OS film is subjected to structural analysis by an out-of-plane method with an XRD apparatus using an X-ray having a diameter larger than the diameter of a crystal part, a peak which shows a crystal plane does not appear. A diffraction pattern like a halo pattern appears in a selected-area electron diffraction pattern of the nc-OS film obtained by using an electron beam having a probe diameter (e.g., larger than or equal to 50 nm) larger than the diameter of a crystal part. Meanwhile, spots are shown in a nanobeam electron diffraction pattern of the nc-OS film obtained by using an electron beam having a probe diameter close to, or smaller than the diameter of a crystal part. Further, in a nanobeam electron diffraction pattern of the nc-OS film, regions with high luminance in a circular (ring) pattern are shown in some cases. Also in a nanobeam electron diffraction pattern of the nc-OS film, a plurality of spots is shown in a ring-like region in some cases.

The nc-OS film is an oxide semiconductor film that has high regularity as compared to an amorphous oxide semiconductor film. Therefore, the nc-OS film has a lower density of defect states than an amorphous oxide semiconductor film. Note that there is no regularity of crystal orientation between different crystal parts in the nc-OS film; hence, the nc-OS film has a higher density of defect states than the CAAC-OS film.

Next, an amorphous oxide semiconductor film is described.

The amorphous oxide semiconductor film has disordered atomic arrangement and no crystal part. For example, the amorphous oxide semiconductor film does not have a specific state as in quartz.

In the high-resolution TEM image of the amorphous oxide semiconductor film, crystal parts cannot be found.

When the amorphous oxide semiconductor film is subjected to structural analysis by an out-of-plane method with an XRD apparatus, a peak which shows a crystal plane does not appear. A halo pattern is shown in an electron diffraction pattern of the amorphous oxide semiconductor film. Further, a halo pattern is shown but a spot is not shown in a nanobeam electron diffraction pattern of the amorphous oxide semiconductor film.

Note that an oxide semiconductor film may have a structure having physical properties between the nc-OS film and the amorphous oxide semiconductor film. The oxide semiconductor film having such a structure is specifically referred to as an amorphous-like oxide semiconductor (a-like OS) film.

In a high-resolution TEM image of the a-like OS film, a void may be seen. In the high-resolution TEM image, there are a region where a crystal part is clearly observed and a region where a crystal part is not observed. In the amorphous-like OS film, crystallization by a slight amount of electron beam used for TEM observation occurs and growth of the crystal part is found sometimes. In contrast, crystallization by a slight amount of electron beam used for TEM observation is less observed in the nc-OS film having good quality.

Note that the crystal part size in the a-like OS film and the nc-OS film can be measured using high-resolution TEM images. For example, an $InGaZnO_4$ crystal has a layered structure in which two Ga—Zn—O layers are included between In—O layers. A unit cell of the $InGaZnO_4$ crystal has a structure in which nine layers of three In—O layers and six Ga—Zn—O layers are layered in the c-axis direction. Accordingly, the spacing between these adjacent layers is equivalent to the lattice spacing on the (009) plane (also referred to as d value). The value is calculated to 0.29 nm from crystal structure analysis. Focusing on lattice fringes in the high-resolution TEM image, each of lattice fringes in which the lattice spacing therebetween is greater than or equal to 0.28 nm and less than or equal to 0.30 nm corresponds to the a-b plane of the $InGaZnO_4$ crystal.

The density of an oxide semiconductor film might vary depending on its structure. For example, if the composition of an oxide semiconductor film is determined, the structure of the oxide semiconductor film can be estimated from a comparison between the density of the oxide semiconductor film and the density of a single crystal oxide semiconductor film having the same composition as the oxide semiconductor film. For example, the density of the a-like OS film is higher than or equal to 78.6% and lower than 92.3% of the density of the single crystal oxide semiconductor having the same composition. For example, the density of each of the nc-OS film and the CAAC-OS film is higher than or equal to 92.3% and lower than 100% of the density of the single crystal oxide semiconductor having the same composition. Note that it is difficult to deposit an oxide semiconductor film whose density is lower than 78% of the density of the single crystal oxide semiconductor film.

Specific examples of the above description are given. For example, in the case of an oxide semiconductor film with an atomic ratio of In:Ga:Zn=1:1:1, the density of single-crystal $InGaZnO_4$ with a rhombohedral crystal structure is 6.357 $g/cm^3$. Thus, for example, in the case of the oxide semiconductor film with an atomic ratio of In:Ga:Zn=1:1:1, the density of an a-like OS film is higher than or equal to 5.0 $g/cm^3$ and lower than 5.9 $g/cm^3$. In addition, for example, in the case of the oxide semiconductor film with an atomic ratio of In:Ga:Zn=1:1:1, the density of an nc-OS film or a CAAC-OS film is higher than or equal to 5.9 $g/cm^3$ and lower than 6.3 $g/cm^3$.

Note that single crystals with the same composition do not exist in some cases. In such a case, by combining single crystals with different compositions at a given proportion, it is possible to calculate density that corresponds to the density of a single crystal with a desired composition. The density of the single crystal with a desired composition may be calculated using weighted average with respect to the combination ratio of the single crystals with different compositions. Note that it is preferable to combine as few kinds of single crystals as possible for density calculation.

Note that an oxide semiconductor film may be a stacked film including two or more films of an amorphous oxide semiconductor film, an a-like OS film, a microcrystalline oxide semiconductor film, and a CAAC-OS film, for example.

The OS transistor can achieve extremely favorable off-state current characteristics.

[Substrate 30]

The type of the substrate 30 is not limited to a certain type, and any of a variety of substrates can be used as the substrate 30. Examples of the substrate 30 include a semiconductor substrate (e.g., a single crystal substrate or a silicon substrate), an SOI substrate, a glass substrate, a quartz substrate, a plastic substrate, a metal substrate, a stainless steel substrate, a substrate containing stainless steel foil, a tungsten substrate, a substrate containing tungsten foil, a flexible substrate, a bonding film, paper containing a fibrous material, and a base film. As an example of a glass substrate, a barium borosilicate glass substrate, an aluminoborosilicate glass substrate, a soda lime glass substrate, or the like can be given. Examples of a flexible substrate, a flexible substrate, an attachment film, a base film, or the like are as follows: a plastic typified by polyethylene terephthalate (PET), polyethylene naphthalate (PEN), and polyether sulfone (PES); a synthetic resin such as acrylic; polypropylene; polyester; polyvinyl fluoride; polyvinyl chloride; polyamide; polyimide; aramid; epoxy; an inorganic vapor deposition film; and paper. Specifically, the use of semiconductor substrates, single crystal substrates, SOI substrates, or the like enables the manufacture of small-sized transistors with a small variation in characteristics, size, shape, or the like and with high current capability. A circuit using such transistors achieves lower power consumption of the circuit or higher integration of the circuit.

A base insulating film may be formed over the substrate 30 before the gate electrodes GE1, GE2, and GE3 are formed. Examples of the base insulating film include a silicon oxide film, a silicon oxynitride film, a silicon nitride film, a silicon nitride oxide film, a gallium oxide film, a hafnium oxide film, an yttrium oxide film, an aluminum oxide film, and an aluminum oxynitride film. Note that when a silicon nitride film, a gallium oxide film, a hafnium oxide film, an yttrium oxide film, an aluminum oxide film, or the like is used as a base insulating film, it is possible to suppress diffusion of impurities (typically, an alkali metal, water, hydrogen, and the like) into the oxide semiconductor films OS1 to OS3 from the substrate 30.

[Gate Electrode GE1, GE2, and GE3]

The gate electrodes GE1, GE2, and GE3 are a single-layer conductive film or multilayer conductive film. The conductive film of the gate electrodes GE1, GE2, and GE3 can be formed using a metal element selected from aluminum, chromium, copper, tantalum, titanium, molybdenum, and tungsten; an alloy containing any of these metal elements as a component; an alloy containing any of these metal elements in combination; or the like. Further, one or more metal elements selected from manganese and zirconium may be used. Alternatively, an alloy film or a nitride film in which aluminum and one or more elements selected from titanium, tantalum, tungsten, molybdenum, chromium, neodymium, and scandium are combined may be used. The conductive film can be formed using a light-transmitting conductive material such as indium tin oxide, indium oxide containing tungsten oxide, indium zinc oxide containing tungsten oxide, indium oxide containing titanium oxide, indium tin oxide containing titanium oxide, indium zinc oxide, or indium tin oxide containing silicon oxide.

An aluminum film containing silicon can be formed as the gate electrodes GE1, GE2, and GE3, for example. For the gate electrodes GE1, GE2, and GE3, for example, a two-layer structure where a titanium film is formed over an aluminum film, a titanium film is formed over a titanium nitride film, a tungsten film is formed over a titanium nitride film, or a tungsten film is formed over a tantalum nitride film or a tungsten nitride film can be used. Alternatively, a three-layer structure where an aluminum film is sandwiched between titanium films may be employed for the gate electrodes GE1, GE2, and GE3.

The gate electrodes GE1, GE2, and GE3 are formed by a sputtering method, a vacuum evaporation method, a pulsed laser deposition (PLD) method, a thermal CVD method, or the like.

Note that a tungsten film can be formed with a deposition apparatus utilizing an ALD method. In that case, a $WF_6$ gas and a $B_2H_6$ gas are sequentially introduced more than once to form an initial tungsten film, and then a $WF_6$ gas and an $H_2$ gas are introduced at a time, so that a tungsten film is formed. Note that an $SiH_4$ gas may be used instead of a $B_2H_6$ gas.

Note that the gate electrodes GE1 to GE3 can be formed by an electrolytic plating method, a printing method, an ink-jet method, or the like instead of the above formation method.

[Insulating Film 34 (Gate Insulating Film)]

The insulating film 34 is formed to cover the gate electrodes GE1 to GE3. The insulating film 34 is a single layer or a multilayer (two or more layers). An oxide insulating film, a nitride insulating film, an oxynitride insulating film, a nitride oxide insulating film, or the like can be used as the insulating film 34. In this specification, oxynitride refers to a substance which includes more oxygen than nitrogen, and nitride oxide refers to a substance which includes more nitrogen than oxygen.

As the insulating film 34, an insulating film including silicon oxide, silicon oxynitride, silicon nitride oxide, silicon nitride, aluminum oxide, hafnium oxide, gallium oxide, a Ga—Zn-based metal oxide, or the like can be used. A film including a high-k material such as hafnium silicate ($HfSiO_x$), hafnium silicate to which nitrogen is added ($HfSi_xO_yN_z$), hafnium aluminate to which nitrogen is added ($HfAl_xO_yN_z$), hafnium oxide, or yttrium oxide may be used as the insulating film, in which case gate leakage current of the transistor can be reduced.

Since the insulating film 34 is included in a gate insulating film, regions of the insulating film 34 that are in contact with the oxide semiconductor films OS1, OS2, and OS3 are preferably formed using an oxide insulating film or an oxynitride insulating film in order to improve the interface characteristics between the oxide semiconductor films OS1, OS2, and OS3 and the gate insulating film. For example, the uppermost film of the insulating film 34 is a silicon oxide film or a silicon oxynitride film.

The thickness of the insulating film 34 is, for example, 5 nm to 400 nm, inclusive, preferably 10 nm to 300 nm, inclusive, further preferably 50 nm to 250 nm, inclusive.

In the case where the oxide semiconductor films OS1 to OS3 is formed by sputtering, a power source for generating plasma can be an RF power source, an AC power source, a DC power source, or the like as appropriate.

As a sputtering gas, a rare gas (typically argon) atmosphere, an oxygen atmosphere, or a mixed gas of a rare gas and oxygen is used as appropriate. In the case of using the mixed gas of a rare gas and oxygen, the proportion of oxygen to a rare gas is preferably increased.

A target may be appropriately selected in accordance with the composition of the oxide semiconductor films OS1 to OS3.

For example, in the case where the oxide semiconductor films OS1 to OS3 are formed by a sputtering method at a substrate temperature higher than or equal to 150° C. and lower than or equal to 750° C., preferably higher than or equal to 150° C. and lower than or equal to 450° C., more preferably higher than or equal to 200° C. and lower than or equal to 350° C., the amount of hydrogen, water, or the like entering the oxide semiconductor film can be reduced and the oxide semiconductor films 31 and 32 can be a CAAC-OS film.

For the deposition of the CAAC-OS film, the following conditions are preferably used.

By suppressing entry of impurities into the CAAC-OS film during the deposition, the crystal state can be prevented from being broken by the impurities. For example, the concentration of impurities (e.g., hydrogen, water, carbon dioxide, or nitrogen) which exist in the deposition chamber may be reduced. Furthermore, the concentration of impurities in a deposition gas may be reduced. Specifically, a deposition gas whose dew point is −80° C. or lower, preferably −100° C. or lower is used.

It is also preferable that the proportion of oxygen in the deposition gas be increased and the power be optimized in order to reduce plasma damage at the deposition. The proportion of oxygen in the deposition gas is 30 vol % or higher, preferably 100 vol %.

By forming the oxide semiconductor film while it is heated or performing heat treatment after the formation of the oxide semiconductor film, the hydrogen concentration of the oxide semiconductor film can be lower than or equal to $2\times10^{20}$ atoms/cm$^3$, preferably lower than or equal to $5\times10^{19}$ atoms/cm$^3$, more preferably lower than or equal to $1\times10^{19}$ atoms/cm$^3$, still more preferably lower than $5\times10^{18}$ atoms/cm$^3$, further preferably lower than or equal to $1\times10^{18}$ atoms/cm$^3$, yet preferably lower than or equal to $5\times10^{17}$ atoms/cm$^3$, furthermore preferably lower than or equal to $1\times10^{16}$ atoms/cm$^3$.

When the heat treatment is performed at a temperature higher than 350° C. and lower than or equal to 650° C., preferably higher than or equal to 450° C. and lower than or equal to 600° C., it is possible to obtain an oxide semiconductor film whose proportion of CAAC, which is described later, is greater than or equal to 70% and less than 100%, preferably greater than or equal to 80% and less than 100%, further preferably greater than or equal to 90% and less than 100%, still further preferably greater than or equal to 95% and less than or equal to 98%. Furthermore, it is possible to obtain an oxide semiconductor film having a low content of hydrogen, water, and the like. That is, an oxide semiconductor film with a low impurity concentration and a low density of defect states can be formed.

For example, in the case where an oxide semiconductor film, e.g., an InGaZnOx (X>0) film is formed using a deposition apparatus employing ALD, an $In(CH_3)_3$ gas and an $O_3$ gas are sequentially introduced plural times to form an $InO_2$ layer, a $Ga(CH_3)_3$ gas and an $O_3$ gas are introduced at a time to form a GaO layer, and then a $Zn(CH_3)_2$ gas and an $O_3$ gas are introduced at a time to form a ZnO layer. Note that the order of these layers is not limited to this example. A mixed compound layer such as an $InGaO_2$ layer, an $InZnO_2$ layer, a GaInO layer, a ZnInO layer, or a GaZnO layer may be formed by mixing of these gases. Note that although an $H_2O$ gas which is obtained by bubbling with an inert gas such as Ar may be used instead of an $O_3$ gas, it is preferable to use an $O_3$ gas, which does not contain H. Instead of an $In(CH_3)_3$ gas, an $In(C_2H_5)_3$ gas may be used. Instead of a $Ga(CH_3)_3$ gas, a $Ga(C_2H_5)_3$ gas may be used. A $Zn(CH_3)_2$ gas may be used.

Example 1

The oxide semiconductor films 32 and 33 are each a film where a channel of a transistor is formed and the thickness of each film can be 3 nm to 200 nm, inclusive, preferably 3 nm to 100 nm, inclusive, more preferably 30 nm to 50 nm, inclusive. The thickness of the oxide semiconductor film 31 is, for example, 3 nm to 100 nm, inclusive, preferably 3 nm to 30 nm, inclusive, more preferably 3 nm to 15 nm, inclusive. The thickness of the oxide semiconductor film 31 is preferably smaller than those of the oxide semiconductor films 32 and 33.

Here, In—Ga—Zn films are deposited by sputtering as the oxide semiconductor films 31, 32, and 33. The atomic ratio of metal elements (In:Ga:Zn) of a target for depositing the films is, for example, 1:3:6 for the oxide semiconductor film 31, 3:1:2 for the oxide semiconductor film 32, and 1:1:1.2 or 1:1:1 for the oxide semiconductor film 33. The thicknesses of the oxide semiconductor films 31, 32, and 33 are 5 nm, 35 nm, and 35 nm, respectively.

[Source Electrode and Drain Electrode]

The electrodes SE1, DE1, SE2, DE2, SE3, and DE3 can be formed in a manner similar to those of the gate electrodes GE1, GE2, and GE3.

For example, a 50-nm-thick copper-manganese alloy film, a 400-nm-thick copper film, and a 100-nm-thick copper-manganese alloy film are stacked in this order by sputtering, and three-layer electrodes SE1, DE1, SE2, DE2, SE3, and DE3 can be formed.

The channel length of a transistor operated at high speed, such as a transistor used in a driver circuit or the like in a light-emitting device, is preferably short like in the transistors TA1 and TA2 or the transistors TA3, TA4, and TC1. The channel length of such a transistor is preferably smaller than 2.5 μm, for example, smaller than or equal to 2.2 μm. The channel length of the transistor in this embodiment depends on the distance between a source electrode and a drain electrode, and the minimum value of the channel length is limited by processing accuracy of a conductive film to be the electrodes SE1, DE1, SE2, DE2, SE3, and DE3. The channel length the transistor in this embodiment can thus be 0.5 μm or more, or 1.0 μm or more, for example.

[Insulating Films 35, 36]

A two-layer insulating film can be formed as "35", for example. Here, the first film of "35" is referred to as an insulating film 35*a* and the second film is referred to as an insulating film 35*b*.

As the insulating film 35*a*, an oxide insulating film including silicon oxide or the like, or an oxide insulating film containing nitrogen and fewer defects can be formed. Typical examples of the oxide insulating film containing nitrogen and fewer defects include a silicon oxynitride film and an aluminum oxynitride film.

In an ESR spectrum at 100 K or lower of the oxide insulating film with a small number of defects, a first signal that appears at a g-factor of greater than or equal to 2.037 and smaller than or equal to 2.039, a second signal that appears at a g-factor of greater than or equal to 2.001 and smaller than or equal to 2.003, and a third signal that appears at a g-factor of greater than or equal to 1.964 and smaller than or equal to 1.966 are observed. The split width of the first and second signals and the split width of the second and third signals that are obtained by ESR measurement using an X-band are each approximately 5 mT. The sum of the spin densities of the first signal that appears at a g-factor of greater than or equal to 2.037 and less than or equal to 2.039, the second signal that appears at a g-factor of greater than or equal to 2.001 and less than or equal to 2.003, and the third signal that appears at a g-factor of greater than or equal to 1.964 and less than or equal to 1.966 is lower than $1\times10^{18}$ spins/$cm^3$, typically higher than or equal to $1\times10^{17}$ spins/$cm^3$ and lower than $1\times10^{18}$ spins/$cm^3$.

In the ESR spectrum at 100 K or lower, the first signal that appears at a g-factor of greater than or equal to 2.037 and smaller than or equal to 2.039, the second signal that appears at a g-factor of greater than or equal to 2.001 and smaller than or equal to 2.003, and the third signal that appears at a g-factor of greater than or equal to 1.964 and smaller than or equal to 1.966 correspond to signals attributed to nitrogen oxide ($NO_x$; x is greater than or equal to 0 and smaller than or equal to 2, preferably greater than or equal to 1 and smaller than or equal to 2). Typical examples of nitrogen oxide include nitrogen monoxide and nitrogen dioxide. In other words, the lower the total spin density of the first signal that appears at a g-factor of greater than or equal to 2.037 and less than or equal to 2.039, the second signal that appears at a g-factor of greater than or equal to 2.001 and less than or equal to 2.003, and the third signal that appears at a g-factor of greater than or equal to 1.964 and less than or equal to 1.966 is, the lower the content of nitrogen oxide in the oxide insulating film is.

When the insulating film 35*a* contains a small amount of nitrogen oxide, the carrier trap at the interface between the insulating film 35*a* and the layers OS1, OS2, and OS3 can be reduced. As a result, a shift in the threshold voltage of the transistor can be reduced, which leads to a reduced change in the electrical characteristics of the transistor.

In order to improve the reliability of the transistor, the insulating film 35*a* preferably has a nitrogen concentration measured by secondary ion mass spectrometry (SIMS) of lower than or equal to $6\times10^{20}$ atoms/$cm^3$. This is because nitrogen oxide is unlikely to be generated in the insulating film 35*a* through the manufacturing process of the transistor.

A silicon oxynitride film, which is an example of an oxide insulating film containing nitrogen and few defects, can be formed by CVD as the insulating film 35*a*. In this case, a deposition gas containing silicon and an oxidizing gas are preferably used as a source gas. Typical examples of the deposition gas containing silicon include silane, disilane, trisilane, and silane fluoride. Examples of the oxidizing gas include dinitrogen monoxide and nitrogen dioxide.

An oxide insulating film containing nitrogen and having a small number of defects can be formed as the insulating film 35*a* by CVD under the conditions that the flow rate of an oxidizing gas to that of a deposition gas is higher than 20 times and lower than 100 times, preferably higher than or equal to 40 times and lower than or equal to 80 times and pressure in a treatment chamber is lower than 100 Pa, preferably lower than or equal to 50 Pa.

The insulating film 35*b* can be formed using an oxide insulating film whose oxygen content is in excess of that in the stoichiometric composition. Part of oxygen is released by heating from the oxide insulating film containing more oxygen than that in the stoichiometric composition. The oxide insulating film containing more oxygen than that in the stoichiometric composition is an oxide insulating film of which the amount of released oxygen converted into oxygen atoms is greater than or equal to $1.0\times10^{18}$ atoms/cm$^3$, preferably greater than or equal to $3.0\times10^{20}$ atoms/cm$^3$ in TDS analysis. Note that the temperature of the film surface in the TDS analysis is preferably higher than or equal to 100° C. and lower than or equal to 700° C., or higher than or equal to 100° C. and lower than or equal to 500° C.

A silicon oxide film, a silicon oxynitride film, or the like with a thickness greater than or equal to 30 nm and less than or equal to 500 nm, preferably greater than or equal to 50 nm and less than or equal to 400 nm can be used as the insulating film 35*b*. When the insulating film 35*b* is formed using an oxide insulating film which contains oxygen at a higher proportion than that in the stoichiometric composition, a silicon oxynitride film is formed as the oxide insulating film by CVD.

The conditions for depositing a silicon oxide film or a silicon oxynitride film as the insulating film 35*b* will be described. The substrate placed in a treatment chamber of the plasma CVD apparatus, which is vacuum-evacuated, is held at a temperature higher than or equal to 180° C. and lower than or equal to 280° C., preferably higher than or equal to 200° C. and lower than or equal to 240° C., the pressure is set greater than or equal to 100 Pa and less than or equal to 250 Pa, preferably greater than or equal to 100 Pa and less than or equal to 200 Pa with introduction of a source gas into the treatment chamber, and high-frequency power higher than or equal to 0.17 W/cm$^2$ and lower than or equal to 0.5 W/cm$^2$, preferably higher than or equal to 0.25 W/cm$^2$ and lower than or equal to 0.35 W/cm$^2$ is supplied to an electrode provided in the treatment chamber.

As the insulating film 36, a film having an effect of blocking at least hydrogen and oxygen is used. Preferably, the insulating film 36 has an effect of blocking oxygen, hydrogen, water, an alkali metal, an alkaline earth metal, or the like. Typically, a nitride insulating film such as a silicon nitride film, a silicon nitride oxide film, an aluminum nitride film, or an aluminum nitride oxide film can be used.

The insulating film 36 may include an oxide insulating film having a blocking effect against oxygen, hydrogen, water, and the like, i.e., an insulating film including aluminum oxide, aluminum oxynitride, gallium oxide, gallium oxynitride, yttrium oxide, yttrium oxynitride, hafnium oxide, or hafnium oxynitride.

The thickness of the insulating film 36 may be greater than or equal to 50 nm and less than or equal to 300 nm, preferably greater than or equal to 100 nm and less than or equal to 200 nm. The insulating film 36 that has an effect of blocking oxygen, hydrogen, water, and the like can prevent oxygen diffusion from the oxide semiconductor films 31 to 33 to the outside, and entry of hydrogen, water, and the like from the outside to the oxide semiconductor films 31 to 33.

In the case where a silicon nitride film is formed by the plasma CVD method as the insulating film 36, a deposition gas containing silicon, nitrogen, and ammonia are preferably used as a source gas. These source gases are used, and ammonia is dissociated in the plasma and activated species are generated. The activated species cleave a bond between silicon and hydrogen which are contained in a deposition gas containing silicon and a triple bond between nitrogen molecules. As a result, a dense silicon nitride film having few defects, in which bonds between silicon and nitrogen are promoted and bonds between silicon and hydrogen are few, can be formed. On the other hand, when the amount of ammonia is larger than the amount of nitrogen in a source gas, cleavage of a deposition gas containing silicon and cleavage of nitrogen are not promoted, so that a sparse silicon nitride film in which bonds between silicon and hydrogen remain and defects are increased is formed. Therefore, in a source gas, the flow ratio of the nitrogen to the ammonia is set to be preferably greater than or equal to 5 and less than or equal to 50, more preferably greater than or equal to 10 and less than or equal to 50.

Heat treatment may be performed after the insulating film 35 is formed. The temperature of the heat treatment is typically higher than or equal to 150° C. and lower than the strain point of the substrate, preferably higher than or equal to 200° C. and lower than or equal to 450° C., further preferably higher than or equal to 300° C. and lower than or equal to 450° C. By the heat treatment, oxygen contained in the oxide insulating film which is the second layer of the insulating film 35 can move to the oxide semiconductor films 31 to 33, so that the amount of oxygen vacancies contained in these oxide semiconductor films can be reduced. The heat treatment is performed at 350° C. in a mixed atmosphere containing nitrogen and oxygen for one hour.

Heat treatment to release hydrogen or the like from the oxide semiconductor films 31 to 33 may be performed after the insulating film 36 is formed. The heat treatment may be performed at 350° C. in a mixed atmosphere containing nitrogen and oxygen for one hour.

[Backgate Electrode]

The backgate electrodes BGE1 and BGE2 can be formed in a manner similar to those of the gate electrodes GE1, GE2, and GE3.

In this embodiment, other structure examples of transistors will be described.

(Transistors TA3 and TA4)

Figure 31A:
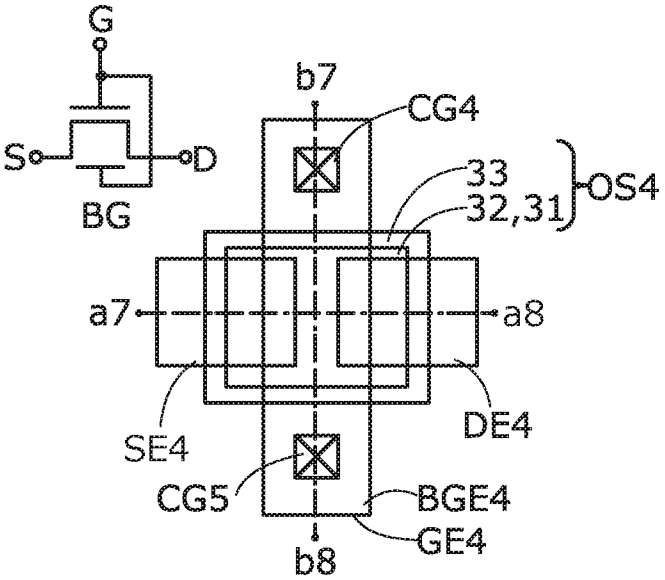
FIGS. 31A and 31B are top views illustrating one embodiment of the present invention.
Figure 31B:
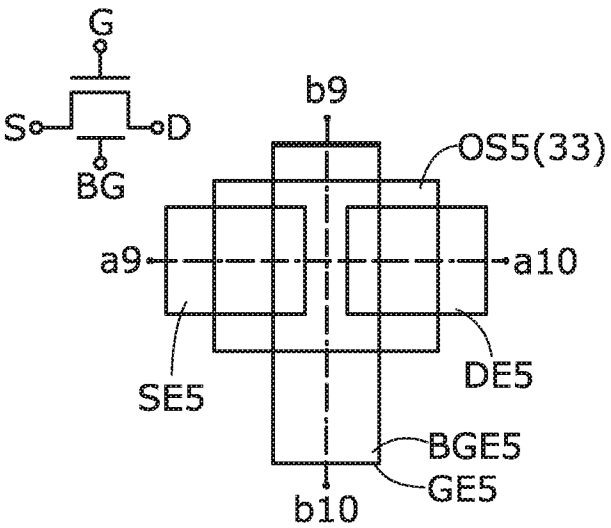
Figure 32A:
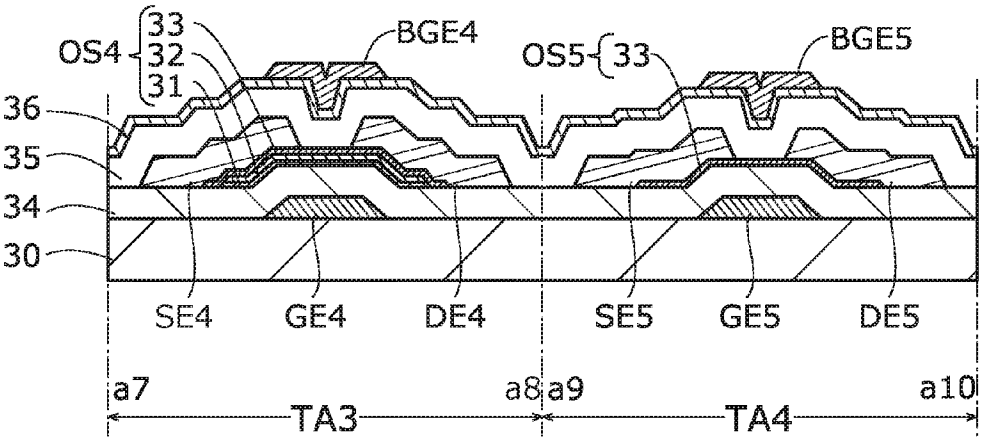
FIGS. 32A and 32B are cross-sectional views illustrating one embodiment of the present invention.
Figure 32B:
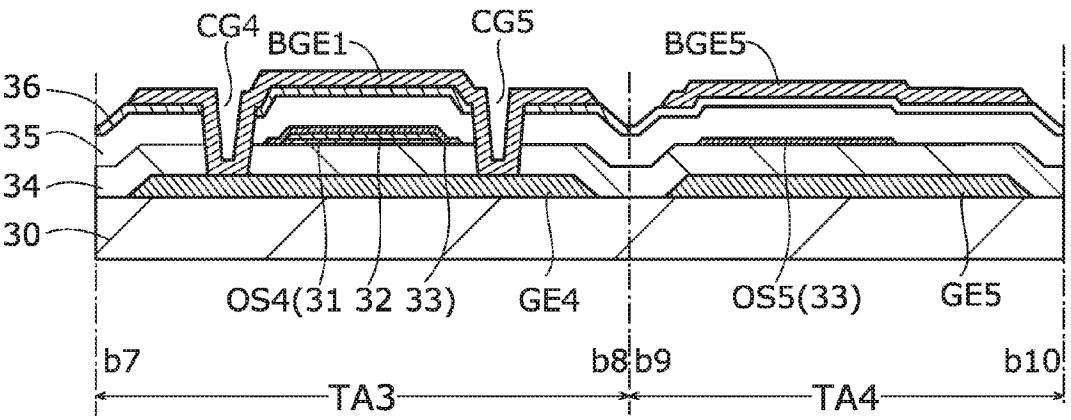

FIGS. 31A and 31B respectively show top views (layouts) and circuit symbols of transistors TA3 and TA4. FIGS. 32A and 32B are cross-sectional views of the transistors TA3 along line a7-a8 and b7-b8 and TA4 along line a9-a10 and b9-b10.

The transistor TA3 includes a gate electrode GE4, an oxide semiconductor film OS4, a source electrode SE4, a drain electrode DE4, and a backgate electrode BGE4. The transistor TA3 is a modification example of the transistor TA1. The transistor TA3 is similar to the transistor TA1 except that the electrode BGE4 is in contact with the electrode GE4 through two openings CG4 and CG5. As shown in FIG. 32B, the film OS4 is surrounded by the electrodes GE4 and BGE4 in the channel width direction, which increases the strength of the transistor TA3.

The transistor TA4 includes a gate electrode GE5, an oxide semiconductor film OS5, a source electrode SE5, a drain electrode DE5, and a backgate electrode BGE5. The transistor TA4 is a modification example of the transistor TA2. Unlike in the transistor TA2, the electrode BGE5 is not connected to the electrode GE5 and thus different signals or potentials can be input to each of the electrode BGE5 and the electrode GE5. For example, a signal for controlling conduction of the transistor TA4 is input to the electrode GE5, whereas a signal or a potential for correcting the threshold voltage of the transistor TA4 is input to the electrode BGE5.

(Transistors TC1, TB2, and TD1)

Figure 33A:
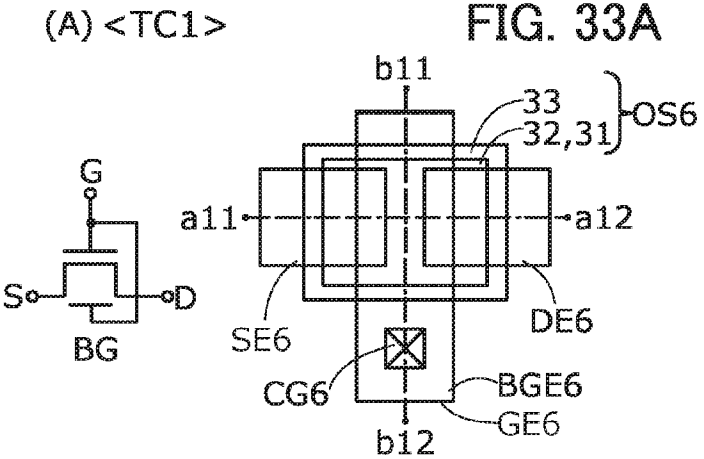
FIGS. 33A to 33C are top views illustrating one embodiment of the present invention.
Figure 33B:
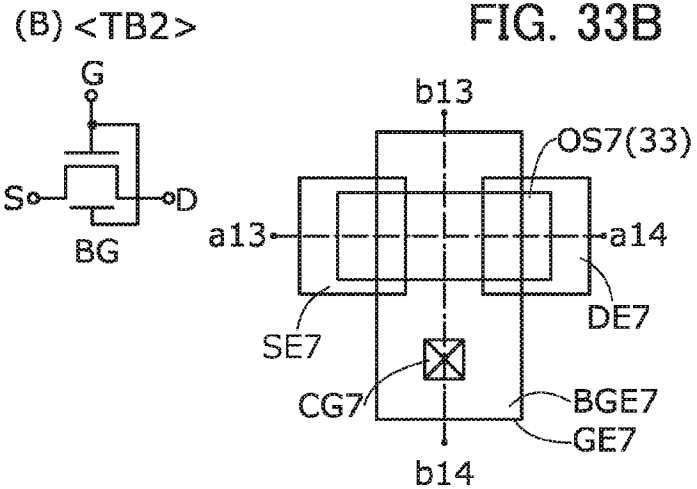
Figure 33C:
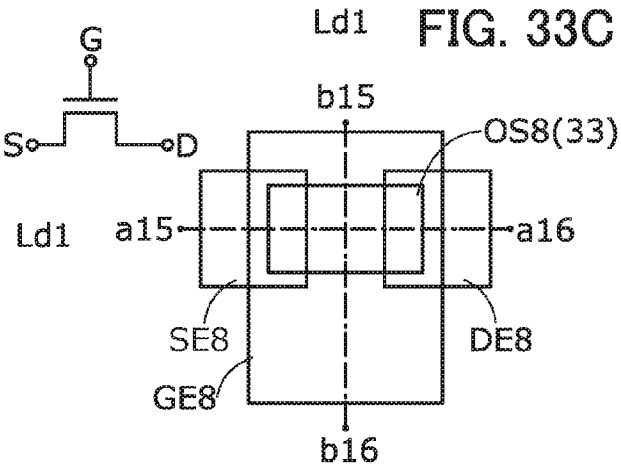
Figure 34A:
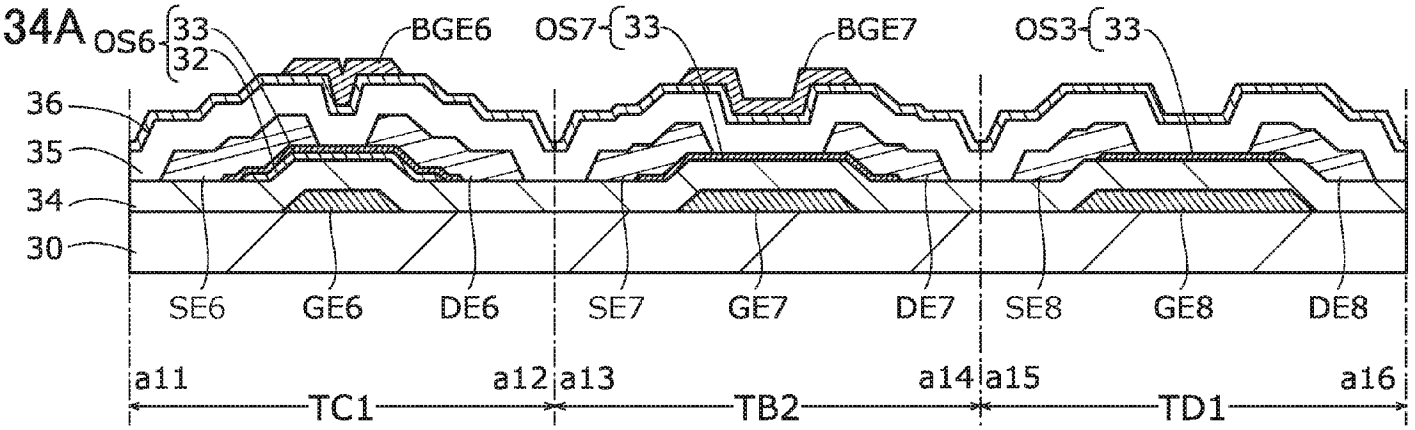
FIGS. 34A and 34B are cross-sectional views illustrating one embodiment of the present invention.
Figure 34B:
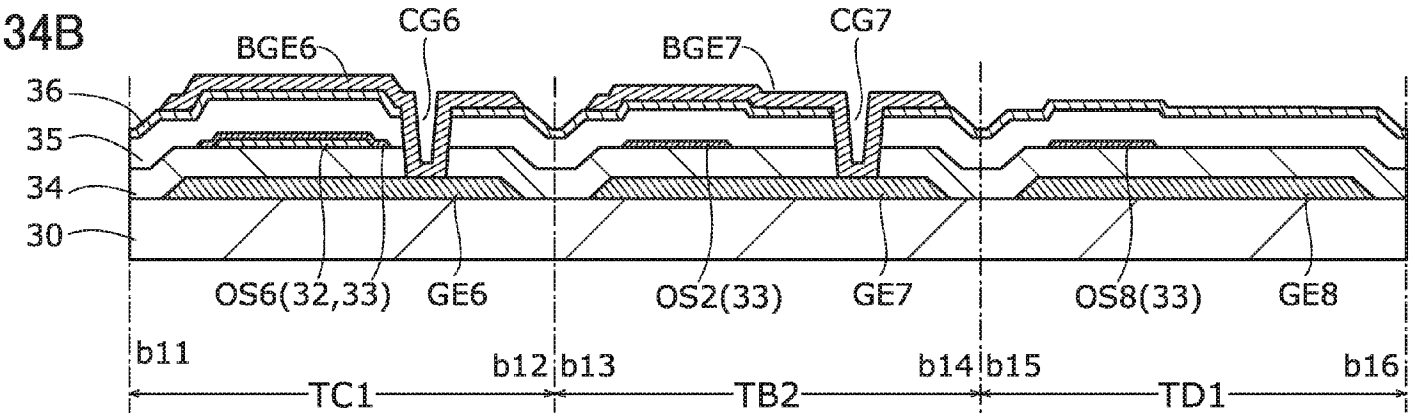

FIGS. 33A, 33B, and 33C show top views (layouts) and circuit symbols of the transistors TC1, TB2, and TD1, respectively. FIGS. 34A and 34B are cross-sectional views of the transistors TC1 along line a11-a12 and b11-b12, TB2 along line a13-a14 and b13-b14, and TD1 along line a15-a16 and b15-b16.

The transistor TC1 includes a gate electrode GE6, an oxide semiconductor film OS6, a source electrode SE6, a drain electrode DE6, and a backgate electrode BGE6. The electrode BGE6 is in contact with the electrode GE6 through an opening CG6. The transistor TC1 is a modification example of the transistor TA1, in which the film OS6 has a two-layer structure of "32" and "33". A channel formation region of the transistor TC1 is formed in "32", like in the transistor TA1. The field-effect mobility of the transistor TC1 is thus as high as that of the transistor TA1, i.e., for example, greater than 10 $cm^2/V\cdot s$ and less than 60 $cm^2/V\cdot s$, preferably greater than or equal to 15 $cm^2/V\cdot s$ and less than 50 $cm^2/V\cdot s$. Like the transistor TA1, the transistor TC1 is also suitable as a high-speed transistor in a driver circuit.

The transistor TB2 includes a gate electrode GE7, an oxide semiconductor film OS7, a source electrode SE7, a drain electrode DE7, and a backgate electrode BGE7. The electrode BGE7 is in contact with the electrode GE7 through an opening CG7. The transistor TB2 is a modification example of the transistor TB1 and differs from the transistor TB1 in including the electrode BGE7. Since the transistor TB2 includes the electrode BGE7 connected to the electrode GE7, the transistor TB2 has higher on-state current and higher mechanical strength than the transistor TB1.

The transistor TD1 includes a gate electrode GE8, an oxide semiconductor film OS8, a source electrode SE8, and a drain electrode DE8. The transistor TD1 is a modification example of the transistor TB1 and differs from the transistor TB1 in that the entire film OS8 overlaps the electrode GE8 and the film OS8 does not exist outside the end portion of the electrode GE8. With this structure, the transistor TD1 is suitable for a pixel portion because the film OS8 in the transistor TD1 is less exposed to light than in the transistor TB1.

Films of the transistors TA1, TA2, and TB1 (e.g., an insulating film, an oxide semiconductor film, a metal oxide film, and a conductive film) can be formed by sputtering, chemical vapor deposition (CVD), vacuum vapor deposition, or pulsed laser deposition (PLD). Alternatively, a coating method or a printing method can be used. Although the sputtering method and a plasma-enhanced chemical vapor deposition (PECVD) method are typical examples of the film formation method, a thermal CVD method may be used. As the thermal CVD method, a metal organic chemical vapor deposition (MOCVD) method or an atomic layer deposition (ALD) method may be used, for example.

Deposition by the thermal CVD method may be performed in such a manner that the pressure in a chamber is set to an atmospheric pressure or a reduced pressure, and a source gas and an oxidizer are supplied to the chamber at a time and react with each other in the vicinity of the substrate or over the substrate. Thus, no plasma is generated in the deposition; therefore, the thermal CVD method has an advantage that no defect due to plasma damage is caused.

Deposition by the ALD method may be performed in such a manner that the pressure in a chamber is set to an atmospheric pressure or a reduced pressure, source gases for reaction are sequentially introduced into the chamber, and then the sequence of the gas introduction is repeated. For example, two or more kinds of source gases are sequentially supplied to the chamber by switching respective switching valves (also referred to as high-speed valves). In such a case, a first source gas is introduced, an inert gas (e.g., argon or nitrogen) or the like is introduced at the same time or after the first source gas is introduced so that the source gases are not mixed, and then a second source gas is introduced. Note that in the case where the first source gas and the inert gas are introduced at a time, the inert gas serves as a carrier gas, and the inert gas may also be introduced at the same time as the introduction of the second source gas. Alternatively, the first source gas may be exhausted by vacuum evacuation instead of the introduction of the inert gas, and then the second source gas may be introduced. The first source gas is adsorbed on the surface of the substrate to form a first single-atomic layer; then the second source gas is introduced to react with the first single-atomic layer; as a result, a second single-atomic layer is stacked over the first single-atomic layer, so that a thin film is formed.

The sequence of the gas introduction is repeated plural times until a desired thickness is obtained, whereby a thin film with excellent step coverage can be formed. The thickness of the thin film can be adjusted by the number of repetitions of the sequence of the gas introduction; therefore, an ALD method makes it possible to accurately adjust a thickness and thus is suitable for manufacturing a minute FET.

Structure Example 2 of Transistor

The transistor used in the light-emitting device of one embodiment of the present invention may include a channel formation region in the semiconductor film or a semiconductor substrate of silicon, germanium, or the like in an amorphous, microcrystalline, polycrystalline, or single crystal state. In the case where the transistors are formed using a thin silicon film, any of the following can be used: amorphous silicon formed by sputtering or vapor phase growth such as plasma CVD; polycrystalline silicon obtained by crystallization of amorphous silicon by treatment such as laser annealing; single crystal silicon obtained by separation of a surface portion of a single crystal silicon wafer by implantation of hydrogen ions or the like into the silicon wafer; and the like.

Figure 35A:
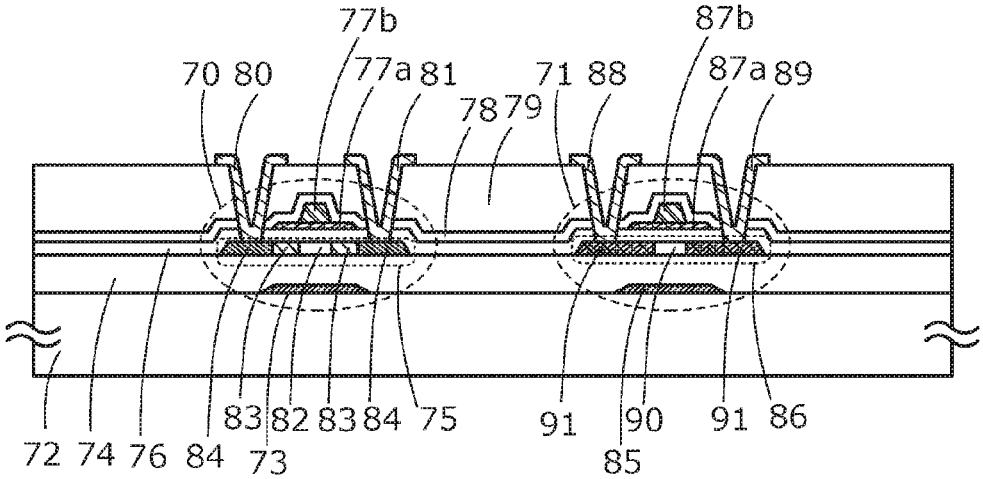
FIGS. 35A and 35B are cross-sectional views illustrating one embodiment of the present invention.
Figure 35B:
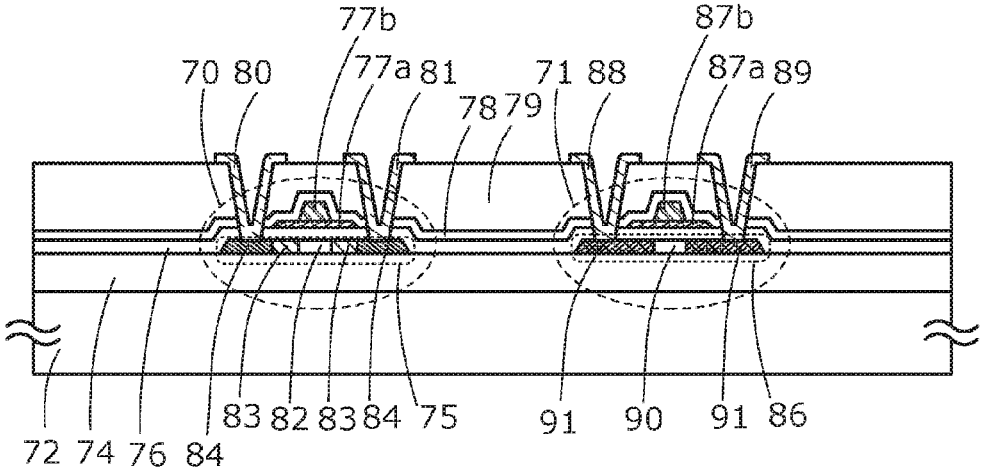

FIGS. 35A and 35B are cross-sectional views of a transistor including a thin silicon film, which can be used in the light-emitting device of one embodiment of the present invention. FIGS. 35A and 35B show an n-channel transistor 70 and a p-channel transistor 71.

The transistor 70 includes, over a substrate 72 having an insulating surface, a conductive film 73 functioning as a gate, an insulating film 74 over the conductive film 73, a semiconductor film 75 overlapping the conductive film 73 with the insulating film 74 provided therebetween, an insulating film 76 over the semiconductor film 75, a conductive film 77*a* and a conductive film 77*b* overlapping with the semiconductor film 75 with the insulating film 76 provided therebetween and functioning as gates, an insulating film 78 over the conductive films 77*a* and 77*b*, an insulating film 79 over the insulating film 78, and a conductive film 80 and a conductive film 81 electrically connected to the semiconductor film 75 through openings in the insulating films 78 and 79 and functioning as a source and a drain.

The width in the channel length direction of the conductive film 77*b* is shorter than the conductive film 77*a*. The conductive films 77*a* and 77*b* are stacked in this order from the insulating film 76 side. The semiconductor film 75 includes a channel formation region 82 overlapping with the conductive film 77*b*, a pair of lightly doped drain (LDD) regions 83 between which the channel formation region 82 is sandwiched, and a pair of impurity regions 84 between which the channel formation region 82 and the LDD regions 83 are sandwiched. The pair of impurity regions 84 functions as a source region and a drain region. An impurity element imparting n-type conductivity to the semiconductor film 75, such as boron (B), aluminum (Al), or gallium (Ga), is added to the LDD regions 83 and the impurity regions 84.

The transistor 71 includes, over the substrate 72 having an insulating surface, the conductive film 85 functioning as a gate, the insulating film 74 over the conductive film 85, a semiconductor film 86 overlapping the conductive film 85 with the insulating film 74 provided therebetween, the insulating film 76 over the semiconductor film 86, a conductive film 87*a* and a conductive film 87*b* overlapping with the semiconductor film 86 with the insulating film 76 provided therebetween and functioning as gates, the insulating film 78 over the conductive films 87*a* and 87*b*, the insulating film 79 over the insulating film 78, and a conductive film 88 and a conductive film 89 electrically connected to the semiconductor film 86 through openings in the insulating films 78 and 79 and functioning as a source and a drain.

The width in the channel length direction of the conductive film 87*b* is shorter than the conductive film 87*a*. The conductive films 87*a* and 87*b* are stacked in this order from the insulating film 76 side. The semiconductor film 75 includes a channel formation region 90 overlapping with the conductive film 87*b*, and a pair of impurity regions 91 between which the channel formation region 90 is sandwiched. The pair of impurity regions 91 functions as a source region and a drain region. An impurity element imparting p-type conductivity to the semiconductor film 86, such as phosphorus (P) or arsenic (As), is added to the impurity regions 91.

Note that the semiconductor film 75 or 86 may be crystallized by various techniques. Examples of the various techniques of crystallization are a laser crystallization method using a laser beam and a crystallization method using a catalyst element. Alternatively, a crystallization method using a catalyst element and a laser crystallization method may be combined. In the case of using a thermally stable substrate such as quartz for the substrate 72, any of the following crystallization methods can be used in combination: a thermal crystallization method with an electrically-heated oven, a lamp anneal crystallization method with infrared light, a crystallization method with a catalyst element, and high temperature annealing at about 950° C.

Although FIG. 35A shows a structure in which the conductive films 77*a* and 77*b* serve as a gate and the conductive film 73 serves as a backgate electrode, another structure may be employed. For example, the conductive film 73 serving as a backgate electrode may be omitted as shown in FIG. 35B. Although FIG. 35A shows a structure in which the conductive films 87*a* and 87*b* serve as a gate and the conductive film 85 serves as a backgate electrode, one embodiment of the present invention is not limited thereto. For example, the conductive film 85 serving as a backgate electrode may be omitted as shown in FIG. 35B. Note that the structure shown in FIG. 35B can be used for an OS transistor.

Figure 36A:
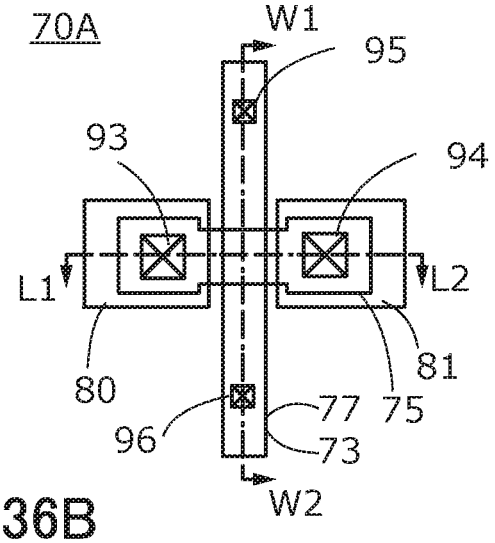
FIGS. 36A to 36C are a top view and cross-sectional views illustrating one embodiment of the present invention.
Figure 36B:
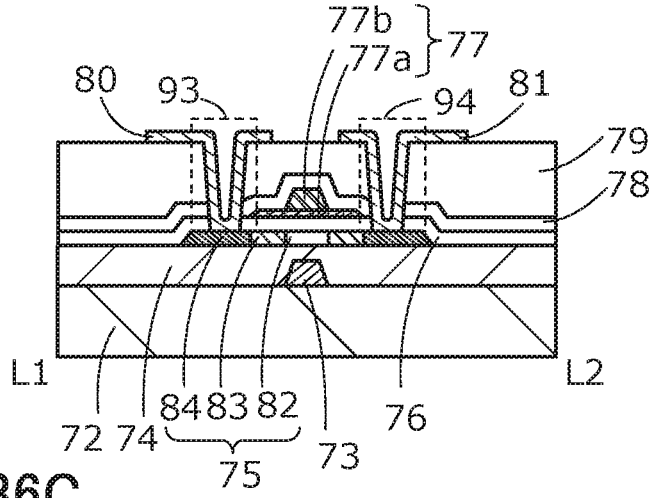
Figure 36C:
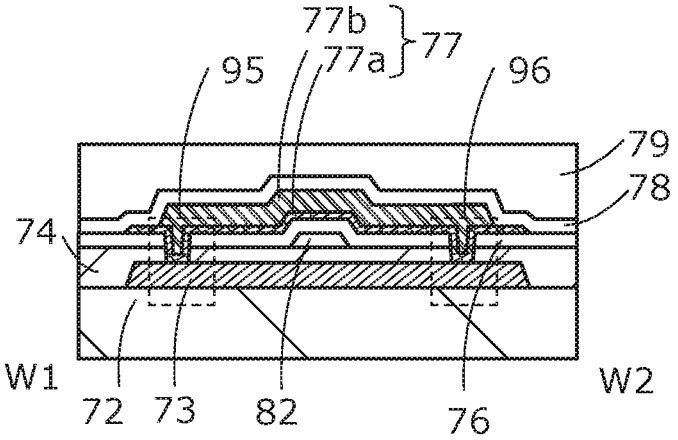

FIG. 36A is a top view of a transistor 70A which corresponds to the n-channel transistor 70 shown in FIG. 35A. FIG. 36B is a cross-sectional view taken along the line L1-L2 in the channel length direction of the transistor 70A. FIG. 36C is a cross-sectional view taken along the line W1-W2 in the channel width direction of the transistor 70A.

FIG. 36A shows a conductive film 77, the conductive film 73, the semiconductor film 75, the conductive film 80, the conductive film 81, an opening 93, an opening 94, an opening 95, and an opening 96. The conductive film 77 serves as a gate. The conductive film 73 serves as a backgate. Details of the components denoted by the same reference numerals as those in FIG. 35A are omitted in the description of FIG. 36A. The openings 93 and 94 are openings for connecting the semiconductor film 75 and the conductive films 80 and 81. The openings 95 and 96 are openings for electrically connecting the conductive films 77 and 73.

FIG. 36B shows the conductive film 73 and the insulating film 74 over the substrate 72, the semiconductor film 75 overlapping the conductive film 73 with the insulating film 74 provided therebetween; the insulating film 76 over the semiconductor film 75, the conductive films 77*a* and 77*b* overlapping with the semiconductor film 75 with the insulating film 76 provided therebetween and serving as a gate, the insulating film 78 over the conductive films 77*a* and 77*b*, the insulating film 79 over the insulating film 78, and the conductive films 80 and 81 electrically connected to the semiconductor film 75 through the openings 93 and 94 in the insulating films 78 and 79 and serving as a source and a drain. The semiconductor film 75 includes a channel formation region 82, an LDD region 83, and an impurity region 84. Details of the components denoted by the same reference numerals as those in FIG. 35A are omitted in the description of FIG. 36B.

FIG. 36C shows, over the substrate 72, the conductive film 73 and the insulating film 74, the channel formation region 82, and the insulating film 76; the conductive film 77*a* and the conductive film 77*b* which are electrically connected to the conductive film 73 in the openings 95 and 96, the insulating film 78 over the conductive films 77*a* and 77*b*, and the insulating film 79 over the insulating film 78. The semiconductor film 75 includes the channel formation region 82, the LDD region 83, and the impurity region 84. Details of the components denoted by the same reference numerals as those in FIG. 35A are omitted in the description of FIG. 36C.

In the structure illustrated in the top view and the cross-sectional views of FIGS. 36A to 36C, the conductive film 77 serving as a gate and the conductive film 73 electrically connected to the conductive film 77 and serving as a backgate electrically surround the channel formation region 82 of the semiconductor film 75 in the channel width direction. In other words, in this structure, the conductive films wrap around the top surface, the bottom surface, and the side surfaces of the channel formation regions. Such a structure can increase the on-state current and reduce the size in the channel width direction. Besides, such a structure that the channel formation region is surrounded by the conductive films can easily block light and thus can suppress photoexcitation caused by undesired light irradiation on the channel formation region.

In addition, the structure shown in the top view and the cross-sectional views of FIGS. 36A to 36C can avoid an accidental electrical connection at the ends of the semiconductor layer 75 in the W1-W2 direction caused by an undesired increase in conductivity. The influence of non-uniform distribution of impurity elements added to the semiconductor layer 75 can be reduced.

Although the structure shown in the top view and the cross-sectional view of FIGS. 36A to 36C includes a gate and a backgate electrically connected to each other, different voltages may be applied to them, which is particularly effective in a circuit in which all transistors has n-channel conductivity, that is, a circuit in which all transistors has the same conductivity. In such a structure, the threshold voltage of a transistor can be controlled by applying voltages to a backgate; thus, a logic circuit, such as an inverter circuit, can be formed using ED-MOS transistors whose threshold voltages are different from each other. The area occupied by a pixel driver circuit using such a logic circuit can be reduced, leading to narrowing the bezel of a display device. In addition, when the voltage of the backgate is set so that a transistor is turned off, the off-state current of the transistor can be further reduced. Therefore, even when the refresh rate of the display device is increased, written voltages can be maintained and accordingly the number of writings can be reduced, leading to low power consumption of the display device.

Figure 37A:
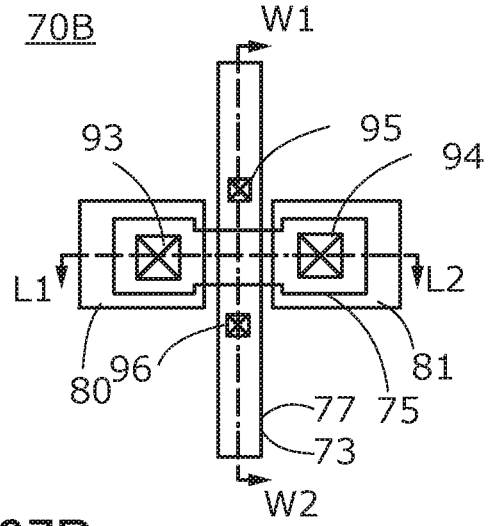
FIGS. 37A to 37C are a top view and cross-sectional views illustrating one embodiment of the present invention.
Figure 37B:
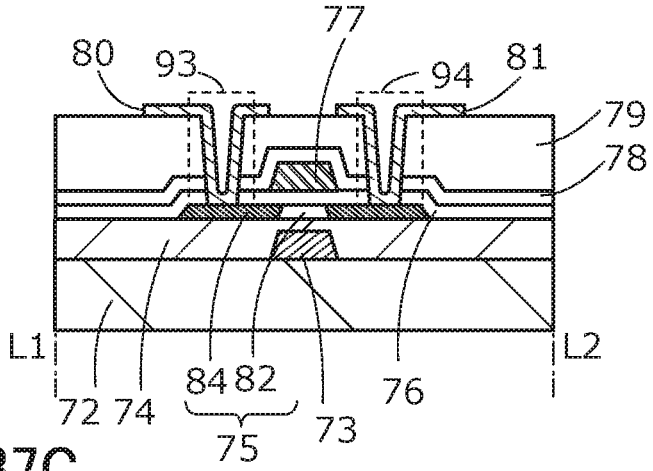
Figure 37C:
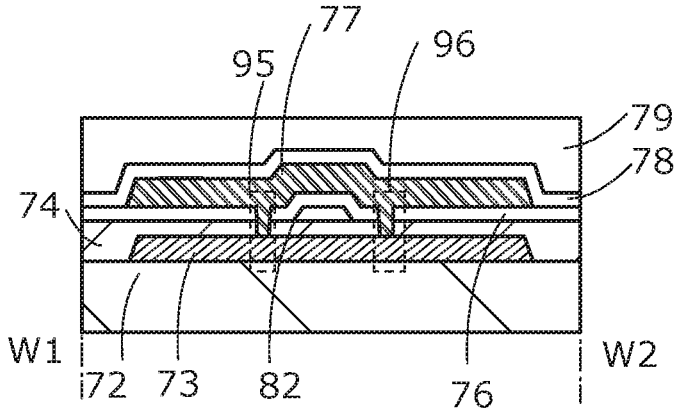

Note that the top view and the cross-sectional views of FIGS. 36A to 36C show just one example, and another structure can be employed. FIGS. 37A to 37C are a top view and cross-sectional views different from those of FIGS. 36A to 36C.

Different points of the structure shown in FIGS. 37A to 37C from the structure shown in FIGS. 36A to 36C are that the conductive layer 77 serving as a gate is a single layer and that the openings 95 and 96 are closer to the channel formation region 82. Such a structure facilitates application of electric field to the channel formation region from the top, bottom, and side surfaces thereof. Effects similar to those of the structure in FIGS. 36A to 36C can be obtained from the structure shown in FIGS. 37A to 37C.

Figure 38A:
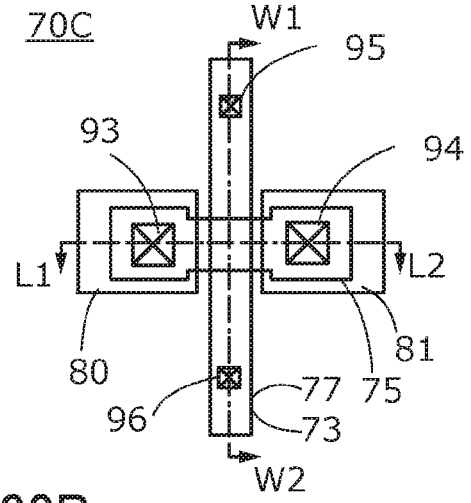
FIGS. 38A to 38C are a top view and cross-sectional views illustrating one embodiment of the present invention.
Figure 38B:
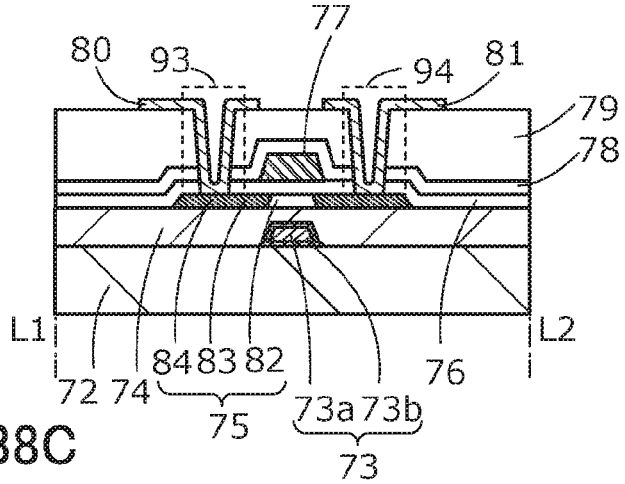
Figure 38C:
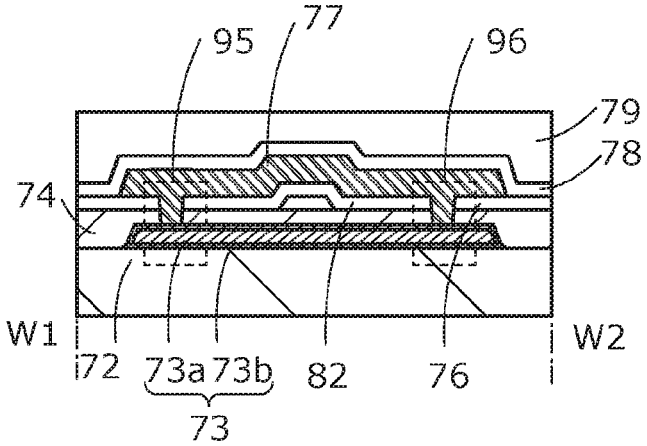

FIGS. 38A to 38C show a top view and cross-sectional views of a structure different from the structures shown in FIGS. 36A to 36C and FIGS. 37A to 37C.

A different point of the structure shown in FIGS. 38A to 38C from the structures shown in FIGS. 36A to 36C and FIGS. 37A to 37C is that the conductive film 73 serving as a backgate is composed of a conductive film 73*a* and a conductive film 73*b* which is surrounded by the conductive film 73*a*. Effects similar to those of the structure in FIGS. 36A to 36C can be obtained from the structure shown in FIGS. 38A to 38C.

In addition, even when the conductive film 73*b* contains a movable element (e.g., copper (Cu)), the structure shown in FIGS. 38A to 38C can prevent the movable element from entering the semiconductor layer 75 causing degradation of the semiconductor layer 75.

As materials of the conductive film 73*a*, which serves as a barrier film and provided on the formation surface of the wiring, any of tungsten (W), molybdenum (Mo), chromium (Cr), titanium (Ti), and tantalum (Ta), which are high melting point materials, or an alloy thereof (e.g., W—Mo, Mo—Cr, or Ta—Mo) or a nitride thereof (e.g., tungsten nitride ($WN_x$), titanium nitride ($TiN_x$), tantalum nitride ($TaN_x$), or $TiSiN_x$), or the like can be used. A sputtering method, a CVD method or the like can be adopted as the formation method. As the materials of the conductive film 73*b*, copper (Cu) is preferable; however, there is no particular limitation as long as they are low resistance materials. For example, silver (Ag), aluminum (Al), gold (Au), or an alloy thereof, etc. can be used. As the formation method of the conductive film 73*b*, a sputtering method is preferable; however, a CVD method can be adopted as long as conditions that do not damage the resist mask 102 are selected.

<Fabrication Process of Transistor>

Described below using cross-sectional views is an example of a fabrication process of the above described transistor including a backgate electrode, which are shown in FIGS. 35A to 38C, and a light-emitting element provided over the transistor. Although FIGS. 39A to 41C show a process of fabricating a p-channel transistor and an n-channel transistor over a substrate, this is just an example: thus, in the case of a circuit in which all transistors has the same conductivity, a process of fabricating either one of the transistor is used.

Figures 39A, 39B, 39C, 39D, 39E:
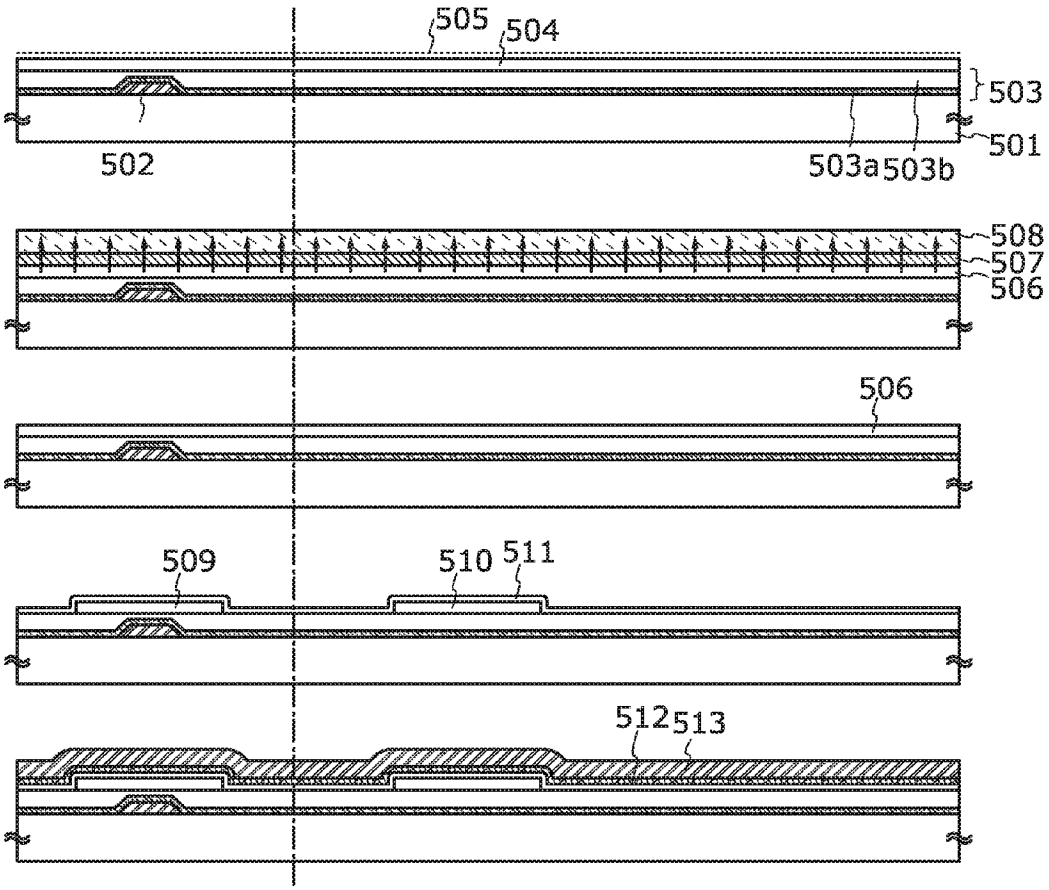
FIGS. 39A to 39E are cross-sectional views illustrating one embodiment of the present invention.

First, a conductive film 502 serving as a backgate electrode is formed on an insulating surface of a substrate 501 as shown in FIG. 39A. The conductive film 502 can be formed using a conductive material containing one or more selected from Al, W, Mo, Ti, and Ta. Although tungsten is used for the conductive film 502 in this embodiment, a film in which tungsten is stacked on tantalum nitride may be used. The conductive film 502 may be composed of a plurality of films without limitation to a single film.

As the substrate 501, for example, a glass substrate made of barium-borosilicate glass or alumino-borosilicate glass, a quartz substrate, a ceramic substrate, or the like can be used. A silicon substrate or a metal substrate, each having an insulating film formed thereover may be used. Although a substrate formed of a flexible synthetic resin such as plastic generally has a lower resistance temperature than the aforementioned substrates, it may be used as long as being resistant to a processing temperature during manufacturing steps.

Next, an insulating film 503 is formed to cover the conductive film 502. The insulating film 503 is composed of an insulating film 503*a* and an insulating film 503*b* stacked thereon. A silicon oxynitride film is used as the insulating film 503*a*, for example. A silicon oxide film or a silicon oxynitride film is used as the insulating film 503*b*, for example. Note that the insulating film 503 is not limited to the structure and may be composed of a single insulating film or three or more insulating films. Also, the materials are not limited thereto.

The surface of the insulating film 503 (i.e., the surface of the insulating film 503*b*) may have projections and depressions because of the conductive film 502 that has been formed. In this case, it is desirable to planarize the projections and depressions. In this embodiment, chemical-mechanical polishing is performed for the planarization.

Next, an amorphous semiconductor film 504 is formed on the insulating film 503 by a plasma CVD method. Depending on the amount of hydrogen contained in the amorphous semiconductor film 504, a dehydrogenation treatment is desirably performed before a crystallization step. The dehydrogenation treatment is preferably performed for several hours at a heating temperature of 400° C. to 550° C. so that the amount of hydrogen is reduced to 5 atom % or less. Alternatively, a sputtering method, an evaporation method, or the like may be used for forming the amorphous semiconductor film. In any case, impurity elements contained in the film, such as oxygen and nitrogen, are desirably reduced to a sufficient level.

For example, silicon germanium can be used as the semiconductor without limitation to silicon. In the case of using silicon germanium, the concentration of germanium is preferably approximately 0.01 to 4.5 atomic %.

Note that when the insulating film 503 and the amorphous semiconductor film 504 are formed by a plasma CVD method, these films can be successively formed without exposure to the air. Such a successive deposition can minimize contamination of the surface with the air, so that variation in characteristics of the transistor can be reduced.

Next, a catalyst is added to the amorphous semiconductor film 304. In this embodiment, a nickel acetate solution containing nickel of 1 to 100 ppm by weight is applied by a spinner. Note that such a treatment may be performed so as to apply the nickel acetate solution sufficiently that the surface of the amorphous semiconductor film 304 is processed using an ozone water solution to form an extremely thin oxide film thereon. The oxide film is etched away with a mixed solution of hydrofluoric acid and hydrogen peroxide water to obtain a clean surface. Then, the treatment using an ozone water solution is performed again to form an extremely thin oxide film. As a result of oxidizing the surface of the semiconductor film, which is originally hydrophobic, the nickel acetate solution can be applied evenly. The above is the description of FIG. 39A.

Needless to say, the method for adding a catalyst to the amorphous semiconductor film is not limited to the above, and a sputtering method, an evaporation method, a plasma treatment, or the like may be used.

Next, heat treatment is performed at 500 to 650° C. for 4 to 24 hours (e.g., at 570° C. for 14 hours), whereby the nickel-containing layer 505 enhances the crystallization. Thus, a highly crystallized semiconductor film is formed.

As a method of the heat treatment, a furnace annealing method using an electrically heated furnace; an RTA method using a lamp, such as a halogen lamp, a metal halide lamp, a xenon arc lamp, a carbon arc lamp, a high-pressure sodium lamp, or a high-pressure mercury lamp, can be employed. Alternatively, a gas heating RTA using a heated inert gas can be used.

In the case of an RTA method, a lamp light source for heating is turned on for 1 to 60 seconds, preferably 30 to 60 seconds, which is repeated 1 to 10 times, preferably 2 to 6 times. The lamp light source may have any light intensity as long as the amorphous semiconductor film 504 can be heated instantaneously to about 600 to 1000° C., preferably about 650 to 750° C. The semiconductor film is just instantaneously subjected to such high temperature, and there is no change in shape of the substrate 501.

In the case of a furnace annealing method, heat treatment at 500° C. for about one hour is first performed to expel hydrogen from the amorphous semiconductor film 504. Then, heat treatment is performed in an electrically heated furnace under a nitrogen atmosphere at 550 to 600° C., preferably 580° C., for four hours, thereby crystallizing the amorphous semiconductor film 504.

Note that catalyst elements other than nickel (Ni), which is used in this embodiment, such as germanium (Ge), iron (Fe), palladium (Pd), tin (Sn), lead (Pb), cobalt (Co), platinum (Pt), copper (Cu), or gold (Au) may be used.

Next described is gettering using catalyst elements which exist in the crystalline semiconductor film 506. After the crystallization using a catalyst element, the crystalline semiconductor film 506 probably contains residual catalyst elements (i.e., nickel) at an average concentration of more than $1\times10^{19}/cm^3$. Such residual catalyst elements can adversely affect the transistor characteristics, and thus, a process of reducing the concentration of catalyst elements is required.

Among a variety of gettering methods, an example described in this embodiment is gettering before the crystalline semiconductor film 506 is patterned. First, a barrier layer 507 is formed on the surface of the crystalline semiconductor film 506 as shown in FIG. 39B. The barrier layer 507 is provided to prevent the crystalline semiconductor film 506 from being etched in a later step of removing a gettering site.

The thickness of the barrier layer 507 is about 1 to 10 nm. Chemical oxide formed by treatment using ozone water may be used as the barrier layer. Chemical oxide can also be formed by treatment using a mixed aqueous solution of hydrogen peroxide water and sulfuric acid, hydrochloric acid, nitric acid, or the like. Alternatively, a plasma treatment under an oxygen atmosphere, an oxidation treatment where ozone is generated by ultraviolet light irradiation under an oxygen-containing atmosphere, or the like can be used. A thin oxide film formed in a clean oven at a heating temperature of about 200 to 350° C. may be used as the barrier layer. Alternatively, an oxide film serving as the barrier layer may be deposited by a plasma CVD method, a sputtering method, an evaporation method, or the like to have a thickness of about 1 to 5 nm. In any cases, a film in which catalyst elements can move to the gettering site side in the gettering step and which serves as a barrier against an etchant in the step of removing the gettering site (i.e., protects the crystalline semiconductor film 506 from an etchant) should be used. Examples of such a film include a chemical oxide film formed by a treatment using ozone water, a silicon oxide film ($SiO_x$), and a porous film.

Next, as a gettering site 508, a gettering semiconductor film (typically, an amorphous silicon film) containing a rare gas element at a concentration of $1\times10^{20}/cm^3$ or more and having a thickness of 25 to 250 nm is formed on the barrier layer 507 by a sputtering method. A low-density film is preferably formed so that the gettering site 508, which is removed later, is etched more preferentially than the crystalline semiconductor film 506.

Note that a rare gas element does not adversely affect the crystalline semiconductor film 506 because the rare gas element itself is inert in the semiconductor film. The rare gas element may be one or more of helium (He), neon (Ne), argon (Ar), krypton (Kr), and xenon (Xe).

Then, heat treatment is performed for gettering (FIG. 39B). A furnace annealing method, an RTA method, or the like is used for the heat treatment. In the case of a furnace annealing method, the heat treatment is conducted at 450 to 600° C. for 0.5 to 12 hours in a nitrogen atmosphere. In the case of an RTA method, a lamp light source for the heating is turned on for 1 to 60 seconds, preferably 30 to 60 seconds, which is repeated 1 to 10 times, preferably 2 to 6 times. The lamp light source may have any light intensity as long as the semiconductor film can be heated instantaneously to about 600 to 1000° C., preferably about 700 to 750° C.

By the heat treatment, the catalyst elements in the crystalline semiconductor film 506 are diffused by thermal energy toward the gettering site 508 as shown by the arrows. Thus, the gettering efficiency depends on a treatment temperature; the higher the treatment temperature is, the faster the gettering proceeds.

After the gettering process is finished, the gettering site 508 is selectively etched and removed. As the etching, dry etching using $ClF_3$ without plasma or wet etching using an alkaline solution such as a water solution containing hydrazine or tetramethyl ammonium hydroxide (chemical formula $(CH_3)_4NOH$) can be performed. The barrier layer 507 serves as an etching stopper in this step and is then removed using fluoric acid thereafter (FIG. 39C).

After the barrier layer 507 is removed, the crystalline semiconductor film 506 is patterned to form island-shaped semiconductor films 509 and 510 (FIG. 39D). The thickness of the semiconductor films 509 and 510 is 25 to 100 nm preferably 30 to 60 nm. Then, an insulating film 511 is formed so as to cover the semiconductor films 509 and 510. Since about 10 to 40 nm of the insulating film 511 will be reduced by dry etching which is performed later for forming an electrode serving as a gate electrode, the thickness of the insulating film 511 is desirably determined in consideration of the reduction in thickness. Specifically, the insulating film 511 is formed to have a thickness of 40 to 150 nm (preferably 60 to 120 nm).

For example, silicon oxide, silicon nitride, silicon oxide containing nitrogen, or the like can be used for the insulating film 511. Note that the case where the insulating film 511 is formed using a single insulating film is described as an example in this embodiment; however, the insulating film 511 may be formed using two or more insulating films. As the film-forming method, a plasma CVD method, a sputtering method, or the like can be used. For example, in the case where the second insulating film 311 is formed using silicon oxide by plasma enhanced CVD, a mixed gas of TEOS (tetraethyl orthosilicate) and $O_2$ is used; reaction pressure is 40 Pa; substrate temperatures are 300° C. to 400° C.; and high-frequency (13.56 MHz) power densities are 0.5 $W/cm^2$ to 0.8 $W/cm^2$.

Aluminum nitride can be used for the insulating film 511. Aluminum nitride has comparatively high thermal conductivity and can efficiently diffuse heat generated in a transistor. Further alternatively, silicon oxide, silicon oxynitride, or the like containing no aluminum may be formed and then aluminum nitride may be stacked thereon to form the insulating film 511.

Then, a conducive film is deposited on the insulating film 511 (FIG. 39E). In this embodiment, a tantalum nitride conductive film 512*a* and a tungsten conductive film 512*b* are deposited to have a thickness of 20 to 100 nm and a thickness of 100 to 400 nm, respectively. Specific deposition conditions of the tantalum nitride conductive film 512*a* are as follows: the purity of Ta target is 99.99%; the temperature in a chamber is room temperature; the flow rates of Ar and $N_2$ are 50 ml/min and 10 ml/min, respectively; the pressure in the chamber is 0.6 Pa; the deposition power is 1 kW; and the deposition rate is approximately 40 nm/min. The deposition conditions of the second film, the tungsten conductive film 512*b* are as follows: the purity of tungsten target is 99.99%; the temperature in a chamber is 230° C.; the flow rate of Ar is 100 ml/min; the pressure in the chamber is 1.5 Pa; the deposition power is 6 kW; and the deposition rate is approximately 390 nm/min.

Although the non-limiting example is described in this embodiment in which such a two-layer conductive film is used as an electrode serving as a gate electrode, the conductive film may be composed of a single layer or three layers or more. In addition, the materials of the conductive layers are not limited to those described in this embodiment.

Specifically, the conductive films can each be composed of an element selected from Ta, W, Ti, Mo, Al, and Cu, or an alloy or a compound containing the element as its main component. For example, tantalum and tungsten may be used for the first layer and the second layer, respectively; tantalum nitride and aluminum may be used for the first layer and the second layer, respectively; and tantalum nitride and copper may be used for the first layer and the second layer, respectively. A silver-palladium-copper alloy may be used for either the first layer or the second layer. Alternatively, a three-layer structure in which tungsten, an aluminum-silicon (Al—Si) alloy, and titanium nitride are stacked in this order may be used. Instead of tungsten, tungsten nitride may be used. Instead of the aluminum-silicon (Al—Si) alloy, an aluminum-titanium (Al—Ti) alloy may be used. Instead of titanium nitride, titanium may be used. Note that in order to make a difference between the widths of the plurality of conductive films in the channel length direction, materials of the conductive films are selected in consideration of the etching selectivity.

Note that it is important to select an optimal etching gas for the materials of the conductive films.

Figures 40A, 40B, 40C, 40D:
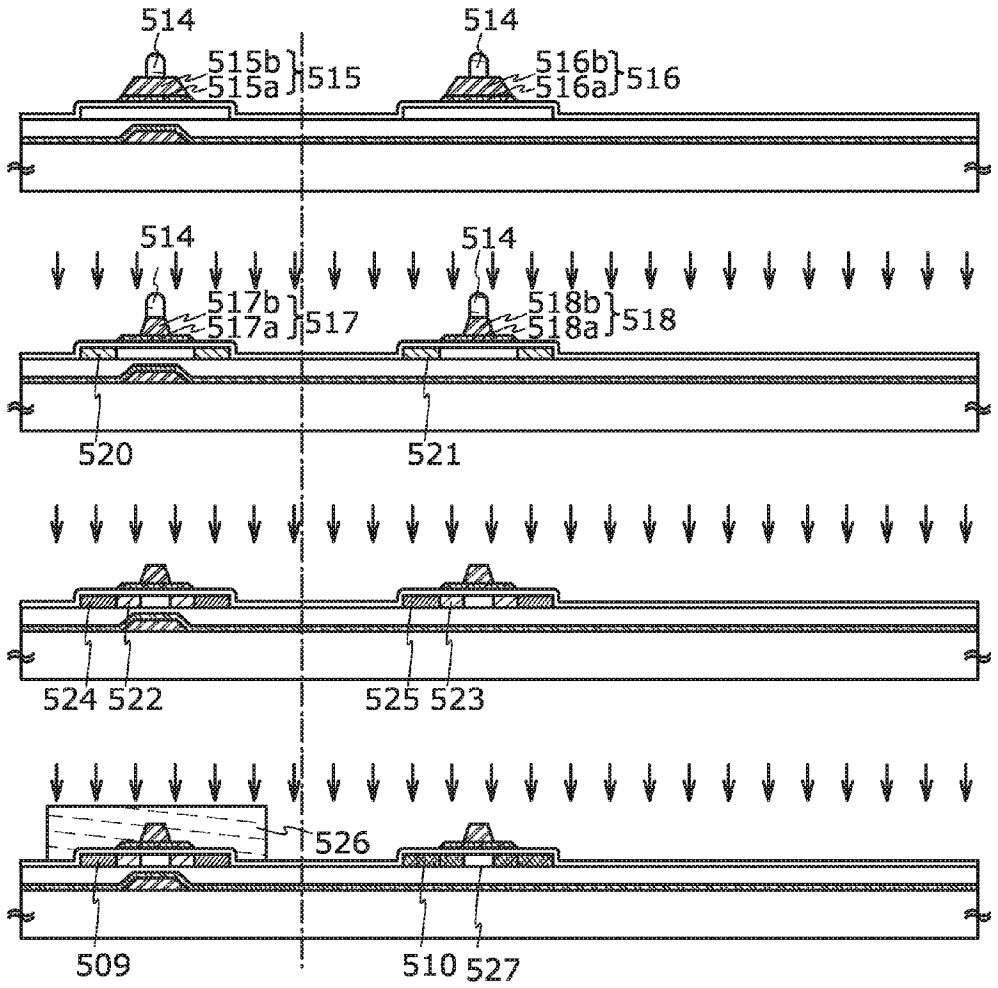
FIGS. 40A to 40D are cross-sectional views illustrating one embodiment of the present invention.

Next, a mask 514 is formed, and the conductive films 512*a* and 512*b* are etched as shown in FIG. 40A (a first etching process). In this embodiment, an inductively coupled plasma (ICP) etching method is used. A mixed gas of $Cl_2$, $CF_4$, and $O_2$ is used as an etching gas. The etching gas pressure in a chamber is 1.0 Pa. An RF (13.56 MHz) power of 500 W is applied to a coiled electrode to generate plasma. An RF (13.56 MHz) power of 150 W is applied to a substrate stage (lower electrode) so that self-bias voltage is applied to the substrate. Then, the etching gas is replaced with a mixed gas of $Cl_2$ and $CF_4$, and the total pressure is set to 1.0 Pa. A RF (13.56 MHz) power of 500 W and that of 20 W are applied to the coiled electrode and to the substrate (sample stage), respectively.

With the use of the etching gas of $Cl_2$ and $CF_4$, the etching rate of the tantalum nitride conductive film 512*a* is substantially equal to that of the tungsten conductive film 512*b*, so that the films are etched to a similar thickness.

By the first etching process, a first shape conductive film 515 composed of a lower layer 515*a* and an upper layer 515*b* and a first shape conductive film 516 composed of a lower layer 516*a* and an upper layer 516*b* are each formed. Note that the first etching process makes each side surface of the lower layers 515*a* and 516*a* and the upper layers 515*b* and 516*b* slightly tapered. In addition, as a result of etching so as not to leave residuals of the conductive films, the surface of the insulating film 511 which is not covered by the first shape conductive films 515 and 516 might be reduced in thickness by about 5 to 10 nm or more.

Next, as shown in FIG. 40B, the first shape conductive films 515 and 516 are etched (a second etching process) using the mask 514 whose surface is etched by the first etching process to be reduced in width. The ICP etching method is used in the second etching process as in the first etching process. A mixed gas of $Cl_2$, $SF_6$, and $O_2$ is used as an etching gas. The etching gas pressure in the chamber is 1.3 Pa. An RF (13.56 MHz) power of 700 W is applied to the coiled electrode to generate plasma. An RF (13.56 MHz) power of 10 W is applied to the substrate stage (lower electrode) so that self-bias voltage is applied to the substrate.

The addition of $O_2$ to the mixed gas of $SF_6$ and $Cl_2$ increases the etching rate of tungsten and dramatically decreases the etching rate of tantalum nitride contained in the lower layers 515*b* and 516*b* of the first shape conductive films 515 and 516, so that their etching selectivity is secured.

By the second etching process, a second shape conductive film 517 (a lower layer 517*a* and an upper layer 517*b*) and a second shape conductive film 518 (a lower layer 518*a* and an upper layer 518*b*) are formed. The width in the channel length direction of the upper layers 517*b* and 518*b* is smaller than that of the lower layers 517*a* and 518*a*. Note that by the second etching process, the surface of the insulating film 511 which is not covered by the second shape conductive films 517 and 518 is reduced in thickness by about 5 to 10 nm or more.

Next, as shown in FIG. 40B, an impurity which imparts n-type conductivity to the semiconductor films 509 and 510 is added using the second shape conductive films 517 and 518 as masks (a first doping process). An ion implantation method is used for the doping. The doping is performed under the conditions where the dosage is $1\times10^{13}/cm^2$ to $5\times10^{14}/cm^2$ and the accelerating voltage is in the range of from 40 kV to 80 kV. As an impurity element imparting n-type conductivity, an element belonging to Group 5 such as phosphorus (P), arsenic (As), or antimony (Sb); an element belonging to Group 6 such as sulfur (S), tellurium (Te), or selenium (Se); or the like which functions as a donor is used. In this embodiment, P is used. By the first doping process, impurity regions 520 and 521 are formed in a self-aligned manner. The impurity element imparting n-type conductivity is added to the impurity regions 520 and 521 at a concentration of $1\times10^{18}$ to $1\times10^{20}$ atoms/$cm^3$.

Next, as shown in FIG. 40C, a second doping process is performed using the upper layers 517*b* and 518*b* of the second shape conductive films 517 and 518 as masks. The acceleration voltage in the second doping process is higher than that in the first doping process so that an impurity is transmitted through the lower layers 517*a* and 518*a* of the second shape conductive films 517 and 518. In addition, in order to form an LDD region, the dosage of an n-type impurity in the second doping process is lower than that in the first doping process. Specifically, the acceleration voltage is 60 to 120 kV and the dosage is $1\times10^{13}$ to $1\times10^{15}$ atoms/$cm^3$.

After the second doping process, the acceleration voltage is lowered to perform a third doping process, so that the state shown in FIG. 40C is obtained. In the third doping process, the acceleration voltage is 50 to 100 kV and the dosage is $1\times10^{15}$ to $1\times10^{17}$ atoms/$cm^3$. By the second doping process and the third doping process, impurity regions 522 and 523 overlapping with the lower layers 517*a* and 518*a* of the second shape conductive films 517 and 518, and impurity regions 524 and 525 that are formed after the impurity is further added to the impurity regions 520 and 521. The impurity element imparting n-type conductivity is added to the impurity regions 522 and 523 in the concentration range of from $1\times10^{18}$ to $5\times10^{19}$ atoms/$cm^2$. The impurity element imparting n-type conductivity is added to the impurity regions 524 and 525 in the concentration range of from $1\times10^{19}$ to $5\times10^{21}$ atoms/$cm^2$.

The impurity regions 522 and 523 are formed on the inside of the impurity regions 524 and 525. The impurity regions 522 and 523 function as LDD regions. The impurity regions 524 and 525 function as source/drain regions.

Needless to say, the second doping process and the third doping process may be combined into one doping process by adjusting the acceleration voltage appropriately, so that a low-concentration impurity region and a high-concentration impurity region can be formed by one doping process.

Note that there is no need to dope the island-shaped semiconductor film 510, where a p-channel transistor is to be formed with an n-type impurity, by the second and third doping processes shown in FIGS. 40B and 40C; thus, the island-shaped semiconductor film 510 may be covered by a mask in doping an n-type impurity. In addition, in order to reduce the number of masks, a mask can be omitted, in which case the concentration of an impurity imparting p-type conductivity is increased to inverse the polarity of the island-shaped semiconductor film to p-type. In the description in this embodiment, the polarity of the island-shaped semiconductor film is inversed to p-type.

As shown in FIG. 40D, the n-type island-shaped semiconductor film 509 is covered by a resist mask 526, and the island-shaped semiconductor film 510 is doped with an impurity imparting p-type conductivity (this is a fourth doping process). In the fourth doping process, the upper layers 517*b* and 518*b* of the second shape conductive films 517 and 518 serve as masks, so that an impurity region 527 to which the impurity element imparting p-type conductivity is added is formed in the island-shaped semiconductor film 510, which is used in a p-channel transistor. In this embodiment, an ion doping method using diborane ($B_2H_6$) is performed. The concentration of impurity elements imparting p-type conductivity and n-type conductivity in regions of the impurity region 527 overlapping with the lower layers 517*a* and 518*a* of the second shape conductive films 517 and 518 is actually different from that in regions other than the regions. However, the doping process is conducted so that each region can have a concentration of the impurity element imparting p-type conductivity of $2\times10^{20}$ to $2\times10^{21}$ atoms/$cm^3$, which is higher than that of the impurity element imparting n-type conductivity; thus, there is no problem for the regions to serve as a source region and a drain region of the p-channel transistor.

By the aforementioned steps, impurity regions are formed in the island-shaped semiconductor films.

Figures 41A, 41B, 41C:
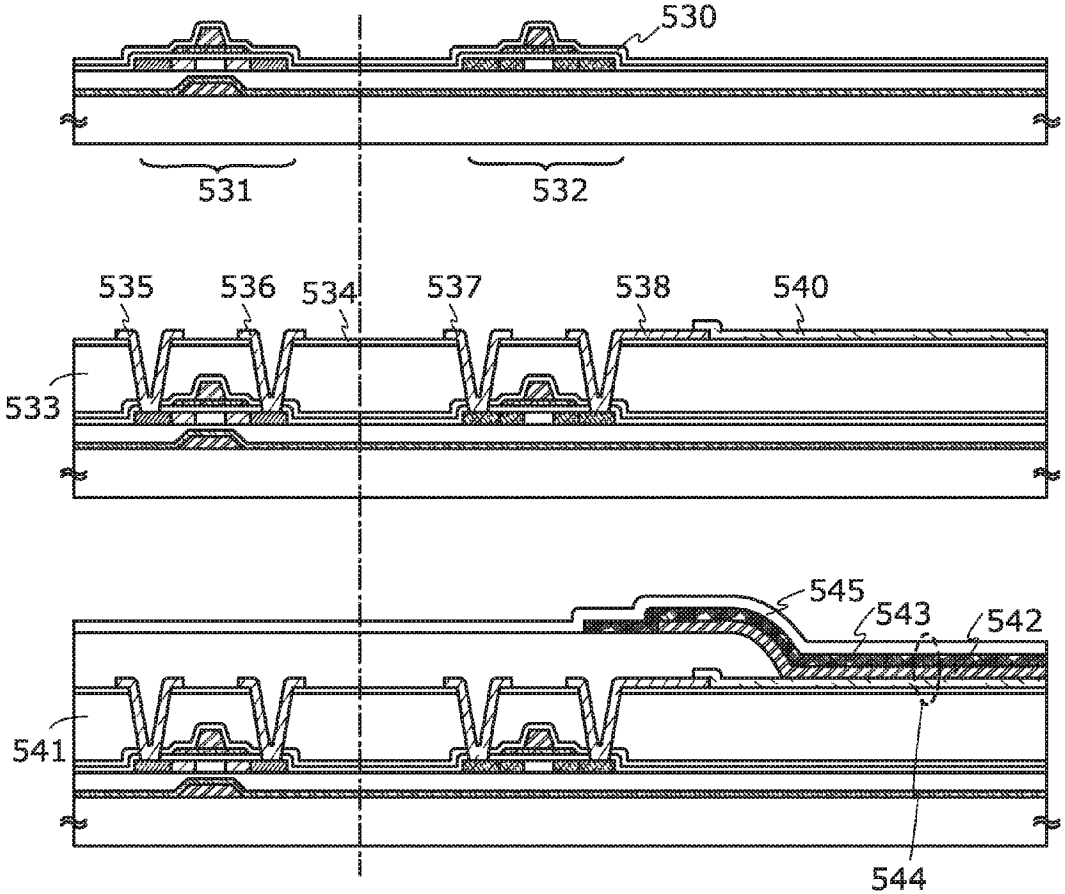
FIGS. 41A to 41C are cross-sectional views illustrating one embodiment of the present invention.

Next, an interlayer insulating film 530 is formed to cover the island-shaped semiconductor films 509 and 510, the insulating film 511, and the second shape conductive films 517 and 518 (FIG. 41A). The interlayer insulating film 530 can be formed of an insulating film containing silicon made of silicon oxide, silicon nitride, silicon oxynitride, or the like to have a thickness of about 100 to 200 nm.

Next, heat treatment is performed to activate the impurity elements which have been added into the island-shaped semiconductor films 509 and 510. This step can use a thermal annealing method using an annealing furnace, a laser annealing method, or a rapid thermal annealing method (an RTA method). For example, activation is performed by a thermal annealing method in a nitrogen atmosphere in which the oxygen concentration is 1 ppm or less, and preferably 0.1 ppm or less, at 400° C. to 700° C. (preferably 500° C. to 600° C.). Furthermore, hydrogenation of the island-shaped semiconductor films is performed by heat treatment at 300° C. to 450° C. for 1 to 12 hours in an atmosphere containing hydrogen at 3 to 100%. This step is performed for the purpose of termination of dangling bonds by thermally excited hydrogen. Alternatively, plasma hydrogenation (using hydrogen excited by plasma) may be performed for hydrogenation. The activation treatment may be performed before the interlayer insulating film 530 is formed.

Through the sequence of processes, an n-channel transistor 531 and a p-channel transistor 532 can be fabricated.

Although the entire impurity region 522 serving as an LDD region overlaps with the lower layers 517*a* and 518*a* of the second shape conductive films 517 and 518 in this embodiment, one embodiment of the present invention is not limited thereto. For example, a doping process is performed between the first etching process and the second etching process to form source/drain regions, and in addition, the lower layers are shortened in the channel length direction by the second etching process, thereby forming both regions overlapping with the lower layers 517*a* and 518*a* of the second shape conductive films 517 and 518 and regions other than the regions.

Note that methods other than the ICP etching method can also be used for the plasma etching without limitation, such as an electron cyclotron resonance (ECR) etching method, an RIE etching method, a helicon wave etching method, a helical resonance etching method, a pulse modulated etching method, or other plasma etching methods.

Although only crystallization using a catalyst element is used in the example, one embodiment of the present invention is not limited thereto. After the crystallization using a catalyst element, irradiation with pulse-oscillation laser light may be carried out to further increase the crystallinity. In addition, the gettering process is not limited to the method described in this embodiment. Another method may be used to decrease the concentration of the catalyst element in the semiconductor film.

Next, an interlayer insulating film 533 and an interlayer insulating film 534 are formed to cover the interlayer insulating film 530. In this embodiment, organic resin, such as nonphotosensitive acrylic, is used for the interlayer insulating film 533. A film used as the interlayer insulating film 534 penetrates a substance that can accelerate deterioration of an OLED, such as moisture or oxygen, in lesser amount than those of other insulating films. Typically, for example, it is desirable to use a DLC film, a carbon nitride film, a silicon nitride film formed by an RF sputtering method, or the like.

Next, the insulating film 511 and the interlayer insulating films 530, 533, and 534 are etched to form openings. Then, wirings 535 to 538 electrically connected to the island-shaped semiconductor films 509 and 510 are formed.

Next, a transparent conductive film covering the interlayer insulating film 534 and the wirings 535 to 538 is formed and patterned to be a pixel electrode (anode) 540 connected to the wiring 538 which is connected to the island-shaped semiconductor film 510 of the p-channel transistor 532 (FIG. 41B). As the transparent conductive film used for the pixel electrode 540, an ITO film or a transparent conductive film formed of a mixture of indium oxide and 2 to 20% of zinc oxide (ZnO) can be used. The surface of the pixel electrode 540 may be polished by a CMP method or by cleaning with a polyvinyl alcohol-based porous body. Furthermore, after the polishing by a CMP method, ultraviolet light irradiation, oxygen plasma treatment, and the like may be carried out on the surface of the pixel electrode 340.

Then, an organic resin film 541 used as a partition wall is formed over the interlayer insulating film 534. The organic resin film 541 includes an opening in a region overlapping with the pixel electrode 540. The organic resin film 541 is heated in a vacuum atmosphere to remove adsorbed moisture, oxygen, or the like before an electroluminescent layer is formed. Specifically, heat treatment is performed at a temperature of 100° C. to 200° C. for about 0.5 to 1 hour in a vacuum atmosphere. The pressure is preferably equal to or lower than $3\times10^{-7}$ Torr, and $3\times10^{-8}$ Torr or lower is the best if possible. In addition, in the case where the electroluminescent layer is formed after the organic resin film 341 is subjected to the heat treatment in a vacuum atmosphere, the vacuum atmosphere is maintained just before the formation of the electroluminescent layer; thus, the reliability can be further improved.

An end portion of the organic resin film 541 in the opening is preferably rounded so that the electroluminescent layer, which will be formed over the end portion, does not have a hole. Specifically, the radius of curvature of a curve drawn by a cross section of the organic insulating film 541 in the opening is desirably approximately 0.2 μm to 2 μm.

A positive photosensitive acrylic resin is used for the organic resin film 541 in the example shown in FIG. 41C. A photosensitive organic resin is classified into a positive type and a negative type. A portion subjected to exposure to energy-ray, such as light, electron, or ion, is removed in the former case and is left in the latter case. Such a negative photosensitive organic resin film may be used in the present invention. Alternatively, a photosensitive polyimide may be used for the organic resin film 541.

The end portion of the organic resin film 541 formed of a negative acrylic resin has an S-shape cross section in the opening. Each curvature radius of the upper and lower end portions of the opening is preferably 0.2 to 2 μm.

Such a structure enables the electroluminescent layer and a cathode, which are formed later, with good coverage and can prevent the short circuit between the pixel electrode 540 and the cathode in a hole formed in the electroluminescent layer. In addition, stress applied to the electroluminescent layer can be relieved, and occurrence of defects called shrink, that is, decrease in light-emitting area can be decreased, so that the reliability can be improved.

Next, a light-emitting layer 542 is formed over the pixel electrode 540. The electroluminescent layer 542 may be composed of a single layer or a plurality of layers and each layer may contain an inorganic material as well as an organic material.

Then, a cathode 543 is formed to cover the light-emitting layer 542. The cathode 543 can be formed of a conductive film composed of a known material with low work function. For example, Ca, Al, CaF, MgAg, or AlLi is preferably used.

The pixel electrode 540, the light-emitting layer 542, and the cathode 543 overlap with each other in the opening in the organic resin film 541, and this overlapping portion corresponds to a light-emitting element 544.

Next, a protective film 545 is formed over the organic resin film 541 and the cathode 543. Similarly to the interlayer insulating film 534, a film which is less likely to transmit a substance which accelerates deterioration of a light-emitting element, such as moisture or oxygen, than other insulating films is used as the protective film 545. Typical and preferred examples are a DLC film, a carbon nitride film, a silicon nitride film formed by an RF sputtering method, and the like. Alternatively, the film which is less likely to transmit the substance, such as moisture or oxygen, and a film which is more likely to transmit the substance, such as moisture or oxygen, than the former film may be stacked to be used as a protective film.

Note that, in FIG. 41C, a structure in which light emitted from the light-emitting element is emitted to the substrate 501 side is shown; however, a light-emitting element having a structure such that light is emitted to the side opposite to the substrate may be used.

In practice, when a process is completed up to and including FIG. 41C, packaging (filling and sealing) is preferably performed by using a protective film (a laminate film, an ultraviolet curable resin film, or the like) which has small degas and high airtightness so as not to be further exposed to the outside air, or a light-transmitting cover member. At that time, if the inside the member for covering is made an inert atmosphere or a hygroscopic material (e.g., barium oxide) is provided in the inside, reliability of the display device including the light-emitting element is improved.

By the above-described manufacturing method, a transistor including a backgate electrode and a light-emitting element over the transistor can be formed over one substrate.

<Pixel Layout Including Transistor>

FIGS. 42A to 46C show examples of top views and cross-sectional views of pixels including the transistors.

[Top View 1]

Figure 42A:
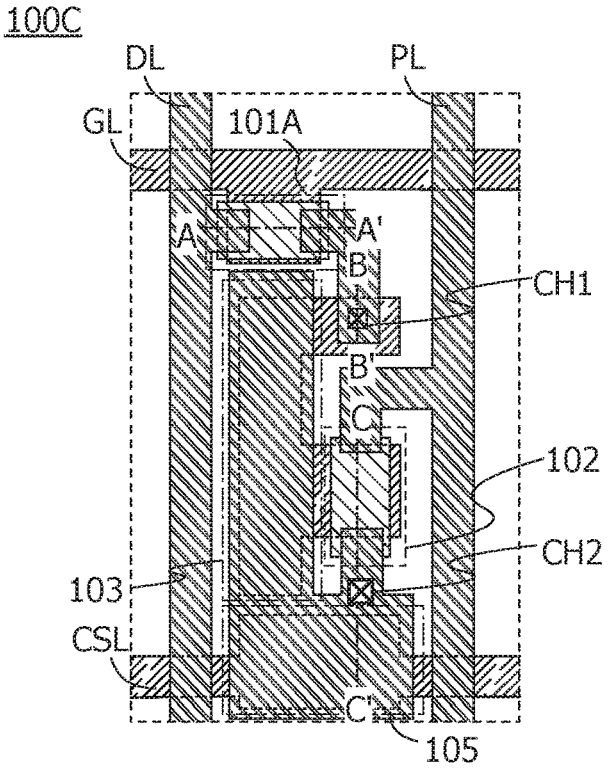
FIGS. 42A and 42B show layouts of one embodiment of the present invention.
Figure 42B:
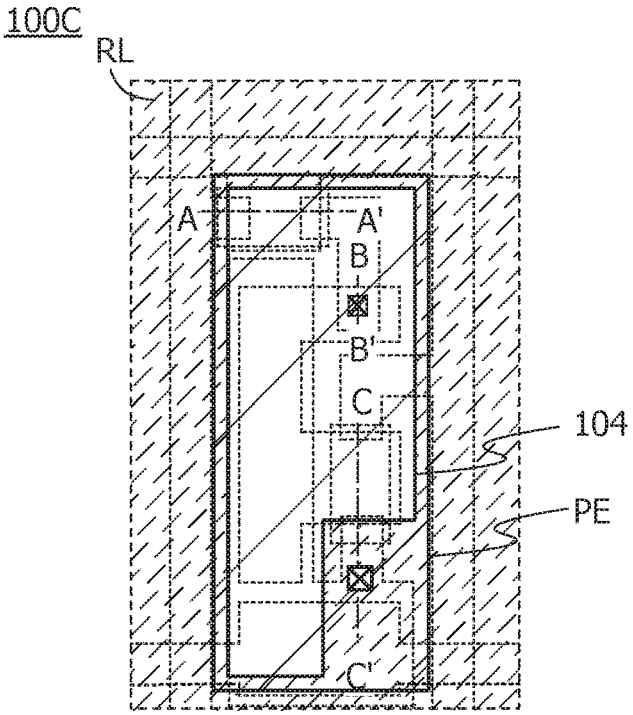

FIG. 42A shows an example of a top view of the pixel 100C which is shown in FIG. 8B. FIG. 42B shows the light-emitting element 104 stacked over the pixel 100C.

The top view of FIG. 42A shows the transistor 101A, the transistor 102, the capacitor 103, a capacitor 105, a gate line GL, a data line DL, a current supply line PL, a capacitor line CSL, an opening CH1, and an opening CH2.

The top view of FIG. 42B shows an electrode PE serving as the anode of the light-emitting element and a partition layer RL. Although the light-emitting layer and an electrode serving as the cathode of the light-emitting element are not shown, they are provided in an opening in the partition layer RL. Note that a region where the electrode PE, the light-emitting layer, and the electrode serving as the cathode of the light-emitting element corresponds to the light-emitting element 104.

Figure 43A:
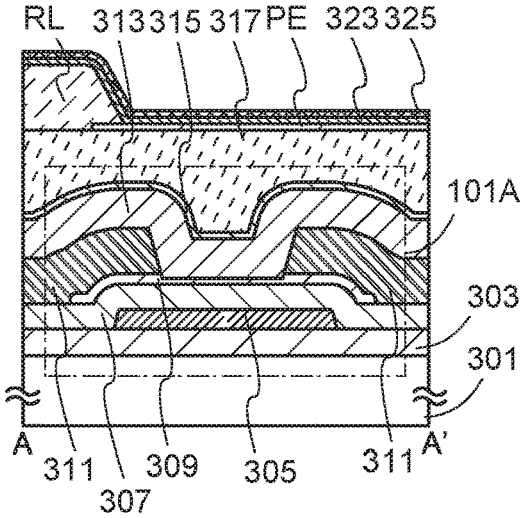
FIGS. 43A to 43C are schematic cross-sectional views illustrating one embodiment of the present invention.
Figure 43B:
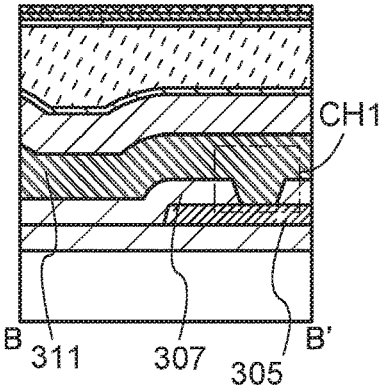
Figure 43C:
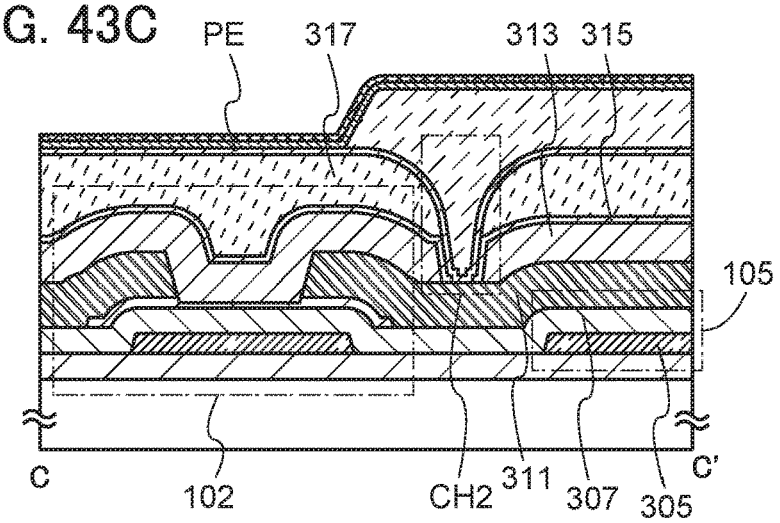

FIGS. 43A to 43C are schematic cross-sectional views taken along the dashed dotted lines A-A', B-B', and C-C' in the top views of FIGS. 42A and 42B.

FIGS. 43A to 43C show a substrate 301, an insulating film 303, a gate electrode 305, an insulating film 307, a semiconductor film 309, an electrode 311, an insulating film 313, an insulating film 315, an insulating film 317, the electrode PE, the partition layer RL, a light-emitting layer 323, an electrode 325, the opening CH1, and the opening CH2.

The insulating film 303 serves as a base film. The insulating film 307 functions as a gate insulating film. The electrodes 311 function as a source electrode and a drain electrode. The insulating film 317 functions as a planarization film. The electrode PE may serve as a reflective electrode. Note that the structure example 1 of the transistor can be referred to for the detailed structure of the transistor.

The opening CH1 is formed in the insulating film 307. The opening CH1 is an opening for connecting a layer including the gate electrode 305 and a layer including the electrode 311. The opening CH2 is formed in the insulating films 313, 315, and 317. The opening CH2 is an opening for connecting a layer including the electrode PE and the layer including the electrode 311.

Figure 44A:
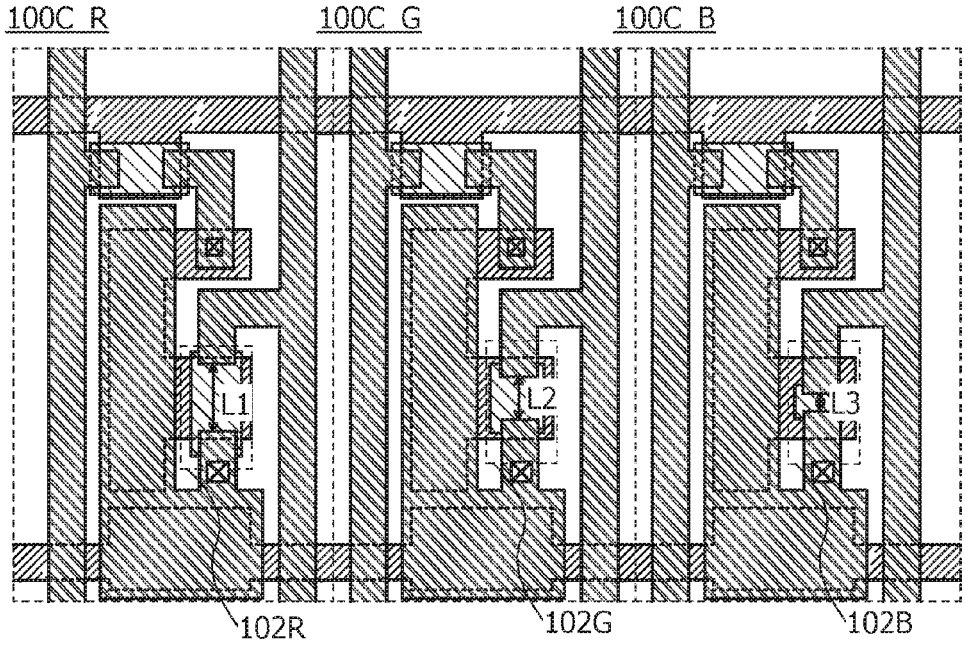
FIGS. 44A and 44B show layouts of one embodiment of the present invention.

Note that the size of the semiconductor film may depend on the emission color of the light-emitting element. For example, FIG. 44A shows a pixel 100C_R emitting red light, a pixel 100C_G emitting green light, and a pixel 100C_B emitting blue light. The pixel 100C_R emitting red light includes a transistor 102R. The pixel 100C_G emitting green light includes a transistor 102G. The pixel 100C_B emitting blue light includes a transistor 102B. Other components may be the same or different between the pixels.

The transistors 102R, 102G, and 102B have distances L1, L2, and L3, respectively, between the electrodes, in which case current flowing in the light-emitting element can be adjusted in the pixel in each color, providing a display device with high display quality.

Figure 44B:
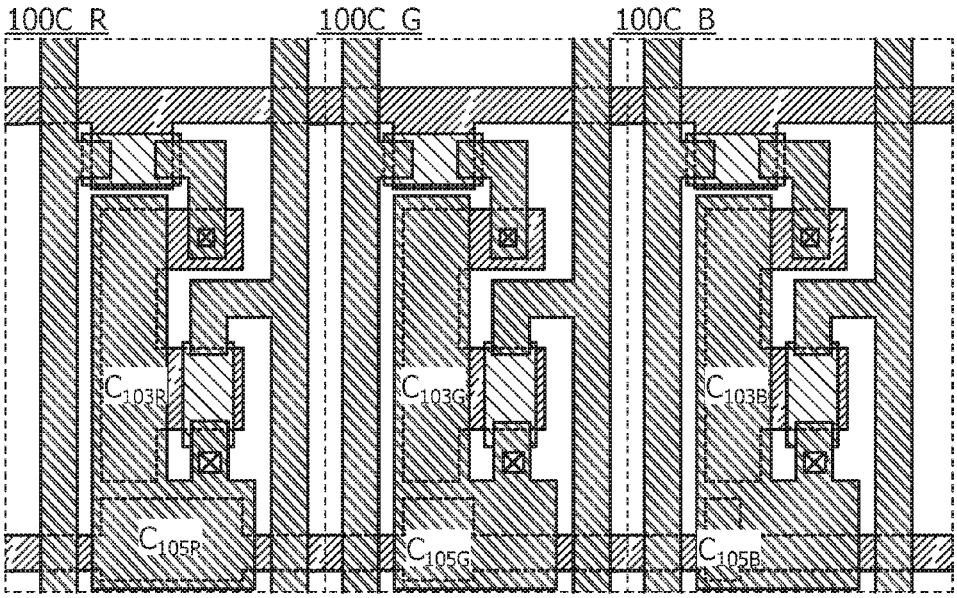

Note that the capacitance ratio of the capacitor 103 to the capacitor 105 depends on the emission color of the light-emitting element. FIG. 44B shows the pixel 100C_R emitting red light, the pixel 100C_G emitting green light, and the pixel 100C_B emitting blue light as in FIG. 44A.

The pixel 100C_R emitting red light includes a capacitor $C_{103R}$ where the layer including the gate electrode 305 overlaps with the layer including the electrode 311. The pixel 100C_R emitting red light includes a capacitor $C_{105R}$ where the layer including the gate electrode 305 overlaps with the layer including the electrode 311. The pixel 100C_G emitting green light includes a capacitor $C_{103G}$ and a capacitor $C_{105G}$. The pixel 100C_B emitting blue light includes a capacitor $C_{103B}$ and a capacitor $C_{105B}$.

As shown in FIG. 44B, the ratio in area of the capacitor $C_{103R}$ to the capacitor $C_{105R}$, that of the capacitor $C_{103G}$ to the capacitor $C_{105G}$, and that of the capacitor $C_{103B}$ to the capacitor $C_{105B}$ are preferably different from each other. As a result, the potential rise on the anode side of the light-emitting element in the data voltage writing period, which depends on the capacitance ratio, can be adjusted in each color. Thus, a display device with high display quality can be obtained.

[Top View 3]

Figure 45A:
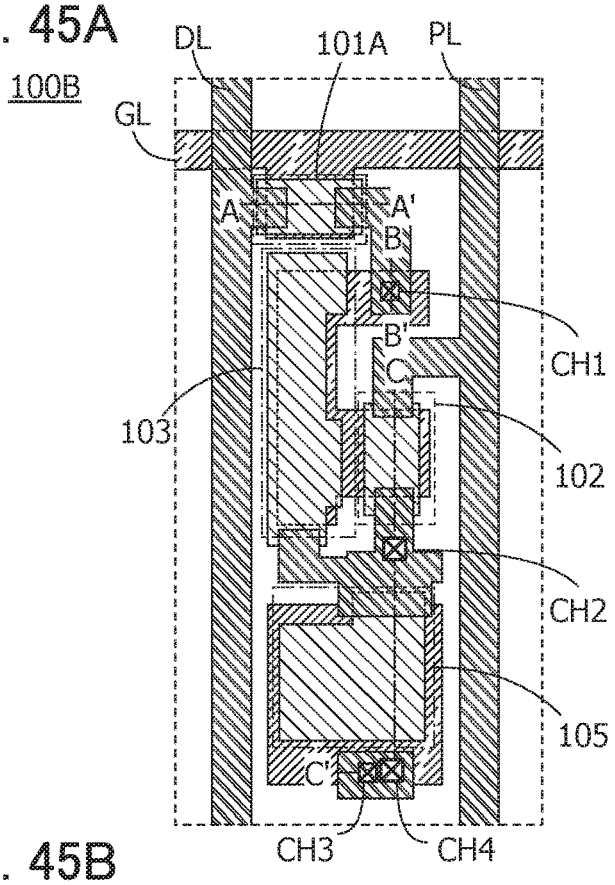
FIGS. 45A and 45B show layouts of one embodiment of the present invention.
Figure 45B:
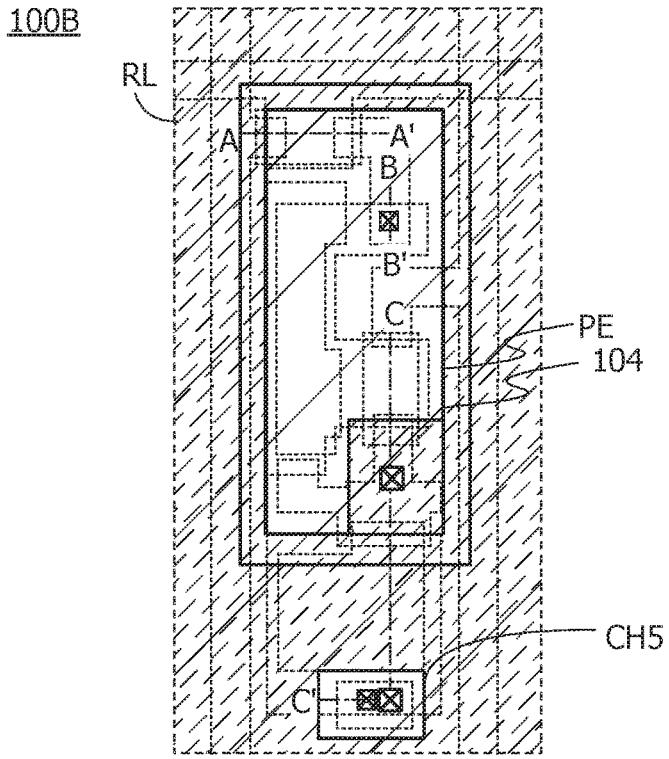

FIG. 45A shows an example of a top view of the pixel 100B which is shown in FIG. 8A. FIG. 45B shows the light-emitting element 104 stacked over the pixel 100B.

The top view of FIG. 45A shows the transistor 101A, the transistor 102, the capacitor 103, the capacitor 105, the gate line GL, the data line DL, the current supply line PL, the opening CH1, the opening CH2, an opening CH3, and an opening CH4.

The top view of FIG. 45B shows the electrode PE serving as the anode of the light-emitting element and the partition layer RL. Although the light-emitting layer and an electrode serving as the cathode of the light-emitting element are not shown, they are provided in an opening in the partition layer RL overlapping with the electrode PE. Note that a region where the electrode PE, the light-emitting layer, and the electrode serving as the cathode of the light-emitting element corresponds to the light-emitting element 104. In addition, in the top view of FIG. 45B, the opening in the partition layer RL is denoted by an opening CH5.

Figure 46A:
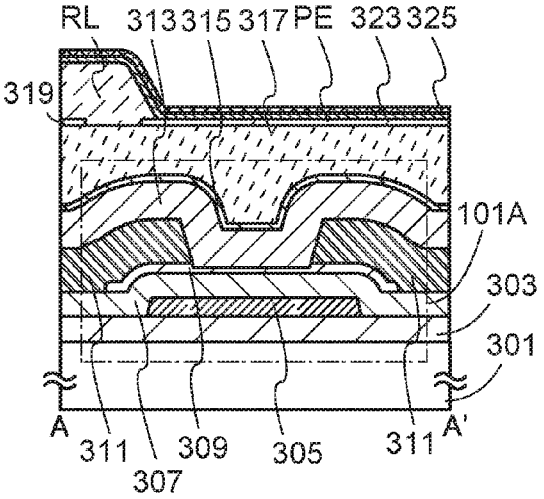
FIGS. 46A to 46C are schematic cross-sectional views illustrating one embodiment of the present invention.
Figure 46B:
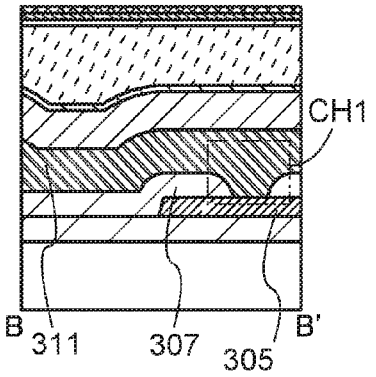
Figure 46C:
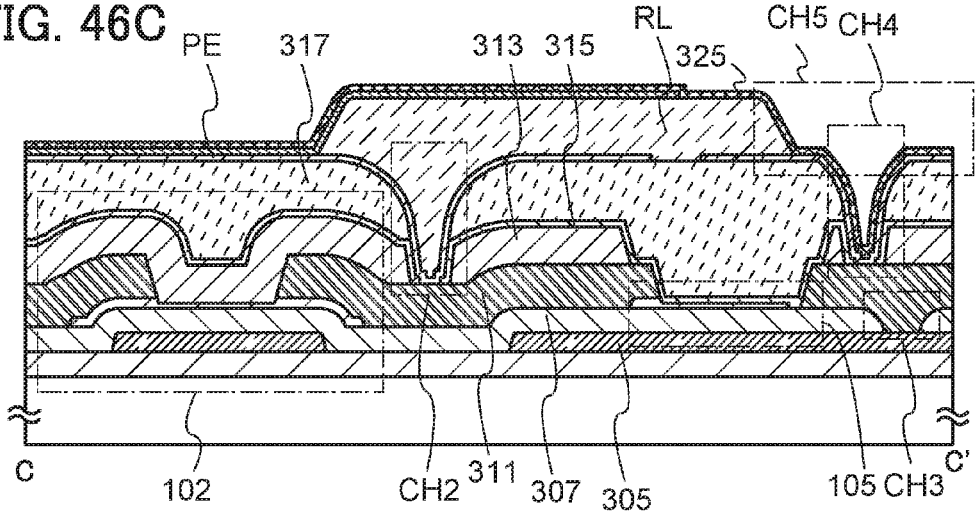

FIGS. 46A to 46C are schematic cross-sectional views taken along the dashed dotted lines A-A', B-B', and C-C' in the top views of FIGS. 45A and 45B.

FIGS. 46A to 46C show the substrate 301, the insulating film 303, the gate electrode 305, the insulating film 307, the semiconductor film 309, the electrode 311, the insulating film 313, the insulating film 315, the insulating film 317, the electrode PE, the partition layer RL, a light-emitting layer 323, the electrode 325, and the openings CH1, CH2, CH3, CH4, and CH5.

The insulating film 303 serves as a base film. The insulating film 307 functions as a gate insulating film. The electrodes 311 function as a source electrode and a drain electrode. The insulating film 317 functions as a planarization film. The electrode PE may serve as a reflective electrode. Note that the structure example 1 of the transistor can be referred to for the detailed structure of the transistor.

The opening CH1 is provided in the insulating film 303. The opening CH1 is an opening for connecting a layer including the gate electrode 305 and a layer including the electrode 311. The opening CH2 is provided in the insulating films 313, 315, and 317. The opening CH2 is an opening for connecting a layer including the electrode PE and the layer including the electrode 311. The opening CH3 is provided in the insulating film 303. The opening CH3 is an opening for connecting the layer including the gate electrode 305 and the layer including the electrode 311. The opening CH4 is provided in the insulating films 313, 315, and 317. The opening CH4 is an opening for connecting the layer including the electrode PE and the layer including the electrode 311. The opening CH5 is provided in the partition layer RL. The opening CH5 is an opening for connecting the layer including the electrode PE and the layer including the electrode 325.

Note that in the structures shown in the top views and the schematic cross-sectional views of FIGS. 45A to 46C, the size of the semiconductor film may be different between the emission colors of the light-emitting elements, as in FIG. 44A. In addition, in the structure shown in the top views and the schematic cross-sectional views of FIGS. 45A to 46C, the ratio in area of the capacitor 103 to the capacitor 105 may be different between the emission colors of the light-emitting elements, as in FIG. 44B.

Embodiment 3

In this embodiment, an example of a method for manufacturing a display device is described with reference to FIGS. 47A to 49D. In particular, a method for manufacturing a flexible display device is described in this embodiment.

<Manufacturing Method 1 of Display Device>

Figure 47A:
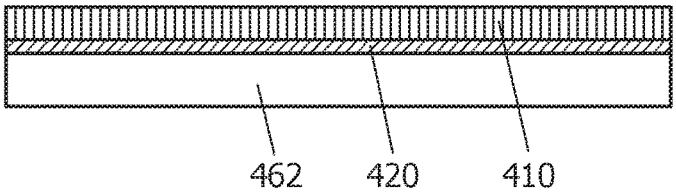
FIGS. 47A to 47D are cross-sectional views illustrating one embodiment of the present invention.
Figure 47B:
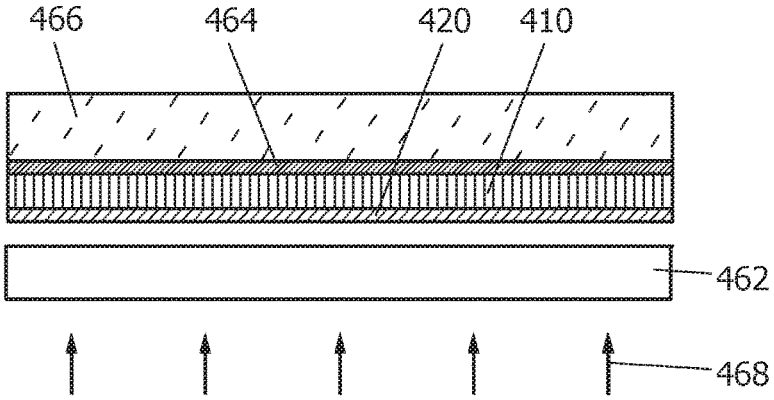

First, an insulating film 420 is formed over a substrate 462, and a first element layer 410 is formed over the insulating film 420 (see FIG. 47A). The first element layer 410 includes a semiconductor element. A display element or part of the display element such as a pixel electrode may also be included in the first element layer 410.

It is necessary that the substrate 462 have at least heat resistance high enough to withstand heat treatment performed later. For example, a glass substrate, a ceramic substrate, a quartz substrate, or a sapphire substrate may be used as the substrate 462.

In the case where a glass substrate is used as the substrate 462, an insulating film such as a silicon oxide film, a silicon oxynitride film, a silicon nitride film, or a silicon nitride oxide film is preferably formed between the substrate 462 and the insulating film 420, in which case contamination from the glass substrate can be prevented.

For the insulating film 420, an organic resin film of an epoxy resin, an aramid resin, an acrylic resin, a polyimide resin, a polyamide resin, a polyamide-imide resin, or the like can be used. Among them, a polyimide resin is preferably used because it has high heat resistance. For example, in the case where a polyimide resin is used for the insulating film 420, the thickness of the polyimide resin is greater than or equal to 3 nm and less than or equal to 20 μm, preferably greater than or equal to 500 nm and less than or equal to 2 μm. In the case where a polyimide resin is used for the insulating film 420, the insulating film 420 can be formed by a spin coating method, a dip coating method, a doctor blade method, or the like. In the case where a polyimide resin is used for the insulating film 420, for example, the insulating film 420 with a desired thickness can be obtained by removing an excess part of the polyimide resin film by a doctor blade method.

Note that formation temperatures of the first element layer 410 are preferably higher than or equal to room temperature and lower than or equal to 300° C. For example, the deposition temperature of an insulating film or a conductive film which is formed in the first element layer 410 using an inorganic material is higher than or equal to 150° C. and lower than or equal to 300° C., preferably higher than or equal to 200° C. and lower than or equal to 270° C. Furthermore, an insulating film or the like formed in the first element layer 410 using an organic resin material is preferably formed at a temperature higher than or equal to room temperature and lower than or equal to 100° C.

The above-described CAAC-OS is preferably used for the oxide semiconductor film of the transistor included in the first element layer 410. In the case where the CAAC-OS is used for the oxide semiconductor film of the transistor, for example, when the light-emitting device 400 is bent, a crack or the like is less likely to be generated in the channel region, resulting in high resistance against bending.

Indium tin oxide to which silicon oxide is added is preferably used for the conductive film included in the first element layer 410 because a crack is less likely to be generated in the conductive film when the light-emitting device 400 is bent.

Next, the first element layer 410 and a temporary supporting substrate 466 are attached with an adhesive 464 for separation, and then the insulating film 420 and the first element layer 410 are separated from the substrate 462. The temporary supporting substrate 466 is thus provided with the insulating film 420 and the first element layer 410 (see FIG. 47B).

As the temporary supporting substrate 466, a glass substrate, a quartz substrate, a sapphire substrate, a ceramic substrate, a metal substrate, or the like can be used. Alternatively, a plastic substrate that can withstand a processing temperature of this embodiment may be used, or a flexible film-like substrate may be used.

An adhesive with which the temporary supporting substrate 466 and the element layer 410 can be chemically or physically separated when necessary, such as an adhesive that is soluble in water or a solvent or an adhesive which is capable of being plasticized upon irradiation of UV light or the like, is used as the adhesive 464 for separation.

Any of various methods can be used as appropriate as the process for transferring the components to the temporary supporting substrate 466. For example, the substrate 462 and the insulating film 420 can be separated from each other in such a manner that the insulating film 420 is irradiated with laser light 468 from a side of the substrate 462 where the insulating film 420 is not formed, i.e., from the bottom side in FIG. 47B to make the insulating film 420 weak. Furthermore, a region where adhesion between the substrate 462 and the insulating film 420 is low and a region where adhesion between the substrate 462 and the insulating film 420 is high may be formed by adjustment of the irradiation energy density of the laser light 468, and then the substrate 462 and the insulating film 420 may be separated.

Although the method in which separation is caused at the interface between the substrate 462 and the insulating film 420 is described, one embodiment of the present invention is not limited thereto. For example, separation may be caused at the interface between the insulating film 420 and the first element layer 410.

The insulating film 420 may be separated from the substrate 462 by filling the interface between the substrate 462 and the insulating film 420 with a liquid. Alternatively, the first element layer 410 may be separated from the insulating film 420 by filling the interface between the insulating film 420 and the first element layer 410 with a liquid. As the liquid, water, a polar solvent, or the like can be used, for example. The interface along which the insulating film 420 is separated, specifically, the interface between the substrate 462 and the insulating film 420 or the interface between the insulating film 420 and the first element layer 410 is filled with a liquid, whereby an influence of static electricity and the like which are generated owing to the separation and applied to the first element layer 410 can be reduced.

Figure 47C:
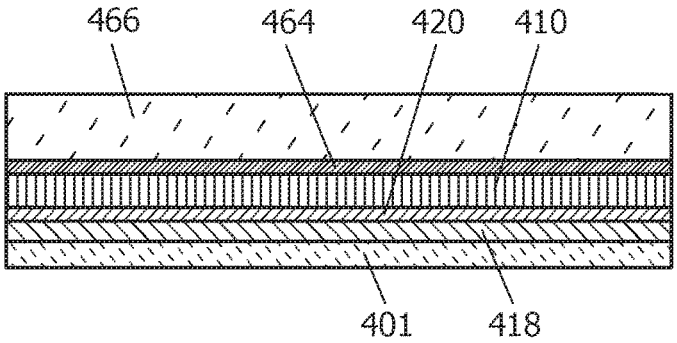

Next, the first substrate 401 is attached to the insulating film 420 using the adhesive layer 418 (see FIG. 47C).

Figure 47D:
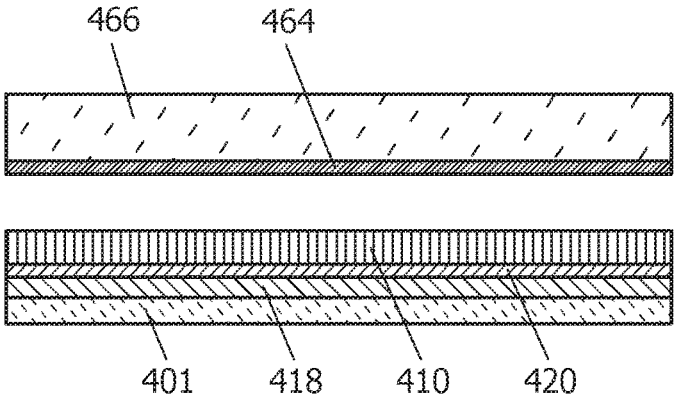

Then, the adhesive 464 for separation and the temporary supporting substrate 466 are removed from the first element layer 410 by dissolving or plasticizing the adhesive 464 for separation (see FIG. 47D).

Note that the adhesive 464 for separation is preferably removed by water, a solvent, or the like to expose the surface of the first element layer 410.

Through the above process, the first element layer 410 can be formed over the first substrate 401.

Figure 48A:
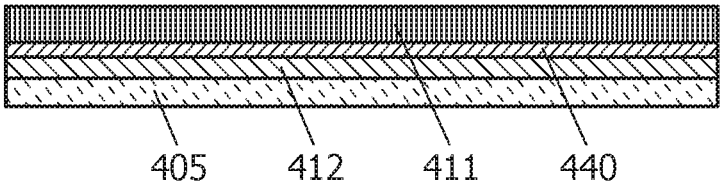
FIGS. 48A and 48B are cross-sectional views illustrating one embodiment of the present invention.

Next, the second substrate 405, the adhesive layer 412 over the second substrate 405, the insulating film 440 over the adhesive layer 412, and the second element layer 411 are formed by a process similar to that illustrated in FIGS. 47A to 47D (see FIG. 48A).

The insulating film 440 included in the second element layer 411 can be formed using a material similar to that of the insulating film 420, here, using an organic resin film.

Figure 48B:
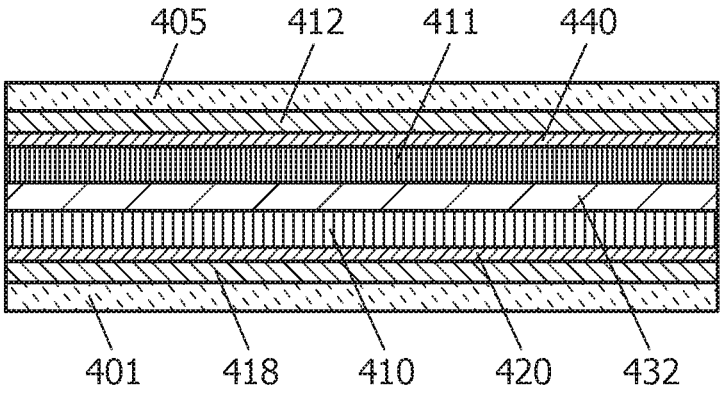

Next, a space between the first element layer 410 and the second element layer 411 is filled with the sealing layer 432 to attach the first element layer 410 and the second element layer 411 (see FIG. 48B).

With the sealing layer 432, for example, solid sealing is possible. Note that the sealing layer 432 preferably has flexibility. For example, a glass material such as a glass frit, or a resin that is curable at room temperature such as a two-component type resin, a light curable resin, a heat-curable resin, and the like can be used for the sealing layer 432.

In the above-described manner, the light-emitting device 400 can be manufactured.

<Manufacturing Method 2 of Light-Emitting Device>

Another method for manufacturing the light-emitting device 400 which is one embodiment of the present invention will be described with reference to FIGS. 49A to 49D. Note that an inorganic insulating film is used as the insulating films 420 and 440 FIGS. 49A to 49D.

First, a separation layer 463 is formed over the substrate 462. Then, the insulating film 420 is formed over the separation layer 463, and the first element layer 410 is formed over the insulating film 420 (see FIG. 49A).

The separation layer 463 can have a single-layer structure or a stacked-layer structure containing an element selected from tungsten, molybdenum, titanium, tantalum, niobium, nickel, cobalt, zirconium, zinc, ruthenium, rhodium, palladium, osmium, iridium, and silicon; an alloy material containing any of the elements; or a compound material containing any of the elements, for example. In the case of a layer containing silicon, a crystal structure of the layer containing silicon may be amorphous, microcrystal, polycrystal, or single crystal The separation layer 463 can be formed by a sputtering method, a PE-CVD method, a coating method, a printing method, or the like. Note that a coating method includes a spin coating method, a droplet discharge method, and a dispensing method.

In the case where the separation layer 463 has a single-layer structure, a tungsten layer, a molybdenum layer, or a layer containing a mixture of tungsten and molybdenum is preferably formed. Alternatively, a layer containing an oxide or an oxynitride of tungsten, a layer containing an oxide or an oxynitride of molybdenum, or a layer containing an oxide or an oxynitride of a mixture of tungsten and molybdenum may be formed. Note that a mixture of tungsten and molybdenum is an alloy of tungsten and molybdenum, for example.

When the separation layer 463 has a stacked-layer structure including a layer containing tungsten and a layer containing an oxide of tungsten, it may be utilized that the layer containing tungsten is formed first and an insulating layer formed of oxide is formed thereover so that a layer containing an oxide of tungsten is formed at the interface between the tungsten layer and the insulating layer. Alternatively, the layer containing an oxide of tungsten may be formed by performing thermal oxidation treatment, oxygen plasma treatment, nitrous oxide ($N_2O$) plasma treatment, treatment with a highly oxidizing solution such as ozone water, or the like on the surface of the layer containing tungsten. Plasma treatment or heat treatment may be performed in an atmosphere of oxygen, nitrogen, or nitrous oxide alone, or a mixed gas of any of these gasses and another gas. Surface condition of the separation layer 463 is changed by the plasma treatment or heat treatment, whereby adhesion between the separation layer 463 and the insulating film 420 formed later can be controlled.

The insulating film 420 can be formed using an inorganic insulating film with low moisture permeability, such as a silicon oxide film, a silicon nitride film, a silicon oxynitride film, a silicon nitride oxide film, or an aluminum oxide film. The inorganic insulating film can be formed by a sputtering method or a PE-CVD method, for example.

Next, the first element layer 410 and a temporary supporting substrate 466 are attached with an adhesive 464 for separation, and then the insulating film 420 and the first element layer 410 are separated from the separation layer 463. Thus, the temporary supporting substrate 466 is provided with the insulating film 420 and the first element layer 410 (see FIG. 49B).

Any of various methods can be used as appropriate as the process for transferring the layer to the temporary supporting substrate 466. For example, in the case where a layer including a metal oxide film is formed at the interface between the separation layer 463 and the insulating film 420, the metal oxide film is made to be weakened by crystallization, so that the insulating film 420 can be separated from the separation layer 463. Alternatively, in the case where the separation layer 463 is formed using a tungsten film, separation is performed in such a manner that the tungsten film is etched using a mixed solution of ammonia water and a hydrogen peroxide solution.

The insulating film 420 may be separated from the separation layer 463 by filling the interface between the separation layer 463 and the insulating film 420 with a liquid. As the liquid, water, a polar solvent, or the like can be used, for example. The interface along which the insulating film 420 is separated, specifically, the interface between the separation layer 463 and the insulating film 420 is filled with a liquid, whereby an influence of static electricity and the like which are generated owing to the separation and applied to the first element layer 410 can be reduced.

Figure 49A:
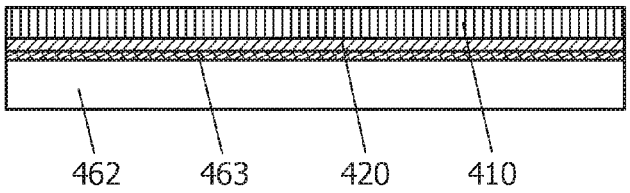
FIGS. 49A to 49D are cross-sectional views illustrating one embodiment of the present invention.
Figure 49B:
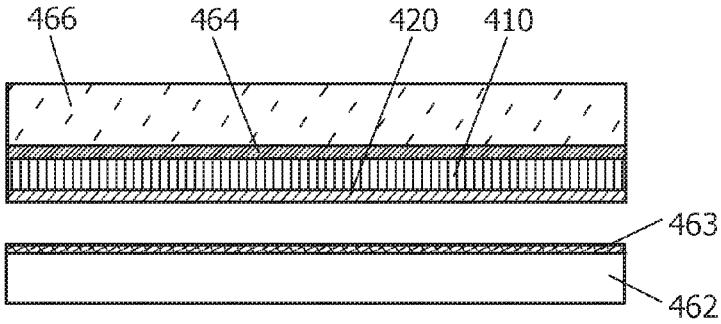
Figure 49C:
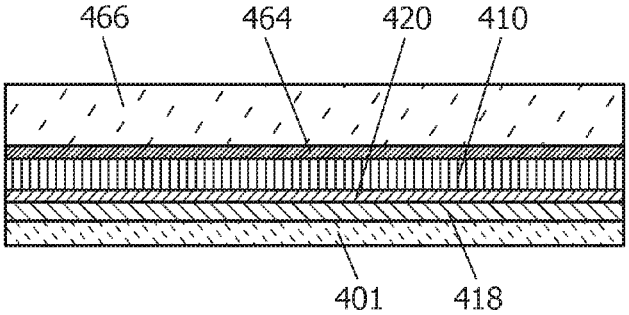

Next, the first substrate 401 is attached to the insulating film 420 using the adhesive layer 418 (see FIG. 49C).

Figure 49D:
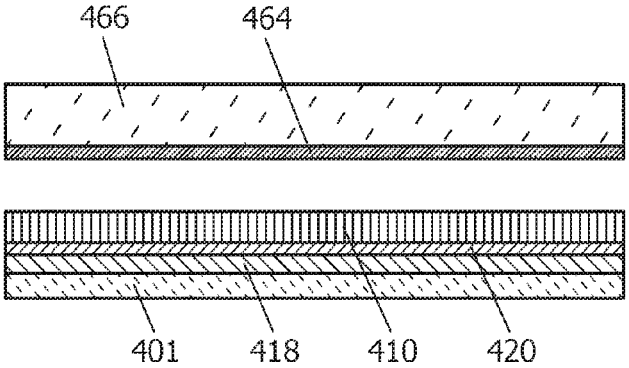

Then, the adhesive 464 for separation and the temporary supporting substrate 466 are removed from the first element layer 410 by dissolving or plasticizing the adhesive 464 for separation (see FIG. 49D).

Note that the adhesive 464 for separation is preferably removed by water, a solvent, or the like to expose the surface of the first element layer 410.

Through the above process, the first element layer 410 can be formed over the first substrate 401.

Next, the second substrate 405, the adhesive layer 412 over the second substrate 405, the insulating film 440 over the adhesive layer 412, and the second element layer 411 are formed by a process similar to that illustrated in FIGS. 49A to 49D. After that, a space between the first element layer 410 and the second element layer 411 is filled with the sealing layer 432, so that the first element layer 410 and the second element layer 411 are attached to each other.

Finally, the anisotropic conductive film 380 and the FPC 408 are attached to the connection electrode 360. An IC chip or the like may be mounted if necessary.

Through the above process, the display device 400 can be manufactured.

Embodiment 4

In this embodiment, a display device of one embodiment of the present invention and an electronic device in which the display device is provided with an input device will be described with reference to FIGS. 50A and 50B, FIGS. 51A and 51B, FIG. 52, FIGS. 53A and 53B, FIGS. 54A and 54B, and FIG. 55.

<Touch Panel>

In this embodiment, a touch panel 2000 including a display device and an input device will be described as an example of an electronic device. In addition, an example in which a touch sensor is used as an input device will be described.

Figure 50A:
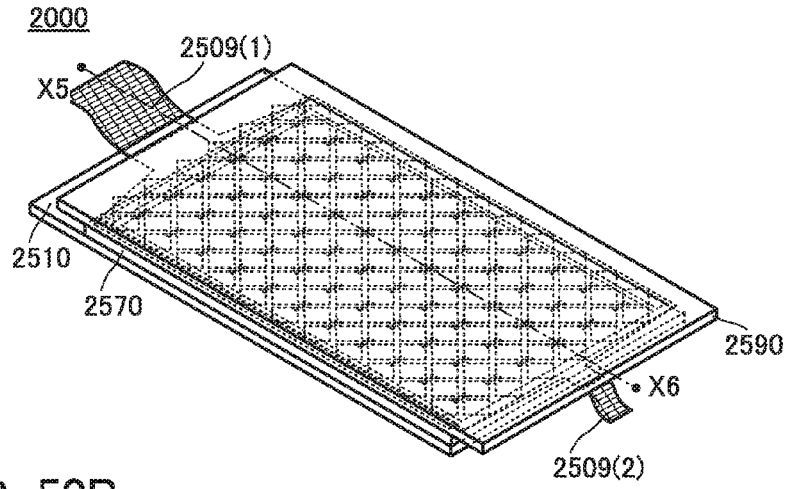
FIGS. 50A to 50B are perspective views illustrating one embodiment of the present invention.
Figure 50B:
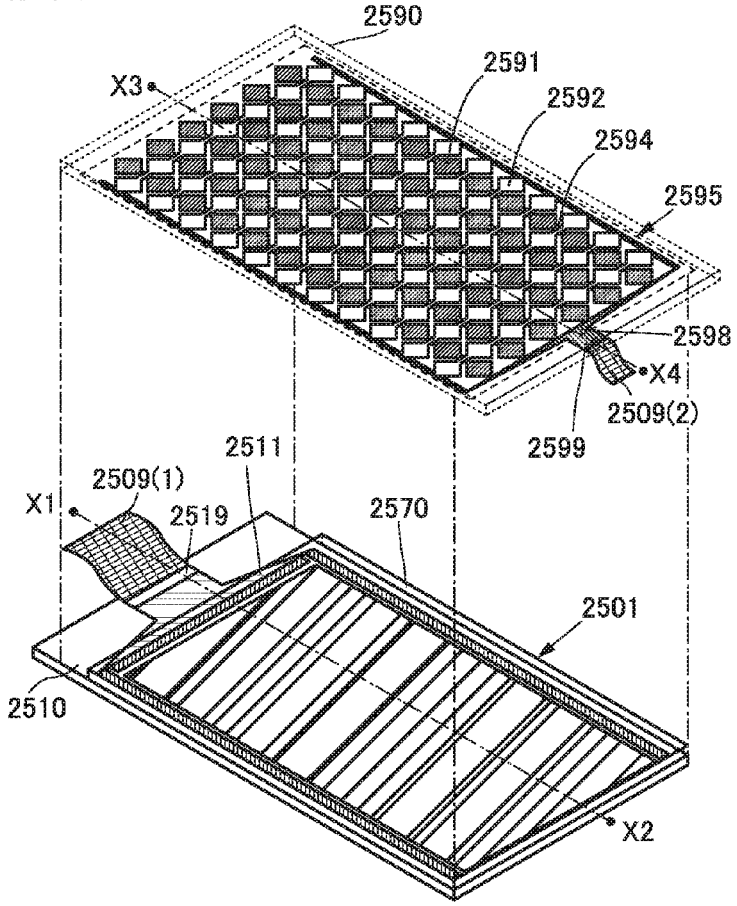

FIGS. 50A and 50B are perspective views of the touch panel 2000. Note that FIGS. 50A and 50B illustrate only main components of the touch panel 2000 for simplicity.

The touch panel 2000 includes a display device 2501 and a touch sensor 2595 (see FIG. 50B). The touch panel 2000 also includes a substrate 2510, a substrate 2570, and a substrate 2590. The substrate 2510, the substrate 2570, and the substrate 2590 each have flexibility. Note that one or all of the substrates 2510, 2570, and 2590 may be inflexible.

The display device 2501 includes a plurality of pixels over the substrate 2510 and a plurality of wirings 2511 through which signals are supplied to the pixels. The plurality of wirings 2511 are led to a peripheral portion of the substrate 2510, and parts of the plurality of wirings 2511 form a terminal 2519. The terminal 2519 is electrically connected to an FPC 2509(1).

The substrate 2590 includes the touch sensor 2595 and a plurality of wirings 2598 electrically connected to the touch sensor 2595. The plurality of wirings 2598 are led to a peripheral portion of the substrate 2590, and parts of the plurality of wirings 2598 form a terminal. The terminal is electrically connected to an FPC 2509(2). Note that in FIG. 50B, electrodes, wirings, and the like of the touch sensor 2595 provided on the back side of the substrate 2590 (the side facing the substrate 2510) are indicated by solid lines for clarity.

As the touch sensor 2595, a capacitive touch sensor can be used. Examples of the capacitive touch sensor are a surface capacitive touch sensor and a projected capacitive touch sensor.

Examples of the projected capacitive touch sensor are a self capacitive touch sensor and a mutual capacitive touch sensor, which differ mainly in the driving method. The use of a mutual capacitive type is preferable because multiple points can be sensed simultaneously.

Note that the touch sensor 2595 illustrated in FIG. 50B is an example of using a projected capacitive touch sensor.

Note that a variety of sensors that can sense proximity or touch of a sensing target such as a finger can be used as the touch sensor 2595.

The projected capacitive touch sensor 2595 includes electrodes 2591 and electrodes 2592. The electrodes 2591 are electrically connected to any of the plurality of wirings 2598, and the electrodes 2592 are electrically connected to any of the other wirings 2598.

The electrodes 2592 each have a shape of a plurality of quadrangles arranged in one direction with one corner of a quadrangle connected to one corner of another quadrangle as illustrated in FIGS. 50A and 50B.

The electrodes 2591 each have a quadrangular shape and are arranged in a direction intersecting with the direction in which the electrodes 2592 extend.

A wiring 2594 electrically connects two electrodes 2591 between which the electrode 2592 is positioned. The intersecting area of the electrode 2592 and the wiring 2594 is preferably as small as possible. Such a structure allows a reduction in the area of a region where the electrodes are not provided, reducing variation in transmittance. As a result, variation in luminance of light passing through the touch sensor 2595 can be reduced.

Note that the shapes of the electrodes 2591 and the electrodes 2592 are not limited thereto and can be any of a variety of shapes. For example, a structure may be employed in which the plurality of electrodes 2591 are arranged so that gaps between the electrodes 2591 are reduced as much as possible, and the electrodes 2592 are spaced apart from the electrodes 2591 with an insulating layer interposed therebetween to have regions not overlapping with the electrodes 2591. In this case, it is preferable to provide, between two adjacent electrodes 2592, a dummy electrode electrically insulated from these electrodes because the area of regions having different transmittances can be reduced.

Note that as a material of the conductive films such as the electrodes 2591, the electrodes 2592, and the wirings 2598, that is, wirings and electrodes forming the touch panel, a transparent conductive film containing indium oxide, tin oxide, zinc oxide, or the like (e.g., ITO) can be given. For example, a low-resistance material is preferably used as a material that can be used as the wirings and electrodes forming the touch panel. For example, silver, copper, aluminum, a carbon nanotube, graphene, or a metal halide (such as a silver halide) may be used. Alternatively, a metal nanowire including a plurality of conductors with an extremely small width (for example, a diameter of several nanometers) may be used. Further alternatively, a net-like metal mesh with a conductor may be used. For example, an Ag nanowire, a Cu nanowire, an Al nanowire, an Ag mesh, a Cu mesh, or an Al mesh may be used. For example, in the case of using an Ag nanowire as the wirings and electrodes forming the touch panel, a visible light transmittance of 89% or more and a sheet resistance of 40 Ω/cm2 or more and 100 Ω/cm2 or less can be achieved. Since the above-described metal nanowire, metal mesh, carbon nanotube, graphene, and the like, which are examples of the material that can be used as the wirings and electrodes forming the touch panel, have high visible light transmittances, they may be used as electrodes of display elements (e.g., a pixel electrode or a common electrode).

<Display Device>

Figure 51A:
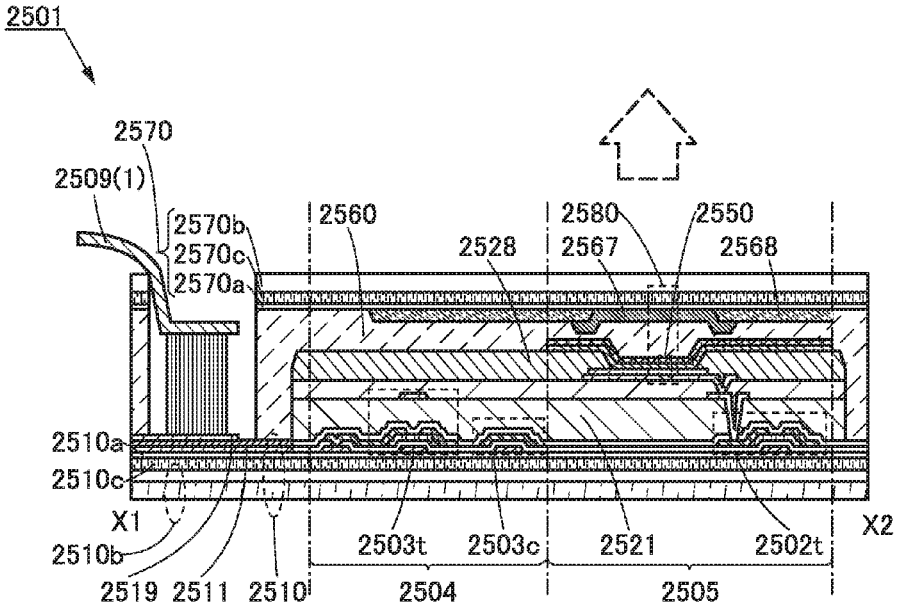
FIGS. 51A and 51B are cross-sectional views illustrating one embodiment of the present invention.
Figure 51B:
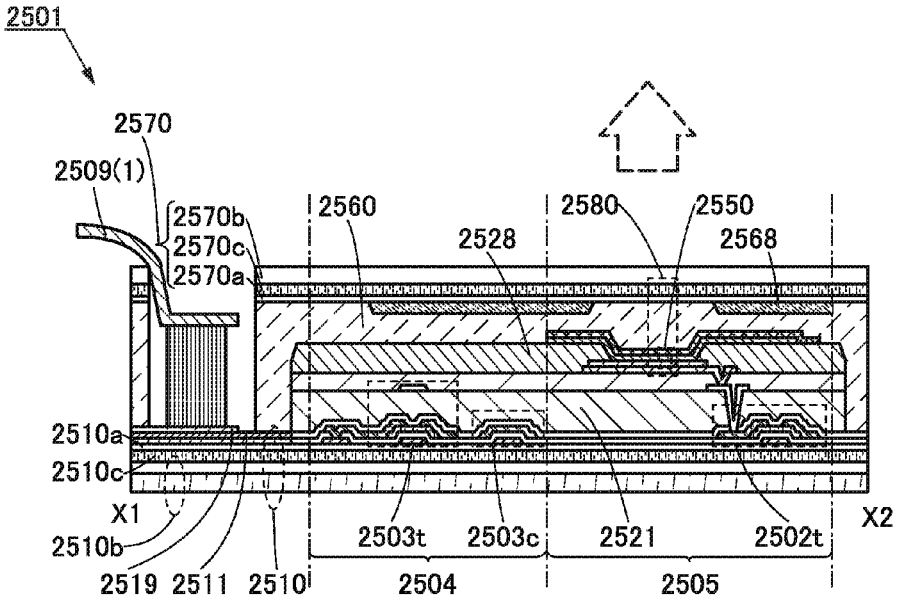

Next, the display device 2501 will be described in detail with reference to FIGS. 51A and 51B. FIGS. 51A and 51B correspond to cross-sectional views taken along dashed-dotted line X1-X2 in FIG. 50B.

The display device 2501 includes a plurality of pixels arranged in a matrix. Each of the pixels includes a display element and a pixel circuit for driving the display element.

In the cross-sectional view of FIG. 51A, an example of using an EL element that emits white light as a display element will be described; however, the EL element is not limited to such element. For example, as shown in FIG. 51B, EL elements that emit light of different colors may be included so that the light of different colors can be emitted from adjacent pixels. In the description below, a non-limiting example of using an EL element that emits white light as a display element will be described For the substrate 2510 and the substrate 2570, for example, a flexible material with a vapor permeability of lower than or equal to $1\times10^{-5}$ g/(m$^2$·day), preferably lower than or equal to $1\times10^{-6}$ g/(m$^2$·day) can be favorably used. Alternatively, materials whose thermal expansion coefficients are substantially equal to each other are preferably used for the substrate 2510 and the substrate 2570. For example, the coefficients of linear expansion of the materials are preferably lower than or equal to $1\times10^{-3}$/K, further preferably lower than or equal to $5\times10^{-5}$/K, and still further preferably lower than or equal to $1\times10^{-5}$/K.

Note that the substrate 2510 is a stacked body including an insulating layer 2510*a* for preventing impurity diffusion into the EL element, a flexible substrate 2510*b*, and an adhesive layer 2510*c* for attaching the insulating layer 2510*a* and the flexible substrate 2510*b* to each other. The substrate 2570 is a stacked body including an insulating layer 2570*a* for preventing impurity diffusion into the EL element, a flexible substrate 2570*b*, and an adhesive layer 2570*c* for attaching the insulating layer 2570*a* and the flexible substrate 2570*b* to each other.

For the adhesive layer 2510*c* and the adhesive layer 2570*c*, for example, polyester, polyolefin, polyamide (e.g., nylon, aramid), polyimide, polycarbonate, polyurethane, an acrylic resin, an epoxy resin, or a resin having a siloxane bond can be used.

A sealing layer 2560 is provided between the substrate 2510 and the substrate 2570. The sealing layer 2560 preferably has a refractive index higher than that of air. In the case where light is extracted to the sealing layer 2560 side as illustrated in FIG. 51A, the sealing layer 2560 can also serve as an optical element.

A sealant may be formed in the peripheral portion of the sealing layer 2560. With the use of the sealant, an EL element 2550 can be provided in a region surrounded by the substrate 2510, the substrate 2570, the sealing layer 2560, and the sealant. Note that an inert gas (such as nitrogen or argon) may be used instead of the sealing layer 2560. A drying agent may be provided in the inert gas so as to adsorb moisture or the like. For example, an epoxy-based resin or a glass frit is preferably used as the sealant. As a material used for the sealant, a material which is impermeable to moisture or oxygen is preferably used.

The display device 2501 illustrated in FIG. 51A includes a pixel 2505. The pixel 2505 includes a light-emitting module 2580, the EL element 2550 and a transistor 2502*t* that can supply electric power to the EL element 2550. Note that the transistor 2502*t* functions as part of the pixel circuit.

The light-emitting module 2580 includes the EL element 2550 and a coloring layer 2567. The EL element 2550 includes a lower electrode, an upper electrode, and an EL layer between the lower electrode and the upper electrode.

In the case where the sealing layer 2560 is provided on the light extraction side, the sealing layer 2560 is in contact with the EL element 2550 and the coloring layer 2567. Note that the coloring layer 2567 can be omitted as shown in FIG. 51B when emission colors from EL elements differ from pixel to pixel.

The coloring layer 2567 is positioned in a region overlapping with the EL element 2550. Accordingly, part of light emitted from the EL element 2550 passes through the coloring layer 2567 and is emitted to the outside of the light-emitting module 2580 as indicated by an arrow in FIG. 51A.

The display device 2501 includes a light-blocking layer 2568 on the light extraction side. The light-blocking layer 2568 is provided so as to surround the coloring layer 2567.

The coloring layer 2567 is a coloring layer having a function of transmitting light in a particular wavelength region. For example, a color filter for transmitting light in a red wavelength range, a color filter for transmitting light in a green wavelength range, a color filter for transmitting light in a blue wavelength range, a color filter for transmitting light in a yellow wavelength range, or the like can be used. Each color filter can be formed with any of various materials by a printing method, an inkjet method, an etching method using a photolithography technique, or the like.

An insulating layer 2521 is provided in the display device 2501. The insulating layer 2521 covers the transistor 2502*t* and the like. Note that the insulating layer 2521 has a function of covering the roughness caused by the pixel circuit to provide a flat surface. The insulating layer 2521 may have a function of suppressing impurity diffusion. This can prevent the reliability of the transistor 2502*t* or the like from being lowered by impurity diffusion.

The EL element 2550 is formed over the insulating layer 2521. A partition 2528 is provided so as to overlap with an end portion of the lower electrode of the EL element 2550. Note that a spacer for controlling the distance between the substrate 2510 and the substrate 2570 may be formed over the partition 2528.

A gate driver circuit 2504 includes a transistor 2503*t* and a capacitor 2503*c*. Note that the driver circuit can be formed in the same process and over the same substrate as those of the pixel circuits.

The wirings 2511 through which signals can be supplied are provided over the substrate 2510. The terminal 2519 is provided over the wirings 2511. The FPC 2509(1) is electrically connected to the terminal 2519. The FPC 2509(1) has a function of supplying a video signal, a clock signal, a start signal, a reset signal, or the like. Note that the FPC 2509(1) may be provided with a printed wiring board (PWB).

Any of the transistors described in the above embodiments may be used as one or both of the transistors 2502*t* and 2503*t*. The transistors used in this embodiment each include an oxide semiconductor film which is highly purified and whose crystallinity is high. In the transistors, the current in an off state (off-state current) can be made small. Accordingly, an electrical signal such as an image signal can be held for a longer period, and a writing interval can be set longer in an on state. Accordingly, the frequency of refresh operation can be reduced, which leads to an effect of suppressing power consumption. Note that the details of refresh operation are described later.

In addition, the transistors used in this embodiment can have relatively high field-effect mobility and thus are capable of high speed operation. For example, with such transistors which can operate at high speed used for the display device 2501, a switching transistor of a pixel circuit and a driver transistor in a driver circuit portion can be formed over one substrate. That is, a semiconductor device formed using a silicon wafer or the like is not additionally needed as a driver circuit, by which the number of components of the semiconductor device can be reduced. In addition, by using a transistor which can operate at high speed in a pixel circuit, a high-quality image can be provided.

<Touch Sensor>

Figure 52:
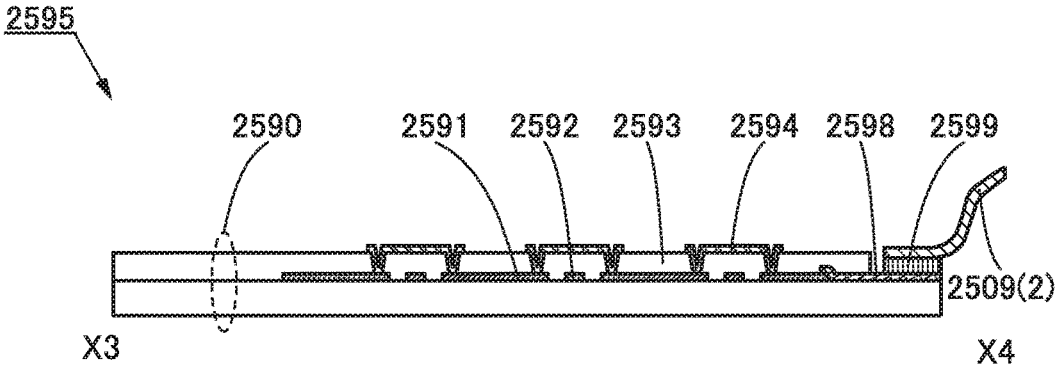
FIG. 52 is a cross-sectional view illustrating one embodiment of the present invention.

Next, the touch sensor 2595 will be described in detail with reference to FIG. 52. FIG. 52 corresponds to a cross-sectional view taken along dashed-dotted line X3-X4 in FIG. 50B.

The touch sensor 2595 includes the electrodes 2591 and the electrodes 2592 provided in a staggered arrangement on the substrate 2590, an insulating layer 2593 covering the electrodes 2591 and the electrodes 2592, and the wiring 2594 that electrically connects the adjacent electrodes 2591 to each other.

The electrodes 2591 and the electrodes 2592 are formed using a light-transmitting conductive material. As a light-transmitting conductive material, a conductive oxide such as indium oxide, indium tin oxide, indium zinc oxide, zinc oxide, or zinc oxide to which gallium is added can be used. Note that a film containing graphene may be used as well. The film containing graphene can be formed, for example, by reducing a film containing graphene oxide. As a reducing method, a method with application of heat or the like can be employed.

The electrodes 2591 and the electrodes 2592 may be formed by, for example, depositing a light-transmitting conductive material on the substrate 2590 by a sputtering method and then removing an unnecessary portion by any of various pattern forming techniques such as photolithography.

Examples of a material for the insulating layer 2593 are a resin such as an acrylic resin or an epoxy resin, a resin having a siloxane bond such as silicon, and an inorganic insulating material such as silicon oxide, silicon oxynitride, or aluminum oxide.

Openings reaching the electrodes 2591 are formed in the insulating layer 2593, and the wiring 2594 electrically connects the adjacent electrodes 2591. A light-transmitting conductive material can be favorably used as the wiring 2594 because the aperture ratio of the touch panel can be increased. Moreover, a material with higher conductivity than the conductivities of the electrodes 2591 and 2592 can be favorably used for the wiring 2594 because electric resistance can be reduced.

One electrode 2592 extends in one direction, and a plurality of electrodes 2592 are provided in the form of stripes. The wiring 2594 intersects with the electrode 2592.

Adjacent electrodes 2591 are provided with one electrode 2592 provided therebetween. The wiring 2594 electrically connects the adjacent electrodes 2591.

Note that the plurality of electrodes 2591 are not necessarily arranged in the direction orthogonal to one electrode 2592 and may be arranged to intersect with one electrode 2592 at an angle of more than 0 degrees and less than 90 degrees.

The wiring 2598 is electrically connected to any of the electrodes 2591 and 2592. Part of the wiring 2598 functions as a terminal. For the wiring 2598, a metal material such as aluminum, gold, platinum, silver, nickel, titanium, tungsten, chromium, molybdenum, iron, cobalt, copper, or palladium or an alloy material containing any of these metal materials can be used.

Note that an insulating layer that covers the insulating layer 2593 and the wiring 2594 may be provided to protect the touch sensor 2595.

A connection layer 2599 electrically connects the wiring 2598 to the FPC 2509(2).

As the connection layer 2599, any of various anisotropic conductive films (ACF), anisotropic conductive pastes (ACP), or the like can be used.

<Touch Panel>

Figure 53A:
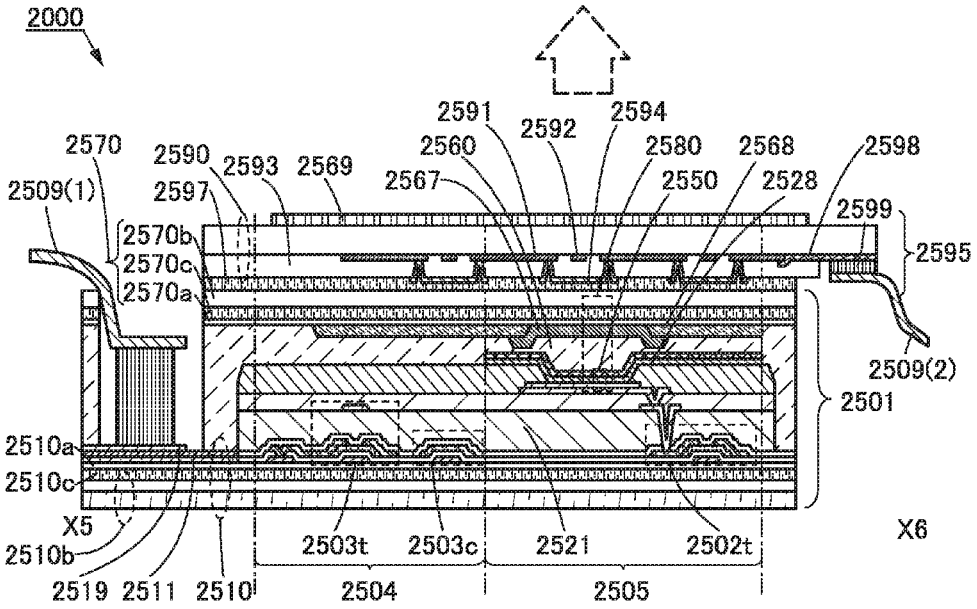
FIGS. 53A and 53B are cross-sectional views illustrating one embodiment of the present invention.

Next, the touch panel 2000 will be described in detail with reference to FIG. 53A. FIG. 53A corresponds to a cross-sectional view taken along dashed-dotted line X5-X6 in FIG. 50A.

In the touch panel 2000 illustrated in FIG. 53A, the display device 2501 described with reference to FIG. 51A and the touch sensor 2595 described with reference to FIG. 52 are attached to each other.

The touch panel 2000 illustrated in FIG. 53A includes an adhesive layer 2597 and an anti-reflective layer 2569 in addition to the components described with reference to FIG. 51A.

The adhesive layer 2597 is provided in contact with the wiring 2594. Note that the adhesive layer 2597 attaches the substrate 2590 to the substrate 2570 so that the touch sensor 2595 overlaps with the display device 2501. The adhesive layer 2597 preferably has a light-transmitting property. A heat curable resin or an ultraviolet curable resin can be used for the adhesive layer 2597. For example, an acrylic resin, a urethane-based resin, an epoxy-based resin, or a siloxane-based resin can be used.

The anti-reflective layer 2569 is positioned in a region overlapping with pixels. As the anti-reflective layer 2569, a circularly polarizing plate can be used, for example.

Next, a touch panel having a structure different from that illustrated in FIG. 53A will be described with reference to FIG. 53B.

Figure 53B:
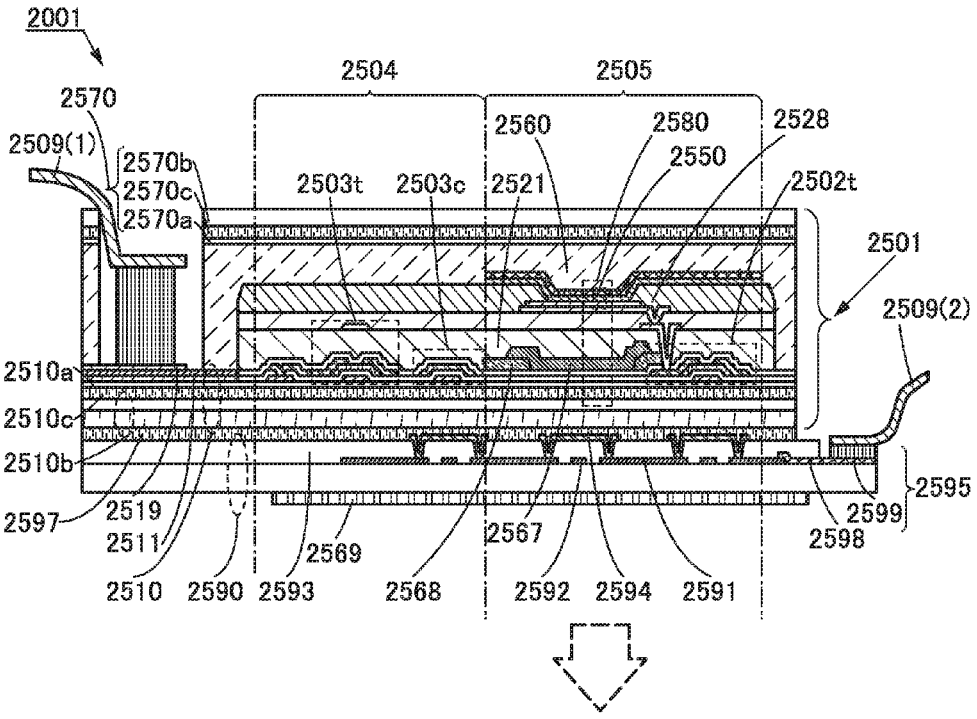

FIG. 53B is a cross-sectional view of a touch panel 2001. The touch panel 2001 illustrated in FIG. 53B differs from the touch panel 2000 illustrated in FIG. 53A in the position of the touch sensor 2595 relative to the display device 2501. Different parts are described in detail below, and the above description of the touch panel 2000 is referred to for the other similar parts.

The coloring layer 2567 is positioned under the EL element 2550. The EL element 2550 illustrated in FIG. 53B emits light to the side where the transistor 2502*t* is provided. Accordingly, part of light emitted from the EL element 2550 passes through the coloring layer 2567 and is emitted to the outside of the light-emitting module 2580 as indicated by an arrow in FIG. 53B.

The touch sensor 2595 is provided on the substrate 2510 side of the display device 2501.

The adhesive layer 2597 is provided between the substrate 2510 and the substrate 2590 and attaches the touch sensor 2595 to the display device 2501.

As illustrated in FIG. 53A or FIG. 53B, light may be emitted from the light-emitting element to one or both of upper and lower sides of the substrate.

<Driving Method of Touch Panel>

Next, an example of a method for driving a touch panel will be described with reference to FIGS. 54A and 54B.

Figure 54A:
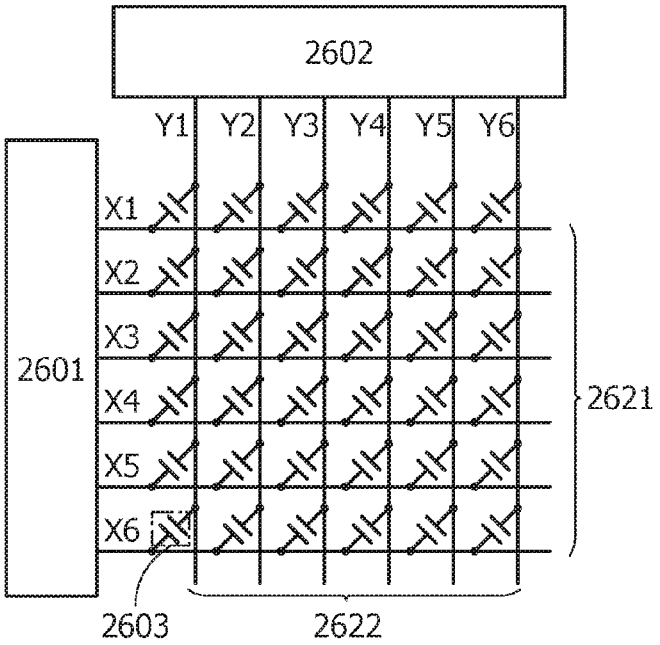
FIGS. 54A and 54B are circuit diagrams illustrating one embodiment of the present invention.

FIG. 54A is a block diagram illustrating the structure of a mutual capacitive touch sensor. FIG. 54A illustrates a pulse voltage output circuit 2601 and a current sensing circuit 2602. Note that in FIG. 54A, six wirings X1 to X6 represent the electrodes 2621 to which a pulse voltage is applied, and six wirings Y1 to Y6 represent the electrodes 2622 that detect changes in current. FIG. 54A also illustrates capacitors 2603 that are each formed in a region where the electrodes 2621 and 2622 overlap with each other. Note that functional replacement between the electrodes 2621 and 2622 is possible.

The pulse voltage output circuit 2601 is a circuit for sequentially applying a pulse voltage to the wirings X1 to X6. By application of a pulse voltage to the wirings X1 to X6, an electric field is generated between the electrodes 2621 and 2622 of the capacitor 2603. When the electric field between the electrodes is shielded, for example, a change occurs in the capacitor 2603 (mutual capacitance). The approach or contact of a sensing target can be sensed by utilizing this change.

The current sensing circuit 2602 is a circuit for detecting changes in current flowing through the wirings Y1 to Y6 that are caused by the change in mutual capacitance in the capacitor 2603. No change in current value is detected in the wirings Y1 to Y6 when there is no approach or contact of a sensing target, whereas a decrease in current value is detected when mutual capacitance is decreased owing to the approach or contact of a sensing target. Note that an integrator circuit or the like is used for sensing of current values.

Figure 54B:
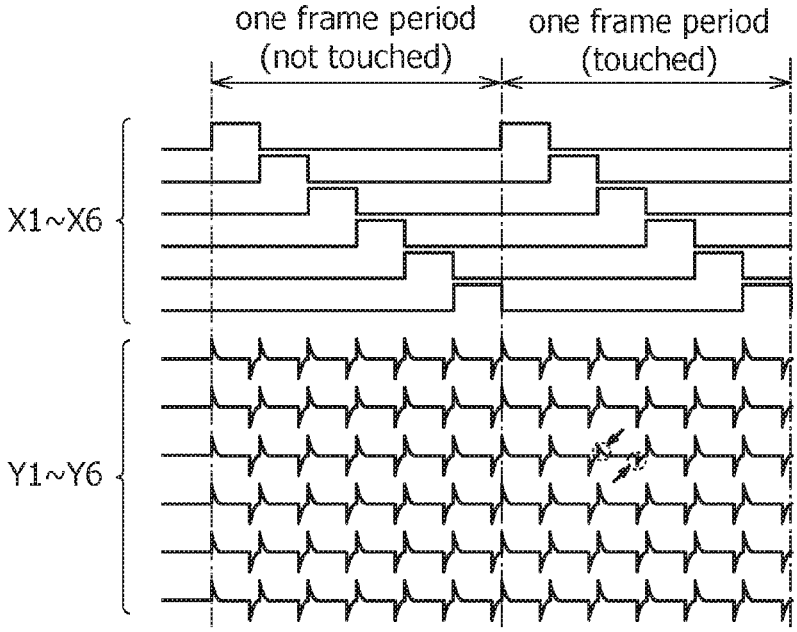

FIG. 54B is a timing chart showing input and output waveforms in the mutual capacitive touch sensor illustrated in FIG. 54A. In FIG. 54B, sensing of a sensing target is performed in all the rows and columns in one frame period. FIG. 54B shows a period when a sensing target is not sensed (not touched) and a period when a sensing target is sensed (touched). Sensed current values of the wirings Y1 to Y6 are shown as the waveforms of voltage values.

A pulse voltage is sequentially applied to the wirings X1 to X6, and the waveforms of the wirings Y1 to Y6 change in accordance with the pulse voltage. When there is no approach or contact of a sensing target, the waveforms of the wirings Y1 to Y6 change in accordance with changes in the voltages of the wirings X1 to X6. The current value is decreased at the point of approach or contact of a sensing target and accordingly the waveform of the voltage value changes.

By detecting a change in mutual capacitance in this manner, the approach or contact of a sensing target can be sensed.

<Sensor Circuit>

Figure 55:
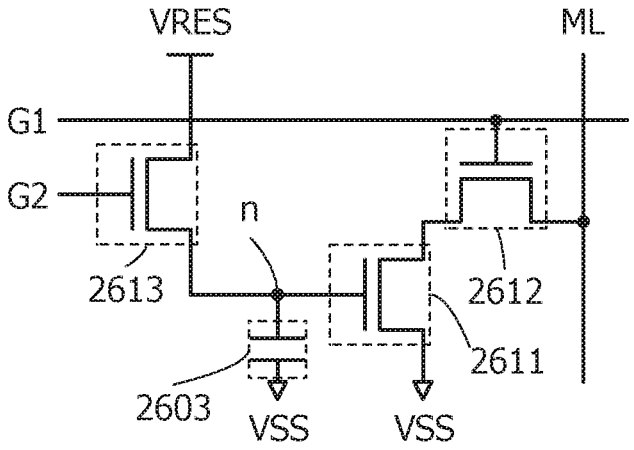
FIG. 55 is a circuit diagram illustrating one embodiment of the present invention.

Although FIG. 54A illustrates a passive matrix type touch sensor in which only the capacitor 2603 is provided at the intersection of wirings as a touch sensor, an active matrix type touch sensor including a transistor and a capacitor may be used. FIG. 55 illustrates an example of a sensor circuit included in an active matrix type touch sensor.

The sensor circuit in FIG. 55 includes the capacitor 2603 and transistors 2611, 2612, and 2613.

A signal G2 is input to a gate of the transistor 2613. A voltage VRES is applied to one of a source and a drain of the transistor 2613, and one electrode of the capacitor 2603 and a gate of the transistor 2611 are electrically connected to the other of the source and the drain of the transistor 2613. One of a source and a drain of the transistor 2611 is electrically connected to one of a source and a drain of the transistor 2612, and a voltage VSS is applied to the other of the source and the drain of the transistor 2611. A signal G1 is input to a gate of the transistor 2612, and a wiring ML is electrically connected to the other of the source and the drain of the transistor 2612. The voltage VSS is applied to the other electrode of the capacitor 2603.

Next, the operation of the sensor circuit in FIG. 55 will be described. First, a potential for turning on the transistor 2613 is supplied as the signal G2, and a potential with respect to the voltage VRES is thus applied to the node n connected to the gate of the transistor 2611. Then, a potential for turning off the transistor 2613 is applied as the signal G2, whereby the potential of the node n is maintained.

Then, mutual capacitance of the capacitor 2603 changes owing to the approach or contact of a sensing target such as a finger, and accordingly the potential of the node n is changed from VRES.

In reading operation, a potential for turning on the transistor 2612 is supplied as the signal G1. A current flowing through the transistor 2611, that is, a current flowing through the wiring ML is changed in accordance with the potential of the node n. By sensing this current, the approach or contact of a sensing target can be sensed.

In each of the transistors 2611, 2612, and 2613, any of the transistors described in the above embodiments can be used. In particular, it is preferable to use any of the transistors described in the above embodiments as the transistor 2613 because the potential of the node n can be held for a long time and the frequency of operation of resupplying VRES to the node n (refresh operation) can be reduced.

Embodiment 5

In this embodiment, a display device of one embodiment of the present invention and a method for driving the display device will be described with reference to FIGS. 56A and 56B, FIGS. 57A and 57B, FIGS. 58A to 58E, and FIGS. 59A to 59E.

Note that the display device of one embodiment of the present invention may include an information processing portion, an arithmetic portion, a memory portion, a display portion, an input portion, and the like.

In the display device of one embodiment of the present invention, power consumption can be reduced by reducing the number of times of writing signals for the same image (also referred to as "refresh operation") in the case where the same image (still image) is continuously displayed. Note that the frequency of refresh operations is referred to as a refresh rate (also referred to as scan frequency or vertical synchronization frequency). A display device in which the refresh rate is reduced and which causes little eye fatigue is described below.

The eye fatigue is divided into two categories: nervous fatigue and muscle fatigue. The nervous fatigue is caused by prolonged looking at light emitted from a display device or blinking images. This is because brightness stimulates and fatigues the retina and nerve of the eye and the brain. The muscle fatigue is caused by overuse of a ciliary muscle which works for adjusting the focus.

Figure 56A:
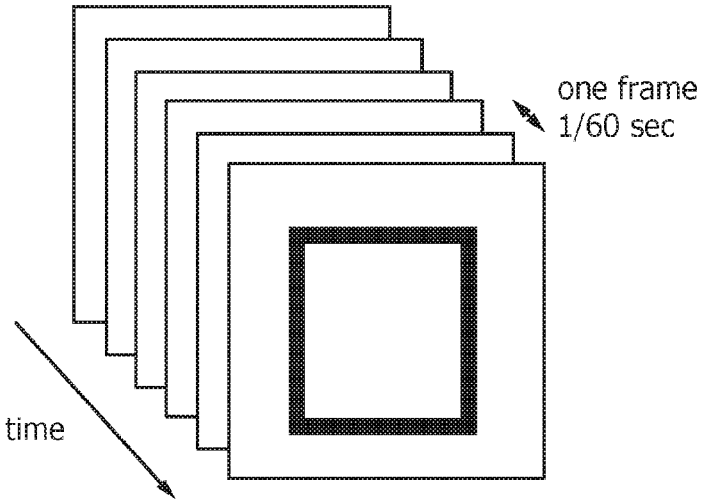
FIGS. 56A and 56B are schematic diagrams illustrating one embodiment of the present invention.

FIG. 56A is a schematic view showing display on a conventional display device. As illustrated in FIG. 56A, for the display of the conventional display device, image rewriting is performed 60 times every second. Prolonged looking at such a screen might stimulate the retina and nerve of the eye and the brain of a user and lead to eye fatigue.

In the display device of one embodiment of the present invention, a transistor including an oxide semiconductor, for example, a transistor including a CAAC-OS, is used in a pixel portion. The off-state current of the transistor is extremely low. Thus, the luminance of the display device can be maintained even when the refresh rate of the display device is lowered.

Figure 56B:
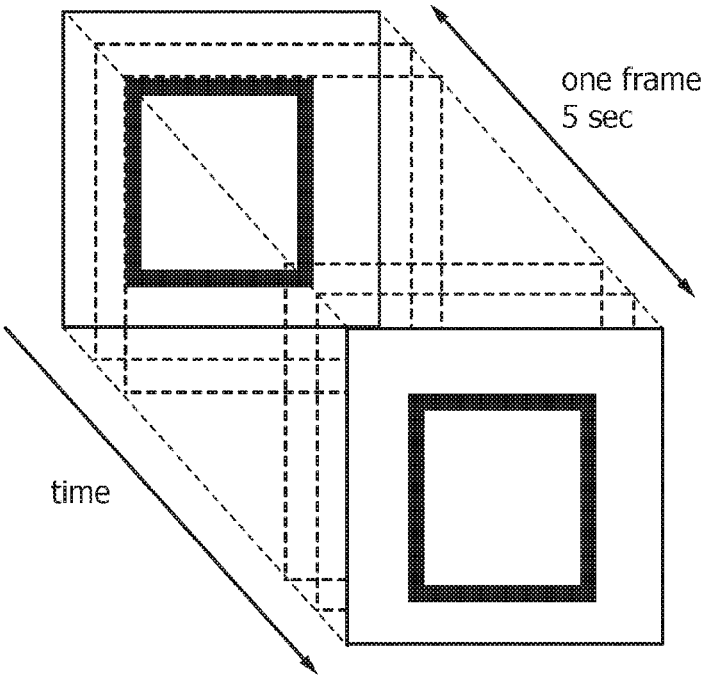

That is, as shown in FIG. 56B, an image can be rewritten as less frequently as once every five seconds, for example. This enables the user to see the same one image as long as possible, so that flicker on the screen perceived by the user is reduced. Consequently, a stimulus to the retina or the nerve of an eye or the brain of the user is relieved, resulting in less nervous fatigue.

Figure 57A:
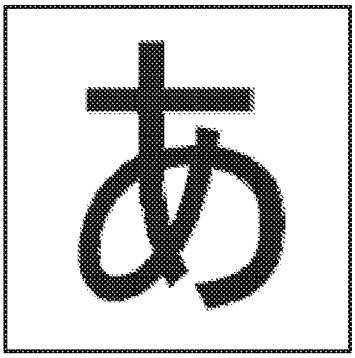
FIGS. 57A and 57B are schematic diagrams illustrating one embodiment of the present invention.

In addition, as shown in FIG. 57A, when the size of each pixel is large (for example, when the resolution is less than 150 ppi), a character displayed on the display device is blurred. When a user keeps looking at a blurred character displayed on the display device for a long time, it continues to be difficult to focus the eye on the character even though the ciliary muscle constantly moves in order to focus the eye, which might put strain on the eye.

Figure 57B:
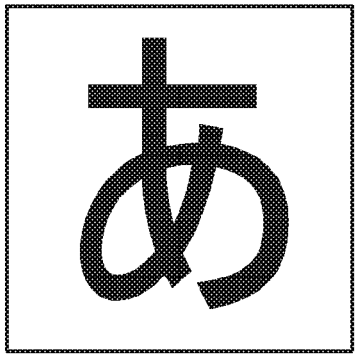

In contrast, as shown in FIG. 57B, the display device of one embodiment of the present invention is capable of high-resolution display because the size of each pixel is small; thus, precise and smooth display can be achieved. The precise and smooth display enables ciliary muscles to adjust the focus more easily, and reduces muscle fatigue of a user. When the resolution of the display device is 150 ppi or more, preferably 200 ppi or more, further preferably 300 ppi or more, the user's muscle fatigue can be effectively reduced.

Methods for quantifying eye fatigue have been studied. For example, critical flicker (fusion) frequency (CFF) is known as an indicator for evaluating nervous fatigue. Further, focus adjustment time, near point distance, and the like are known as indicators for evaluating muscle fatigue.

Other methods for evaluating eye fatigue include electroencephalography, thermography, counting the number of times of blinking, measuring the amount of tears, measuring the speed of contractile response of the pupil, and questionnaires for surveying subjective symptoms.

By any of the variety of methods above, the effect of the reduction of eye fatigue by employing the driving method of the display device of one embodiment of the present invention can be evaluated.

<Method for Driving Display Device>

Now, a method for driving the display device of one embodiment of the present invention is described with reference to FIGS. 58A to 58E.

Display Example of Image Data

An example of displaying two images including different image data by being transferred is described below.

Figure 58A:
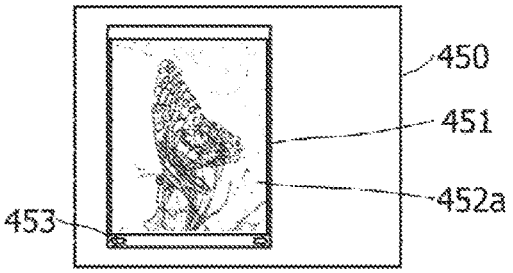
FIGS. 58A to 58E are schematic diagrams illustrating one embodiment of the present invention.

FIG. 58A illustrates an example in which a window 451 and a first image 452*a* which is a still image displayed in the window 451 are displayed on a display portion 450.

At this time, display is preferably performed at the first refresh rate. Note that the first refresh rate can be higher than or equal to $1.16\times10^{-5}$ Hz (about once per day) and lower than or equal to 1 Hz, higher than or equal to $2.78\times10^{-4}$ Hz (about once per hour) and lower than or equal to 0.5 Hz, or higher than or equal to $1.67\times10^{-2}$ Hz (about once per minute) and lower than or equal to 0.1 Hz.

When frequency of rewriting an image is reduced by setting the first refresh rate to an extremely small value, display substantially without flicker can be achieved, and eye fatigue of a user can be more effectively reduced.

The window 451 is displayed by, for example, executing application software for image display and includes a display region where an image is displayed.

Further, in a lower part of the window 451, a button 453 for switching a displayed image data to a different image data is displayed. When a user performs operation in which the button 453 is selected, an instruction of transferring an image can be supplied to the information processing portion of the display device.

Note that the operation method performed by the user may be set in accordance with an input unit. For example, in the case where a touch panel provided to overlap with the display portion 450 is used as the input unit, it is possible to perform operation of touching the button 453 with a finger, a stylus, or the like or input operation by a gesture where an image is made to slide. In the case where the input operation is performed with gesture or sound, the button 453 is not necessarily displayed.

Figure 58B:
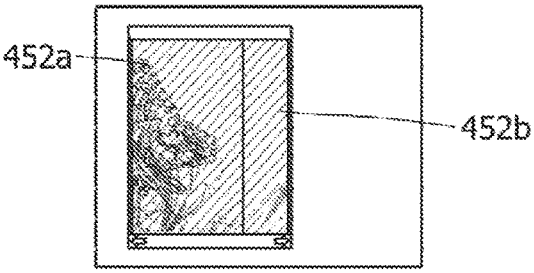

When the information processing portion of the display device receives the instruction of transferring an image, transfer of the image displayed in the window 451 starts (see FIG. 58B).

Note that in the case where display is performed at the first refresh rate in the state of FIG. 58A, the refresh rate is preferably changed to the second refresh rate before transfer of the image starts. The second refresh rate is a value necessary for displaying a moving image. For example, the second refresh rate can be higher than or equal to 30 Hz and lower than or equal to 960 Hz, preferably higher than or equal to 60 Hz and lower than or equal to 960 Hz, further preferably higher than or equal to 75 Hz and lower than or equal to 960 Hz, still further preferably higher than or equal to 120 Hz and lower than or equal to 960 Hz, yet still further preferably higher than or equal to 240 Hz and lower than or equal to 960 Hz.

When the second refresh rate is set to a value higher than that of the first refresh rate, a moving image can be displayed further smoothly and naturally. In addition, flicker which accompanies rewriting of data is less likely to be perceived by a user, whereby eye fatigue of a user can be reduced.

At this time, an image where the first image 452*a* and a second image 452*b* that is to be displayed next are combined is displayed in the window 451. The combined image is transferred unidirectionally (leftward in this case), and part of the first image 452*a* and part of the second image 452*b* are displayed in the window 451.

Further, when the combined image transfers, luminance of the image displayed in the window 451 is gradually lowered from the initial luminance at the time of the state in FIG. 58A.

Figure 58C:
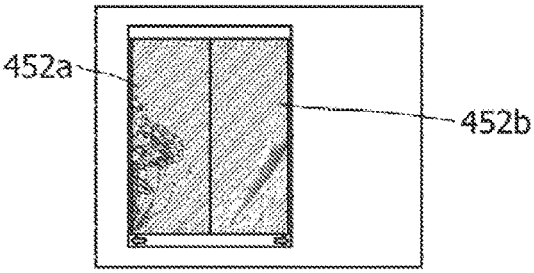

FIG. 58C illustrates a state where the image displayed in the window 451 reaches a position of the predetermined coordinates. Thus, the luminance of the image displayed in the window 451 at this time is lowest.

Note that the predetermined coordinates in FIG. 58C is set so that half of the first image 452*a* and half of the second image 452*b* are displayed; however, the coordinates are not limited to the above, and it is preferable that the coordinates be set freely by a user.

For example, the predetermined coordinates may be set so that the ratio of the distance from the initial coordinates of the image to the distance between the initial coordinates and the final coordinates is higher than 0 and lower than 1.

In addition, it is also preferable that luminance when the image reaches the position of the predetermined coordinates be set freely by a user. For example, the ratio of the luminance when the image reaches the position of the predetermined coordinates to the initial luminance may be higher than 0 and lower than 1, preferably higher than or equal to 0 and lower than or equal to 0.8, further preferably higher than or equal to 0 and lower than or equal to 0.5.

Figure 58D:
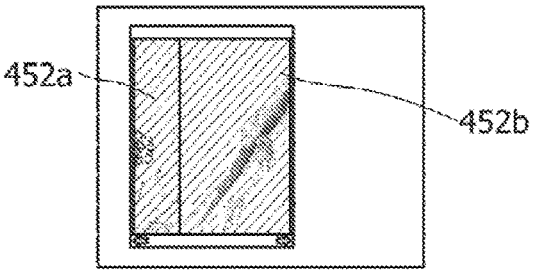

Next, in the window 451, the combined image transfers with the luminance increasing gradually (FIG. 58D).

Figure 58E:
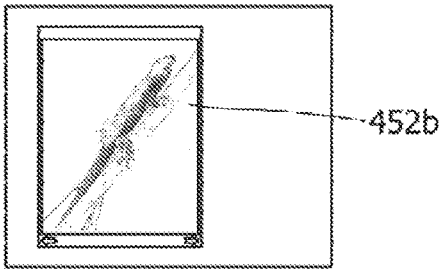

FIG. 58E illustrates a state when the combined image reaches the position of the final coordinates. In the window 451, only the second image 452*b* is displayed with luminance equal to the initial luminance.

Note that after the transfer of the image is completed, the refresh rate is preferably changed from the second refresh rate to the first refresh rate.

Since the luminance of the image is lowered in such a display mode, even when a user follows the motion of the image with his/her eyes, the user is less likely to suffer from eye fatigue. Thus, with such a driving method, eye-friendly display can be achieved.

Display Example of Document Information

Next, an example in which document information whose dimension is larger than a display window is displayed by scrolling is described below.

Figure 59A:
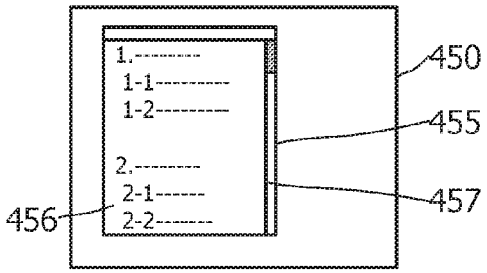
FIGS. 59A to 59E are schematic diagrams illustrating one embodiment of the present invention.

FIG. 59A illustrates an example in which a window 455 and part of document information 456 which is a still image displayed in the window 455 are displayed on the display portion 450.

At this time, display is preferably performed at the first refresh rate.

The window 455 is displayed by, for example, executing application software for document display, application software for document preparation, or the like and includes a display region where document information is displayed.

The dimension of an image of the document information 456 is larger than the display region of the window 455 in the longitudinal direction. That is, part of the document information 456 is displayed in the window 455. Furthermore, as illustrated in FIG. 59A, the window 455 may be provided with a scroll bar 457 which indicates which part of the document information 456 is displayed.

Figure 59B:
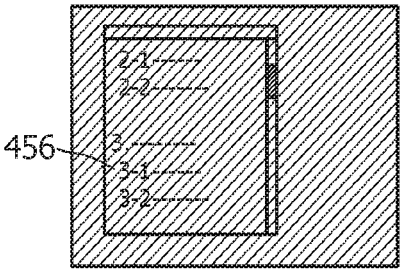

When an instruction of transferring an image (here, also referred to as scroll instruction) is supplied to the display device by the input portion, transfer of the document information 456 starts (FIG. 59B). In addition, luminance of the displayed image is gradually lowered.

Note that in the case where display is performed at the first refresh rate in the state of FIG. 59A, the refresh rate is preferably changed to the second refresh rate before transfer of the document information 456.

In this state, not only the luminance of the image displayed in the window 455 but also the luminance of the whole image displayed on the display portion 450 is lowered.

Figure 59C:
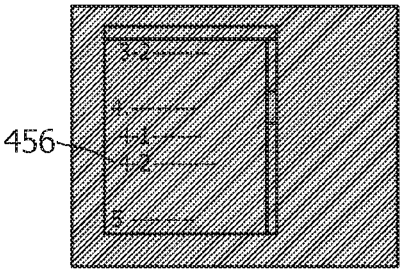

FIG. 59C illustrates a state when the document information 456 reaches a position of the predetermined coordinates. At this time, the luminance of the whole image displayed on the display portion 450 is lowest.

Figure 59D:
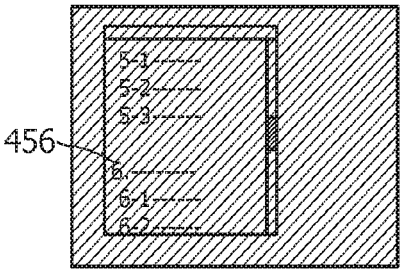

Then, the document information 456 is displayed in the window 455 while being transferred (FIG. 59D). Under this condition, the luminance of the whole image displayed on the display portion 450 is gradually increased.

Figure 59E:
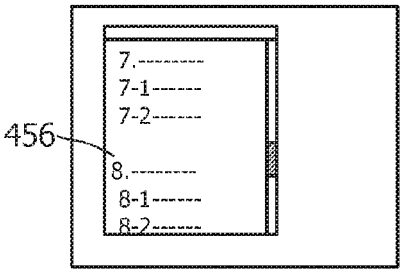

FIG. 59E illustrates a state where the document information 456 reaches a position of the final coordinates. In the window 455, a region of the document information 456, which is different from the region displayed in an initial state, is displayed with luminance equal to the initial luminance.

Note that after transfer of the document information 456 is completed, the refresh rate is preferably changed to the first refresh rate.

Since the luminance of the image is lowered in such a display mode, even when a user follows the motion of the image with his/her eyes, the user can be less likely to suffer from eye fatigue. Thus, with such a driving method, eye-friendly display can be achieved.

In particular, display of document information or the like, which has high contrast, gives a user eye fatigue significantly; thus, it is preferable to apply such a driving method to the display of document information.

Embodiment 6

In this embodiment, an external view of a display device including the pixel described in this embodiment and examples of electronic devices each including the display device described will be described.

<External View of Light-Emitting Device>

Figure 60A:
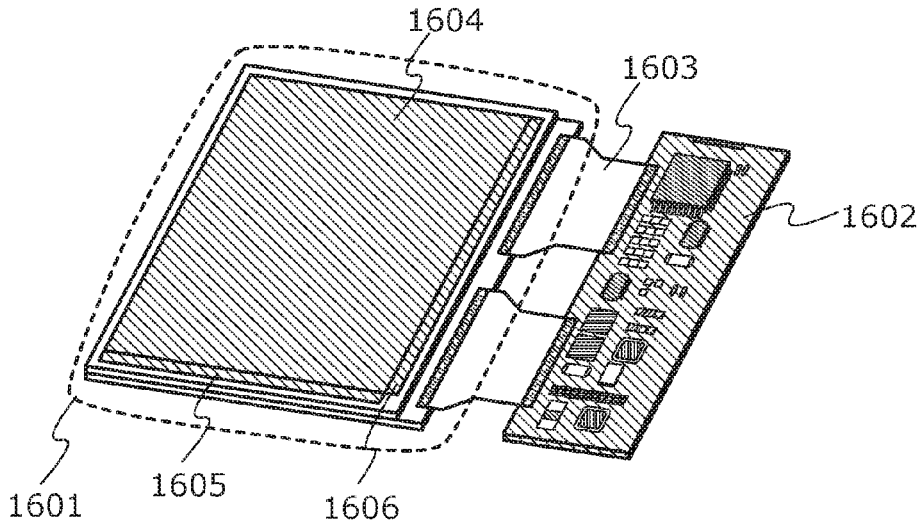
FIGS. 60A and 60B are perspective views illustrating one embodiment of the present invention.

FIG. 60A is a perspective view illustrating an example of an external view of a display device. The display device illustrated in FIG. 60A includes a panel 1601; a circuit board 1602 including a controller, a power supply circuit, an image processing circuit, an image memory, a CPU, and the like; and a connection portion 1603. The panel 1601 includes a pixel portion 1604 including a plurality of pixels, a driver circuit 1605 that selects pixels row by row, and a driver circuit 1606 that controls input of a data voltage to the pixels in a selected row.

A variety of signals and power supply potentials are input from the circuit board 1602 to the panel 1601 through the joints 1603. As the connecting portion 1603, a flexible printed circuit (FPC) or the like can be used. The chip-mounted FPC is referred to as COF tape, which achieves higher-density packaging in a smaller area. In the case where a COF tape is used as the connection portion 1603, part of circuits in the circuit board 1602 or part of the driver circuit 1605 or the driver circuit 1606 included in the panel 1601 may be formed on a chip separately prepared, and the chip may be connected to the COF tape by a chip-on-film (COF) method.

Figure 60B:
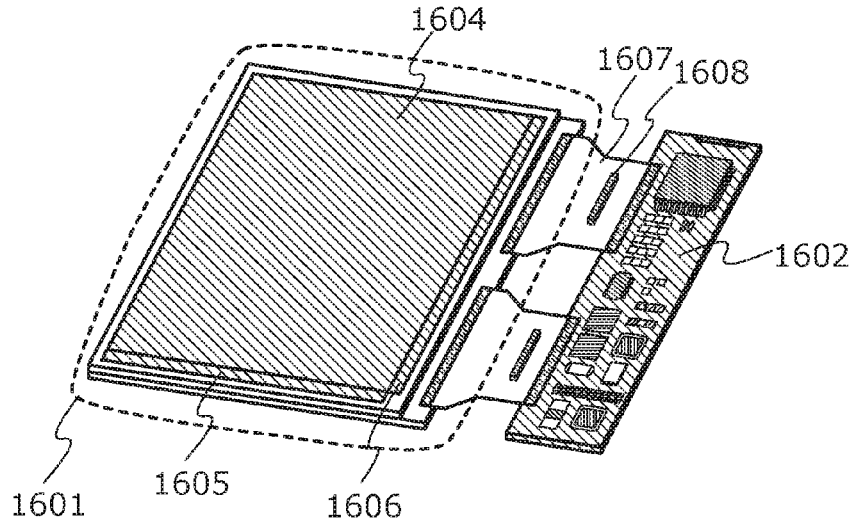

FIG. 60B is a perspective view of an appearance example of a display device using a COF tape 1607.

A chip 1608 is a semiconductor bare chip including a terminal (e.g., bump) on its surface, i.e., IC or LSI. CR components can also be mounted on the COF tape 1607, so that the area of the circuit board 1602 can be reduced. There is a plurality of wiring patterns of a flexible substrate depending on a terminal of a mounted chip. The chip 1608 is mounted using a bonder apparatus or the like; the position of the chip is determined over the flexible substrate having a wiring pattern and thermocompression bonding is performed.

One embodiment of the present invention is not limited to the example of FIG. 60B in which one COF tape 1607 is mounted on one chip 1608. Chips may be mounted in a plurality of lines on one side or both sides of one COF tape 1607; however, for cost reduction, the number of lines is preferably one in order to reduce the number of mounted chips. It is more preferable that the number of mounted chips is one.

Structural Example of Electronic Device

Next, electronic devices including the display devices will be described.

The display device according to one embodiment of the present invention can be used for display devices, notebook personal computers, or image reproducing devices provided with recording media (typically, devices which reproduce the content of recording media such as digital versatile discs (DVDs) and have displays for displaying the reproduced images). Other than the above, as an electronic device which can use the display device according to one embodiment of the present invention, cellular phones, portable game machines, portable information terminals, electronic books, cameras such as video cameras and digital still cameras, goggle-type displays (head mounted displays), navigation systems, audio reproducing devices (e.g., car audio systems and digital audio players), copiers, facsimiles, printers, multifunction printers, automated teller machines (ATM), vending machines, and the like can be given. FIGS. 61A to 61F illustrate specific examples of these electronic devices.

Figure 61A:
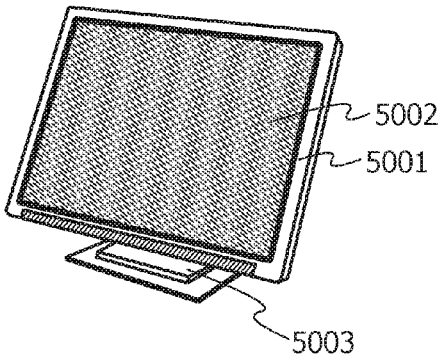
FIGS. 61A to 61F are electronic devices illustrating one embodiment of the present invention.

FIG. 61A illustrates a display device including a housing 5001, a display portion 5002, a supporting base 5003, and the like. The display device according to one embodiment of the present invention can be used for the display portion 5002. Note that the category of the display device includes all the display devices for displaying information, such as display devices for a personal computer, TV broadcast reception, advertisement display, and the like.

Figure 61B:
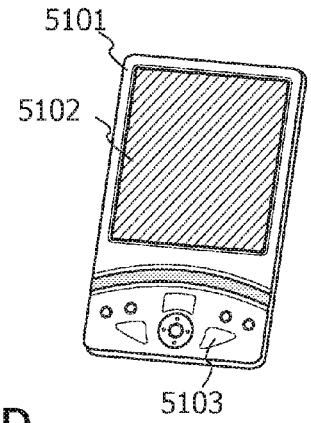

FIG. 61B illustrates a portable information terminal including a housing 5101, a display portion 5102, operation keys 5103, and the like. The display device according to one embodiment of the present invention can be used for the display portion 5102.

Figure 61C:
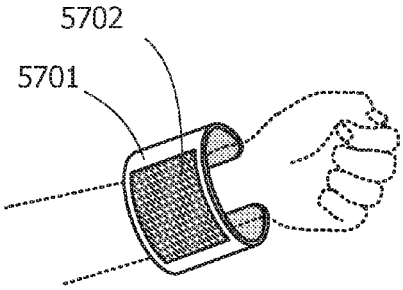

FIG. 61C illustrates a display device, which includes a housing 5701 having a curved surface, a display portion 5702, and the like. When a flexible substrate is used for the display device according to one embodiment of the present invention, it is possible to use the display device as the display portion 5702 supported by the housing 5701 having a curved surface. It is thus possible to provide a user-friendly display device that is flexible and lightweight.

Figure 61D:
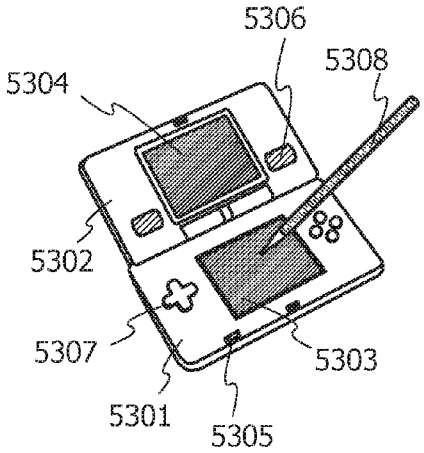

FIG. 61D illustrates a portable game machine that includes a housing 5301, a housing 5302, a display portion 5303, a display portion 5304, a microphone 5305, a speaker 5306, an operation key 5307, a stylus 5308, and the like. The display device according to one embodiment of the present invention can be used for the display portion 5303 or the display portion 5304. When the display device according to one embodiment of the present invention is used as the display portion 5303 or 5304, it is possible to provide a user-friendly portable game machine with quality that hardly deteriorates. Although the portable game machine in FIG. 61D has the two display portions 5303 and 5304, the number of display portions included in the portable game machine is not limited to two.

Figure 61E:
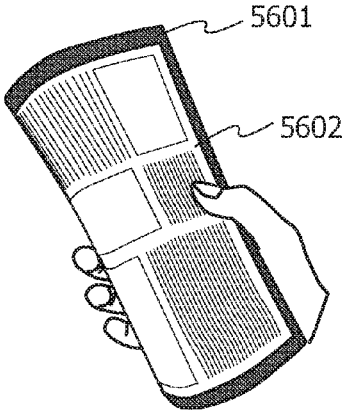

FIG. 61E illustrates an e-book reader, which includes a housing 5601, a display portion 5602, and the like. The display device according to one embodiment of the present invention can be used as the display portion 5602. When a flexible substrate is used, the display device can have flexibility, so that it is possible to provide a flexible and lightweight e-book reader.

Figure 61F:
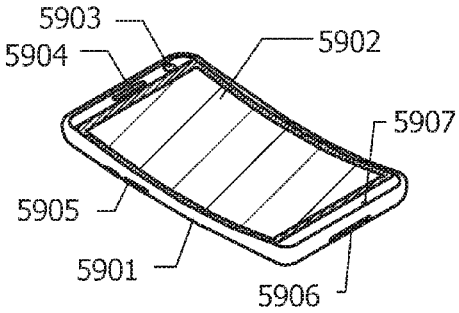

FIG. 61F illustrates a cellular phone, which includes a display portion 5902, a microphone 5907, a speaker 5904, a camera 5903, an external connection port 5906, and an operation button 5905 in a housing 5901. It is possible to use the display device according to one embodiment of the present invention as the display portion 5902. When the display device of one embodiment of the present invention is provided over a flexible substrate, the display device can be used for the display portion 5902 having a curved surface, as illustrated in FIG. 61F.

(Supplementary Notes on the Description in this Specification and the Like)

The following are notes on the description of the above embodiments and structures in the embodiments.

<Notes on One Embodiment of the Present Invention Described in Embodiments>

One embodiment of the present invention can be constituted by appropriately combining the structure described in an embodiment with any of the structures described the other embodiments. In addition, in the case where a plurality of structure examples are described in one embodiment, some of the structure examples can be combined as appropriate.

Note that what is described (or part thereof) in an embodiment can be applied to, combined with, or replaced with another content in the same embodiment and/or what is described (or part thereof) in another embodiment or other embodiments.

Note that in each embodiment, a content described in the embodiment is a content described with reference to a variety of diagrams or a content described with text disclosed in this specification.

Note that by combining a diagram (or may be part of the diagram) illustrated in one embodiment with another part of the diagram, a different diagram (or may be part of the different diagram) illustrated in the embodiment, and/or a diagram (or may be part of the diagram) illustrated in one or a plurality of different embodiments, much more diagrams can be formed.

In each Embodiment, one embodiment of the present invention has been described; however, one embodiment of the present invention is not limited to the described embodiment. For example, an example in which a channel formation region of a transistor, such as the transistor 102, contains an oxide semiconductor or silicon is described in Embodiment 2 of one embodiment of the present invention; however, one embodiment of the present invention is not limited to this example. Depending on circumstances or conditions, various transistors or a channel formation region, a source region, a drain region, or the like of a transistor in one embodiment of the present invention may include various semiconductors. For example, the transistor of one embodiment of the present invention may contain, for example, at least one of silicon, germanium, silicon germanium, silicon carbide, gallium arsenide, aluminum gallium arsenide, indium phosphide, gallium nitride, an organic semiconductor, and the like.

<Notes on the Description for Drawings>

In this specification and the like, terms for describing arrangement, such as "over" and "under," are used for convenience for describing the positional relation between components with reference to drawings. The positional relation between components is changed as appropriate in accordance with a direction in which each component is described. Thus, terms for describing arrangement are not limited to those used in this specification and can be changed to other terms as appropriate depending on the situation.

The term "over" or "under" does not necessarily mean that a component is placed "directly above and in contact with" or "directly below and in contact with" another component. For example, the expression "electrode B over insulating layer A" does not necessarily mean that the electrode B is on and in direct contact with the insulating layer A and can mean the case where another component is provided between the insulating layer A and the electrode B.

Furthermore, in a block diagram in this specification and the like, components are functionally classified and shown by blocks that are independent from each other. However, in an actual circuit and the like, such components are sometimes hard to classify functionally, and there is a case in which one circuit is concerned with a plurality of functions or a case in which a plurality of circuits are concerned with one function. Therefore, the segmentation of a block in the block diagrams is not limited by any of the components described in the specification, and can be differently determined as appropriate depending on situations.

In drawings, the size, the layer thickness, or the region is determined arbitrarily for description convenience. Therefore, the size, the layer thickness, or the region is not limited to the illustrated scale. Note that the drawings are schematically shown for clarity, and embodiments of the present invention are not limited to shapes or values shown in the drawings. For example, the following can be included: variation in signal, voltage, or current due to noise or difference in timing.

In drawings such as a top view (also referred to as a plan view or a layout view) and a perspective view, some of components might not be illustrated for clarity of the drawings.

<Notes on Expressions that can be Rephrased>

In this specification or the like, in description of connections of a transistor, one of a source and a drain is referred to as "one of a source and a drain" (or a first electrode or a first terminal), and the other of the source and the drain is referred to as "the other of the source and the drain" (or a second electrode or a second terminal). This is because a source and a drain of a transistor are interchangeable depending on the structure, operation conditions, or the like of the transistor. Note that the source or the drain of the transistor can also be referred to as a source (or drain) terminal, a source (or drain) electrode, or the like as appropriate depending on the situation.

In addition, in this specification and the like, the term such as an "electrode" or a "wiring" does not limit a function of a component. For example, an "electrode" is used as part of a "wiring" in some cases, and vice versa. Further, the term "electrode" or "wiring" can also mean a combination of a plurality of "electrodes" or "wirings" formed in an integrated manner.

In this specification and the like, "voltage" and "potential" can be replaced with each other. The term "voltage" refers to a potential difference from a reference potential. When the reference potential is a ground potential, for example, "voltage" can be replaced with "potential." The ground potential does not necessarily mean 0 V. Potentials are relative values, and the potential applied to a wiring or the like is changed depending on the reference potential, in some cases.

In this specification and the like, the terms "film," "layer," and the like can be interchanged with each other depending on the case or circumstances. For example, the term "conductive layer" can be changed into the term "conductive film" in some cases. Also, the term "insulating film" can be changed into the term "insulating layer" in some cases.

This specification and the like show a 2T2C circuit structure where each pixel includes two transistors and one capacitor; however, this specification and the like are not limited to these. A circuit structure where each pixel includes three or more transistors and three or more capacitors may be used. Moreover, a variety of circuit structures can be obtained by formation of an additional wiring.

<Notes on Definitions of Terms>

The following are definitions of the terms not mentioned in the above embodiments.

<<Switch>>

In this specification and the like, a switch is in a conductive state (on state) or in a non-conductive state (off state) to determine whether current flows therethrough or not. Alternatively, a switch has a function of selecting and changing a current path.

Examples of a switch are an electrical switch, a mechanical switch, and the like. That is, any element can be used as a switch as long as it can control current, without limitation to a certain element.

Examples of the electrical switch are a transistor (e.g., a bipolar transistor or a MOS transistor), a diode (e.g., a PN diode, a PIN diode, a Schottky diode, a metal-insulator-metal (MIM) diode, a metal-insulator-semiconductor (MIS) diode, or a diode-connected transistor), and a logic circuit in which such elements are combined.

In the case of using a transistor as a switch, an "on state" of the transistor refers to a state in which a source and a drain of the transistor are electrically short-circuited. Furthermore, an "off state" of the transistor refers to a state in which the source and the drain of the transistor are electrically disconnected. In the case where a transistor operates just as a switch, the polarity (conductivity type) of the transistor is not particularly limited to a certain type.

An example of the mechanical switch is a switch formed using a micro electro mechanical systems (MEMS) technology, such as a digital micromirror device (DMD). Such a switch includes an electrode which can be moved mechanically, and operates by controlling conduction and non-conduction in accordance with movement of the electrode.

[Channel Length]

In this specification and the like, the channel length refers to, for example, a distance between a source and a drain in a region where a semiconductor (or a portion where a current flows in a semiconductor when a transistor is on) and a gate overlap with each other or a region where a channel is formed in a plan view of the transistor.

In one transistor, channel lengths in all regions are not necessarily the same. In other words, the channel length of one transistor is not fixed to one value in some cases. Therefore, in this specification, the channel length is any one of values, the maximum value, the minimum value, or the average value, in a region where a channel is formed.

[Channel Width]

In this specification and the like, the channel width refers to, for example, the length of a portion where a source and a drain face each other in a region where a semiconductor (or a portion where a current flows in a semiconductor when a transistor is on) and a gate electrode overlap with each other, or a region where a channel is formed.

In one transistor, channel widths in all regions are not necessarily the same. In other words, the channel width of one transistor is not fixed to one value in some cases. Therefore, in this specification, the channel width is any one of values, the maximum value, the minimum value, or the average value, in a region where a channel is formed.

Note that depending on transistor structures, a channel width in a region where a channel is formed actually (hereinafter referred to as an effective channel width) is different from a channel width shown in a plan view of the transistor (hereinafter referred to as an apparent channel width) in some cases. For example, in a transistor having a three-dimensional structure, an effective channel width is greater than an apparent channel width shown in a top view of the transistor, and its influence cannot be ignored in some cases. For example, in a miniaturized transistor having a three-dimensional structure, the proportion of a channel region formed in a side surface of a semiconductor is high in some cases. In that case, an effective channel width obtained when a channel is actually formed is greater than an apparent channel width shown in the top view.

In a transistor having a three-dimensional structure, an effective channel width is difficult to measure in some cases.

For example, estimation of an effective channel width from a design value requires an assumption that the shape of a semiconductor is known. Therefore, in the case where the shape of a semiconductor is not known accurately, it is difficult to measure an effective channel width accurately.

Therefore, in this specification, in a top view of a transistor, an apparent channel width that is a length of a portion where a source and a drain face each other in a region where a semiconductor and a gate electrode overlap with each other is referred to as a surrounded channel width (SCW) in some cases. Furthermore, in this specification, in the case where the term "channel width" is simply used, it may represent a surrounded channel width or an apparent channel width. Alternatively, in this specification, in the case where the term "channel width" is simply used, it may represent an effective channel width in some cases. Note that the values of a channel length, a channel width, an effective channel width, an apparent channel width, a surrounded channel width, and the like can be determined by obtaining and analyzing a cross-sectional TEM image and the like.

Note that in the case where field-effect mobility, a current value per channel width, and the like of a transistor are obtained by calculation, a surrounded channel width may be used for the calculation. In that case, the values may be different from those calculated using an effective channel width in some cases.

[Pixel]

In this specification and the like, one pixel refers to one element whose brightness can be controlled, for example. Therefore, for example, one pixel expresses one color element by which brightness is expressed. Accordingly, in the case of a color display device formed of color elements of R (red), G (green), and B (blue), the smallest unit of an image is formed of three pixels of an R pixel, a G pixel, and a B pixel.

Note that the number of color elements is not limited to three, and more color elements may be used. For example, RGBW (W: white), RGB added with yellow, cyan, or magenta, and the like may be employed.

[Display Element]

In this specification and the like, a display element, such as the light-emitting element 104, includes a display medium whose contrast, luminance, reflectivity, transmittance, or the like is changed by electrical or magnetic effect. Examples of the display element include an electroluminescent (EL) element, an LED (e.g., a white LED, a red LED, a green LED, and a blue LED), a transistor (a transistor that emits light depending on current), an electron emitter, a display element including a carbon nanotube, a liquid crystal element, electronic ink, an electrophoretic element, a grating light valve (GLV), a plasma display panel (PDP), a display element using microelectromechanical system (MEMS), a digital micromirror device (DMD), a digital micro shutter (DMS), Mirasol (registered trademark), an interferometric modulator display (IMOD) element, a MEMS shutter display element, an optical-interference-type MEMS display element, an electrowetting element, a piezoelectric ceramic display, a display element using a carbon nanotube, and a quantum dot. Examples of display devices having EL elements include an EL display. Examples of display devices including electron emitters are a field emission display (FED) and an SED-type flat panel display (SED: surface-conduction electron-emitter display). Examples of display devices including liquid crystal elements include a liquid crystal display (e.g., a transmissive liquid crystal display, a transflective liquid crystal display, a reflective liquid crystal display, a direct-view liquid crystal display, or a projection liquid crystal display). Examples of a display device including electronic ink, electronic liquid powder (registered trademark), or electrophoretic elements include electronic paper. Examples of display devices containing quantum dots in each pixel include a quantum dot display. Note that quantum dots may be provided not as display elements but as part of a backlight. With the use of the quantum dots, a display device with high color purity can be fabricated. In the case of a transflective liquid crystal display or a reflective liquid crystal display, some of or all of pixel electrodes function as reflective electrodes. For example, some or all of pixel electrodes are formed to contain aluminum, silver, or the like. In such a case, a memory circuit such as an SRAM can be provided under the reflective electrodes, leading to lower power consumption. Note that in the case of using an LED chip, graphene or graphite may be provided under an electrode or a nitride semiconductor of the LED chip. Graphene or graphite may be a multilayer film in which a plurality of layers are stacked. As described above, provision of graphene or graphite enables easy formation of a nitride semiconductor film thereover, such as an n-type GaN semiconductor layer including crystals. Furthermore, a p-type GaN semiconductor layer including crystals can be provided thereover, and thus the LED chip can be formed. Note that an AlN layer may be provided between the n-type GaN semiconductor layer including crystals and graphene or graphite. The GaN semiconductor layer included in the LED chip may be formed by MOCVD. Note that when the graphene is provided, the GaN semiconductor layer included in the LED chip can also be formed by a sputtering method. In a display device including MEMS, a dry agent may be provided in a space where a display element is sealed (or between an element substrate over which the display element is placed and a counter substrate opposed to the element substrate, for example). Providing a dry agent can prevent MEMS and the like from becoming difficult to move or deteriorating easily because of moisture or the like.

[Connection]

In this specification and the like, the expression "A and B are connected" or "A is connected to B" means the case where A and B are electrically connected to each other as well as the case where A and B are directly connected to each other. Here, the expression "A and B are electrically connected" means the case where electric signals can be transmitted and received between A and B when an object having any electric action exists between A and B.

For example, any of the following expressions can be used for the case where a source (or a first terminal or the like) of a transistor is electrically connected to X through (or not through) Z1 and a drain (or a second terminal or the like) of the transistor is electrically connected to Y through (or not through) Z2, or the case where a source (or a first terminal or the like) of a transistor is directly connected to one part of Z1 and another part of Z1 is directly connected to X while a drain (or a second terminal or the like) of the transistor is directly connected to one part of Z2 and another part of Z2 is directly connected to Y.

Examples of the expressions include, "X, Y, a source (or a first terminal or the like) of a transistor, and a drain (or a second terminal or the like) of the transistor are electrically connected to each other, and X, the source (or the first terminal or the like) of the transistor, the drain (or the second terminal or the like) of the transistor, and Y are electrically connected to each other in this order," "a source (or a first terminal or the like) of a transistor is electrically connected to X, a drain (or a second terminal or the like) of the transistor is electrically connected to Y, and X, the source (or the first terminal or the like) of the transistor, the drain (or the second terminal or the like) of the transistor, and Y are electrically connected to each other in this order," and "X is electrically connected to Y through a source (or a first terminal or the like) and a drain (or a second terminal or the like) of a transistor, and X, the source (or the first terminal or the like) of the transistor, the drain (or the second terminal or the like) of the transistor, and Y are provided to be connected in this order." When the connection order in a circuit configuration is defined by an expression similar to the above examples, a source (or a first terminal or the like) and a drain (or a second terminal or the like) of a transistor can be distinguished from each other to specify the technical scope.

Other examples of the expressions include "a source (or a first terminal or the like) of a transistor is electrically connected to X through at least a first connection path, the first connection path does not include a second connection path, the second connection path is a path between the source (or the first terminal or the like) of the transistor and a drain (or a second terminal or the like) of the transistor, Z1 is on the first connection path, the drain (or the second terminal or the like) of the transistor is electrically connected to Y through at least a third connection path, the third connection path does not include the second connection path, and Z2 is on the third connection path." It is also possible to use the expression "a source (or a first terminal or the like) of a transistor is electrically connected to X through at least Z1 on a first connection path, the first connection path does not include a second connection path, the second connection path includes a connection path through the transistor, a drain (or a second terminal or the like) of the transistor is electrically connected to Y through at least Z2 on a third connection path, and the third connection path does not include the second connection path." Still another example of the expression is "a source (or a first terminal or the like) of a transistor is electrically connected to X through at least Z1 on a first electrical path, the first electrical path does not include a second electrical path, the second electrical path is an electrical path from the source (or the first terminal or the like) of the transistor to a drain (or a second terminal or the like) of the transistor, the drain (or the second terminal or the like) of the transistor is electrically connected to Y through at least Z2 on a third electrical path, the third electrical path does not include a fourth electrical path, and the fourth electrical path is an electrical path from the drain (or the second terminal or the like) of the transistor to the source (or the first terminal or the like) of the transistor." When the connection path in a circuit structure is defined by an expression similar to the above examples, a source (or a first terminal or the like) and a drain (or a second terminal or the like) of a transistor can be distinguished from each other to specify the technical scope.

Note that one embodiment of the present invention is not limited to these expressions which are just examples. Here, each of X, Y, Z1, and Z2 denotes an object (e.g., a device, an element, a circuit, a wiring, an electrode, a terminal, a conductive film, a layer, or the like).

This application is based on Japanese Patent Application serial no. 2015-055382 filed with Japan Patent Office on Mar. 18, 2015, the entire contents of which are hereby incorporated by reference.

What is claimed is:

1. A display device comprising:

a switch;

a transistor;

a capacitor; and a light-emitting element, wherein a first electrode of the capacitor is electrically connected to a gate of the transistor, wherein a second electrode of the capacitor is electrically connected to one of a source and a drain of the transistor, wherein the second electrode of the capacitor is electrically connected to a first electrode of the light-emitting element, wherein a data voltage is applied to the gate of the transistor by turning on the switch during a first period, wherein a first potential is applied to the other of the source and the drain of the transistor during the first period, wherein the light-emitting element emits light during a second period, wherein the switch is turned off during the second period, wherein a second potential is applied to the other of the source and the drain of the transistor during the second period, and wherein the first potential is smaller than the second potential.

2. The display device according to claim 1, wherein the first potential is equal to a potential applied to the second electrode.

3. The display device according to claim 1, wherein the transistor includes an oxide semiconductor in a channel formation region of the transistor.

4. An electronic device comprising the display device according to claim 1, wherein the electronic device comprises an operation portion.

5. A method for driving a display device, the display device comprising:

a switch;

a transistor;

a capacitor; and a light-emitting element;

wherein a first electrode of the capacitor is electrically connected to a gate of the transistor, wherein a second electrode of the capacitor is electrically connected to one of a source and a drain of the transistor, wherein the second electrode of the capacitor is electrically connected to a first electrode of the light-emitting element, the method comprising the steps of:

holding a threshold voltage of the transistor in the capacitor between the gate and one of the source and the drain during a first period;

holding the threshold voltage added with a voltage corresponding to a data voltage in the capacitor during a second period;

applying a first potential to the other of the source and the drain of the transistor during the second period;

applying a second potential to the one of the source and the drain of the transistor during the second period; and driving the light-emitting element during a third period, wherein the first potential is smaller than the second potential.

6. A method for driving a display device, the display device comprising:

a switch;

a transistor;

a capacitor; and a light-emitting element;

wherein a first electrode of the capacitor is electrically connected to a gate of the transistor, wherein a second electrode of the capacitor is electrically connected to one of a source and a drain of the transistor, wherein the second electrode of the capacitor is electrically connected to a first electrode of the light-emitting element, the method comprising the steps of:

holding a threshold voltage of the transistor in the capacitor between the gate and one of the source and the drain during a first period;

holding the threshold voltage added with a voltage corresponding to a data voltage in the capacitor during a second period;

applying a first potential to the other of the source and the drain of the transistor during the second period;

applying a second potential to the one of the source and the drain of the transistor during the second period; and driving the light-emitting element during a third period, wherein the first potential is smaller than the second potential, and wherein during the first period, a potential smaller than a potential applied to a second electrode of the light-emitting element is applied to the other of the source and the drain.

7. The method for driving a display device, according to claim 5, wherein the display device comprises a plurality of pixels each including the switch, the transistor, the capacitor, and the light-emitting element, wherein an operation during the first period is carried out by switching the switches of the plurality of the pixels at the same time, and wherein an operation during the second period is carried out by switching the switches of the plurality of pixels row by row.

8. The method for driving a display device, according to claim 6, wherein the potential applied to the other of the source and the drain of the transistor during the second period is equal to the potential applied to the second electrode of the light-emitting element.

* * * * *